US010525369B2

(12) United States Patent
Hohns et al.

(10) Patent No.: US 10,525,369 B2
(45) **Date of Patent: *Jan. 7, 2020**

(54) INTERCHANGEABLE COMPONENTS FOR WATER AND CONVERTIBLE TOYS

(71) Applicant: Toyosity, LLC, Orlando, FL (US)

(72) Inventors: William Hohns, Windermere, FL (US); Marcellus Rambo Benson, II, Rockledge, FL (US); Patrick Hohns, Orlando, FL (US); Jordan Reardon, Orlando, FL (US); Mark Santus, Daytona Beach, FL (US)

(73) Assignee: Toyosity, LLC, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/155,693

(22) Filed: Oct. 9, 2018

(65) Prior Publication Data

US 2019/0038986 A1 Feb. 7, 2019

Related U.S. Application Data

(60) Continuation-in-part of application No. 15/276,191, filed on Sep. 26, 2016, now Pat. No. 10,159,904, (Continued)

(51) Int. Cl.

| | |
|---|---|
| ***A63H 23/10*** | (2006.01) |
| ***A63H 23/02*** | (2006.01) |
| ***A63H 3/26*** | (2006.01) |

(52) U.S. Cl.

CPC ..... *A63H 23/10* (2013.01); *A63H 3/26* (2013.01); *A63H 23/02* (2013.01)

(58) Field of Classification Search

USPC ..... 446/15, 120, 121, 124, 127, 156, 155, 446/160, 153; 441/65, 74, 79; 273/441

See application file for complete search history.

(56) References Cited

U.S. PATENT DOCUMENTS

| | | | |
|---|---|---|---|
| 83,420 | A | 10/1868 | Stoner |
| 954,544 | A | 4/1910 | Sanford |

(Continued)

FOREIGN PATENT DOCUMENTS

| | | |
|---|---|---|
| AU | 2990389 | 6/1990 |
| AU | 5184593 | 6/1994 |

(Continued)

OTHER PUBLICATIONS

Thompson, J., Toy Surfboard, PCT Patent Application No. PCT/US2013/040510 filed May 10, 2013, PCT Search Report dated Aug. 12, 2013, 12 pages.

(Continued)

*Primary Examiner* — Kurt Fernstrom

(74) *Attorney, Agent, or Firm* — Brian S. Steinberger; Hilary F. Steinberger; Law Offices of Brian S. Steinberger, P.A.

(57) ABSTRACT

Surfing and water toys, apparatus, devices and methods for interchanging upwardly protruding objects on the toy and attaching and detaching hydrofoil underneath comprising a skeg and wings/vanes. Apparatus, devices and methods, for converting the toys to non-surfing and non-water uses which include skateboards, sleds and snowboards. Apparatus, devices and methods for providing carve sticks to guide the toys.

20 Claims, 68 Drawing Sheets

Related U.S. Application Data which is a division of application No. 15/074,513, filed on Mar. 18, 2016, now Pat. No. 9,474,983, which is a continuation-in-part of application No. 14/550,440, filed on Nov. 21, 2014, now Pat. No. 9,352,239, which is a continuation-in-part of application No. 13/788,355, filed on Mar. 7, 2013, now Pat. No. 8,894,460, which is a continuation of application No. 29/447,627, filed on Mar. 5, 2013, now Pat. No. Des. 711,485.

(60) Provisional application No. 61/647,910, filed on May 16, 2012.

(56) References Cited

U.S. PATENT DOCUMENTS

| | | | | |
|---|---|---|---|---|
| 1,399,855 | A | 12/1921 | Fierlein | |
| 1,758,289 | A | 5/1930 | Loy | |
| D133,078 | S | 7/1942 | Lee | |
| D168,807 | S | 2/1953 | Reuther | |
| 3,160,897 | A | 12/1964 | Kelly | |
| 3,721,037 | A | 3/1973 | Allen | |
| 3,721,038 | A | 3/1973 | Viczena | |
| 3,871,127 | A | 3/1975 | Heath | |
| 4,320,546 | A | 3/1982 | Knox | |
| 4,768,988 | A | 9/1988 | Rutter | |
| 4,802,429 | A | 2/1989 | Butka | |
| 4,857,025 | A | 8/1989 | Brown | |
| 4,865,337 | A * | 9/1989 | Disler | A63H 17/262 280/7.1 |
| 4,923,427 | A | 5/1990 | Roland | |
| D312,491 | S | 11/1990 | Roland | |
| 4,968,273 | A | 11/1990 | Momot | |
| 5,063,869 | A | 11/1991 | Bielefeldt | |
| 5,069,648 | A | 12/1991 | Ozeki | |
| D324,706 | S | 3/1992 | Gibson | |
| 5,250,001 | A * | 10/1993 | Hansen | A63H 33/04 24/573.09 |
| D424,569 | S | 5/2000 | Augusta | |
| 6,167,829 | B1 | 1/2001 | Lang | |
| 6,183,333 | B1 | 2/2001 | Hall | |
| 6,238,261 | B1 * | 5/2001 | Lang | A63H 33/22 434/407 |
| D455,186 | S | 4/2002 | Koester | |
| 6,478,650 | B1 | 11/2002 | Tsai | |
| 6,551,157 | B1 | 4/2003 | Bishop | |
| 6,692,321 | B2 | 2/2004 | Metrot | |
| 6,699,091 | B1 | 3/2004 | Warner | |
| D496,491 | S | 9/2004 | Chen | |
| 6,793,552 | B2 | 9/2004 | Derrah | |
| D498,559 | S | 11/2004 | Pan | |
| 6,817,308 | B1 | 11/2004 | Millder | |
| 6,863,583 | B2 | 3/2005 | Takahashi | |
| D515,684 | S | 2/2006 | Latone | |
| D560,030 | S | 1/2008 | Welch | |
| 7,401,786 | B2 | 7/2008 | Lochtefeld | |
| 8,650,807 | B2 * | 2/2014 | McKimmy | E04B 1/34321 403/315 |
| D711,485 | S | 8/2014 | Thompson | |
| 8,813,417 | B2 | 8/2014 | Bland | |
| 8,894,460 | B1 | 11/2014 | Thompson | |
| 8,894,463 | B2 | 11/2014 | Chan | |
| 9,064,200 | B2 * | 6/2015 | Trzaskos | G06K 13/0831 |
| 9,352,239 | B2 | 5/2016 | Hohns | |
| 9,474,983 | B2 | 10/2016 | Hohns et al. | |
| 10,159,904 | B2 | 12/2018 | Hohns et al. | |
| 2005/0109257 | A1 | 5/2005 | Lang | |
| 2008/0064239 | A1 * | 3/2008 | Li | H01R 13/635 439/152 |
| 2013/0173182 | A1 | 11/2013 | Thompson | |
| 2015/0104985 | A1 | 4/2015 | Langelaan | |

FOREIGN PATENT DOCUMENTS

| | | |
|---|---|---|
| WO | 8809286 | 12/1988 |
| WO | 9823345 | 6/1998 |
| WO | 9948581 | 9/1999 |

OTHER PUBLICATIONS

Toyosity, LLC, Toy Surfboard, Chinese Patent Application/Patent No. 201380024950.1 filed Nov. 11, 2014, Notice on the First Office Action (PCT Application in the National Phase), dated Dec. 30, 2015, 24 pages.

Toyosity, LLC, Improvements to Surfing Toy, PCT Patent Application No. PCT/US2017/022694 filed Mar. 16, 2017, Notification Concerning Transmittal of International Preliminary Report on Patentability dated Sep. 27, 2018, 23 pages.

* cited by examiner

INTERCHANGEABLE COMPONENTS FOR WATER AND CONVERTIBLE TOYS

CROSS REFERENCE TO RELATED APPLICATIONS

This application is a Continuation-In-Part of U.S. patent application Ser. No. 15/276,191 filed Sep. 26, 2016, now U.S. Pat. No. 10,159,904, which is a Divisional of U.S. patent application Ser. No. 15/074,513 filed Mar. 18, 2016, now U.S. Pat. No. 9,474,983, which is a Continuation-In-Part of U.S. patent application Ser. No. 14/550,440 filed Nov. 21, 2014, now U.S. Pat. No. 9,352,239 issued May 31, 2016, which is a Continuation-In-Part of U.S. Patent application Ser. No. 13/788,355 filed Mar. 7, 2013, now U.S. Pat. No. 8,894,460 issued Nov. 25, 2014, which claims the benefit of priority to U.S. Provisional Patent Application Ser. No. 61/647,910 filed May 16, 2012 and U.S. Design Patent application Serial No. 29/447,627 filed Mar. 5, 2013, now U.S. Design Patent D711,485 issued Aug. 19, 2014. The entire disclosure of each of the applications listed in this paragraph is incorporated herein by specific reference thereto.

FIELD OF INVENTION

This invention relates to toys, and in particular to apparatus, devices, systems and methods of providing interchangeable components for surfing and water toys that allow for different figures to be attached and the toys to be disassembled and reassembled, and converting the toys to non-surfing and non-water uses which include skateboards, sleds and snowboards, and provide carve sticks to guide the toys.

BACKGROUND AND PRIOR ART

Popular marketed water toys over the years have generally included balls and blow up toys which may be fun to some but would have limited fun to others. Many traditional toys, such as dolls and the like, may also sink in the water or float out to sea, both of which would not be desirable. The inventor is not aware of any marketed water toys that would be popular with surfers and beachgoers that are able to take advantage of the direction and power of incoming waves found along ocean and large lake shorelines.

A check of the U.S. Patent Office database has shown that some patents on surfing type toys have been proposed in years past. See for example, U.S. patents: U.S. Pat. No. Des. 312,491 to Roland; U.S. Pat. No. Des. 324,706 to Gibson, and U.S. Pat. No. 4,923,427 to Roland.

Although both Roland patents reference having heavy keels/fins, these toys are primarily for show. The downwardly protruding keels/fins would have difficulty in balancing the toy and keeping it in an upright position in the water.

Gibson '706 shows a surfer doll on top of a toy surfboard. The large mass of the doll compared to the thin toy board and single fin would not be able to balance in the water and would not be able to ride waves coming to shore at a beach. The top heavy doll would undoubtedly cause the toy to capsize if used in the water without someone's hand holding the toy upright.

Furthermore, there is a good chance that Gibson '706 and possibly the Roland products would end up floating away and not being able to return to the shoreline which could result in the loss of these toys.

Thus, the need exists for solutions to the above problems with the prior art.

SUMMARY OF THE INVENTION

A primary objective of the present invention is to provide water toys, apparatus and methods of playing a game with a figurine mounted on a water toy and a hydrofoil rudder underneath the toy for allowing the toy to ride incoming waves back to a shoreline.

A secondary objective of the present invention is to provide water toys, apparatus and methods of playing a game, having a buoyant toy with a weighted hydrofoil which offsets the weight of a figurine mounted on the toy which is able to continuously float on water in an upright position.

A third objective of the present invention is to provide water toys, apparatus and methods of playing a game, having figurines that can interchangeably be mounted to the top of the toy.

A fourth objective of the present invention is to provide water toys, apparatus and methods of playing a game with a figurine mounted on a toy and a hydrofoil rudder underneath the toy, where players can simultaneously toss or throw respective toys, and determine a winner of the first toy to reach the shoreline.

A fifth objective of the present invention is to provide water toys, apparatus and methods, which turn right-side up, point toward the shore after being put into a incoming shore wave, and return to the shore each time it is used where the toy rides or "surfs" the wave to the shore.

A sixth objective of the present invention is to provide water toys, apparatus and methods, which take advantage of the waves at a beach, instead of being overwhelmed, where a figurine on the toy stays upright and rides or "surfs" the waves all the way to the shore.

A seventh objective of the present invention is to provide water toys, apparatus and methods, having a figurine, flotation device, including toy hulls, boats, and similar apparatus that would operate in a similar fashion to a toy surfboard, skeg and wing (hydrofoil) which can be in separate pieces that easily snap together when assembled.

An eighth objective of the present invention is to provide water toys, apparatus and methods, having a figurine and upper portion of a skeg with mateable attachment points to one another through holes that pass through the flotation device.

A ninth objective of the present invention is to provide water toys, apparatus and methods, having figurines with rounded, and non sharp tip edges (such as on hair ends and hand ends) that will not easily break off, and are safe to use.

A tenth objective of the present invention is to provide water toys, apparatus and methods, with a hydrofoil (wings) that do not break off when the toy is stepped upon.

An eleventh objective of the present invention is to provide water toys, apparatus and methods, having separate figurine, flotation device, skeg and main wing that when separated can easily be packaged together taking up less space than a fully assembled or partially assembled toy.

A twelfth objective of the present invention is to provide water toys, apparatus and methods, that can perform tricks similar to real surfers in surf and waves through its unique weighting and balancing.

A thirteenth objective of the present invention is to provide water toys, apparatus and methods, that can interchange different upwardly protruding objects thereon, such as but not limited to figures, characters, animals, vehicles, and the like.

A fourteenth objective of the present invention is to provide water toys, apparatus and methods, that can include wings/vanes that can be bendable to different positions to alter or enhance the toy's performance.

A fifteenth objective of the present invention is to provide water toys, apparatus and methods that can use different versions of pegs or attachment points to attach the main wing, skeg, flotation device and upwardly protruding objects together.

A sixteenth objective of the present invention is to provide water toys, apparatus and methods that can be used with sails or windsurf sails to allow the toy to be self propelled through any water surface, such as but not limited to swimming pools, lakes, ponds, and the like.

A seventeenth objective of the present invention is to provide water toys, apparatus and methods can be pulled through the water with motorboats and/or fishing poles.

An eighteenth objective of the present invention is to provide apparatus, devices and methods for interchanging upwardly protruding objects on surfing and water toys, so that different figures can be used in combinations together or used separately.

A nineteenth objective of the present invention is to provide apparatus, devices and methods and for attaching and easily disassembling figurines on surfing and water toys, and assembling and disassembling hydrofoil parts underneath that can include a skeg and wings/vanes.

A twentieth objective of the present invention is to provide apparatus, devices and methods for converting surfing and water toys to non-surfing and non-water toys that can include skateboards, sleds and snowboards.

A twenty first objective of the present invention is to provide apparatus, devices and methods for surfing and water toys, skateboard toys, sled toys and snowboard toys having carve sticks to guide the toys.

Different embodiments of a water toy can include an elongated flotation device with front and rear ends, and top and bottom surfaces, an upwardly protruding object being attachable and detachable to the top surface adjacent to the rear end of the flotation device, the upwardly protruding object having an upwardly protruding object weight, a skeg having an upper end and a lower end, the upper end being attachable and detachable to the bottom surface of the flotation device underneath the figurine, and a main wing with a left rearward extending vane and a right rearward extending vane, wherein a mid portion of the main wing is attached to the lower end of the skeg, the main wing and skeg having a weight heavier than the weight of the upwardly protruding object so as to cause the toy to move to a standup position in water.

The upwardly protruding object can be selected from at least one of a male figure, a female figure, a cartoon figure, and an animal, and combinations thereof.

The upwardly protruding object can be selected from at least one of an automobile, a truck, a bus, a van, and other types of vehicles for toys.

The upwardly protruding object can be selected from at least one of a main sail and a windsurf sail.

The toy can include at least one weight in either or each of the right vane and the left vane.

The toy can include a weight in at least one of a front middle of the main wing and in a tail extending behind the main wing.

The toy can include at least one weight in the skeg of the hydrofoil.

The toy can include at least one bend line in the center vane, and/or least one bend line in the left vane and/or at least one bend line in the right vane, wherein the bend lines are adapted to allow the user of the toy to select different bent positions of the left, right, and/or center vanes.

The toy can include a first peg extending downward from a bottom of the upwardly protruding object with a fastener end, a second peg extending upward from a top of the skeg with a fastener end, and a pair of through-holes in the flotation device for allowing the first and second peg to pass through, wherein the first hook end attaches to an upper slot in the skeg, and the second hook end attaches to a lower slot in the upwardly protruding object.

The main wing can include a keyhole slot through which allows for the main wing to twist and lock onto a bottom portion of the skeg.

The main wing can include an elongated indentation on an upper surface with side tracks, which can slide about an enlarged bottom plate portion on the skeg.

The toy can include a through-hole in the flotation device, a peg upwardly extending from a top of the skeg with fastener ends, an enlarged bottom portion of the skeg, and an elongated through-hole in the main wing, wherein the peg on the skeg passes through the through-hole in the main wing with the fastener ends passing through the through-holes in the flotation device to attach to a lower portion of the upwardly protruding object on top of the flotation device.

The through-hole in the flotation device can include two through-holes, and the upwardly extending peg on the skeg can include two upwardly protruding pegs.

The toy can include a single peg for attaching the skeg with the flotation device and to the upwardly protruding object.

The upwardly protruding object can include a sail and a figurine, which together can be rotatable relative to the flotation device.

The upwardly protruding object can include sail with mast portion being rotatable relative to the flotation device.

A method of using a toy, can include the steps of providing a flotation device having a top surface, a bottom surface, a front end and a rear end, attaching a skeg to the bottom surface of the flotation device, attaching a main wing having a left wing vane and right wing vane to a bottom of the skeg, attaching a sail to the flotation device, and moving the toy through water with the sail.

A method of using a toy, can include the steps of providing a flotation device having a top surface, a bottom surface, a front end and a rear end, attaching a skeg to the flotation device, attaching a main wing having a left wing vane and right wing vane to a bottom of the skeg, and pulling the toy with a line through water.

The pulling step can include towing the toy through the water with a motorboat.

The pulling step can include moving the toy through the water with a fishing rod.

A water toy having figurines and a hydrofoil and flotation device which parts are able to be easily assembled and disassembled from one another, can include an elongated flotation device with front and rear ends, and top and bottom surfaces, and at least one slot extending between the top and bottom surfaces, a hydrofoil with a skeg and main wing, the skeg including an upwardly protruding member with a top cavity, the upwardly protruding member insertable into the bottom of the flotation device into the at least one slot, and at least one figurine, each figurine having at least one peg member extending beneath, wherein the peg is insertable into the top of the flotation device into the at least one slot and into the top cavity of the upwardly protruding member so as to lock the elongated flotation device and hydrofoil and figurine in an assembled position.

The flotation device can include a surfboard configuration.

The at least one slot extending between the top and bottom surfaces of the flotation device can include a plurality of slots spaced apart from one another extending between the top and bottom surfaces of the flotation device, and wherein the at least one figurine includes a plurality of different figurines. Each slot can include a wider opening through the bottom surface of the flotation device compared to a narrower opening through the top surface of the flotation device.

Each upwardly protruding member can have an upper portion and a lower portion, the upper portion being narrower in width than the lower portion.

The water toy can include a catch and an edge for allowing the peg on the figurine to lockably attach into the cavity in the upwardly protruding member on the skeg. The water toy can include a catch and an edge for allowing the main wing to lockably attach to the skeg.

The water toy can include a pin for pushing against the catch so that the catch detaches from the edge and allows the figurine to disassemble from the flotation device. The water toy can include a pin for pushing against the catch so that the catch detaches from the edge and allows the main wing to disassemble from the skeg.

The plurality of slots each include a wider opening through the bottom surface of the flotation device compared to a narrower opening through the top surface of the flotation device.

The upwardly protruding member can include a plurality of upwardly protruding members, each member having an upper portion and a lower portion, the upper portion being narrower in width than the lower portion. Each upwardly protruding member can include a catch and edge for allowing the peg on each figurine to lockably attach into each cavity in the upwardly protruding member on the skeg.

The main wing and skeg can include a lower catch and lower edge to lockably attach the wing to the skeg.

The plurality of figurines can be selected from at least one of, but not limited to, a male shape, a female shape, an alien, an animal shape or a fish shape.

The surfboard toy can be converted into a skateboard with wheels.

The surfboard toy can be converted into a sled having rails.

The surfboard toy can be converted into a snowboard.

A carving stick can be attached to surfboard toy to allow the toy to carve through the water. The carving stick can be used with the skateboard conversion, the sled conversion and snowboard conversion.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

Second Embodiment

Figure 22:
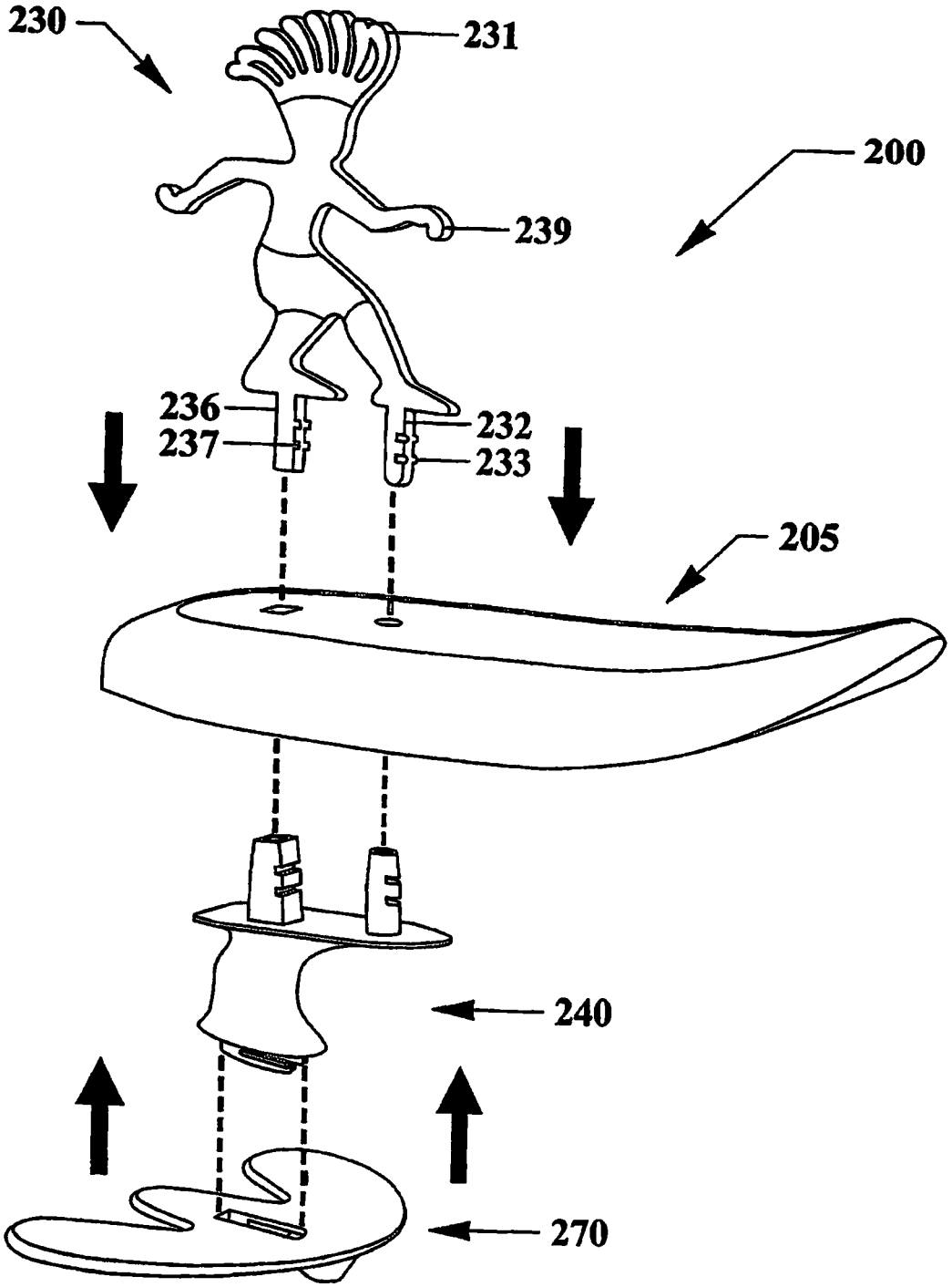

FIG. 22 is an exploded view of another embodiment of the toy with figurine, flotation device, skeg and main wing (hydrofoil).

Figure 23:
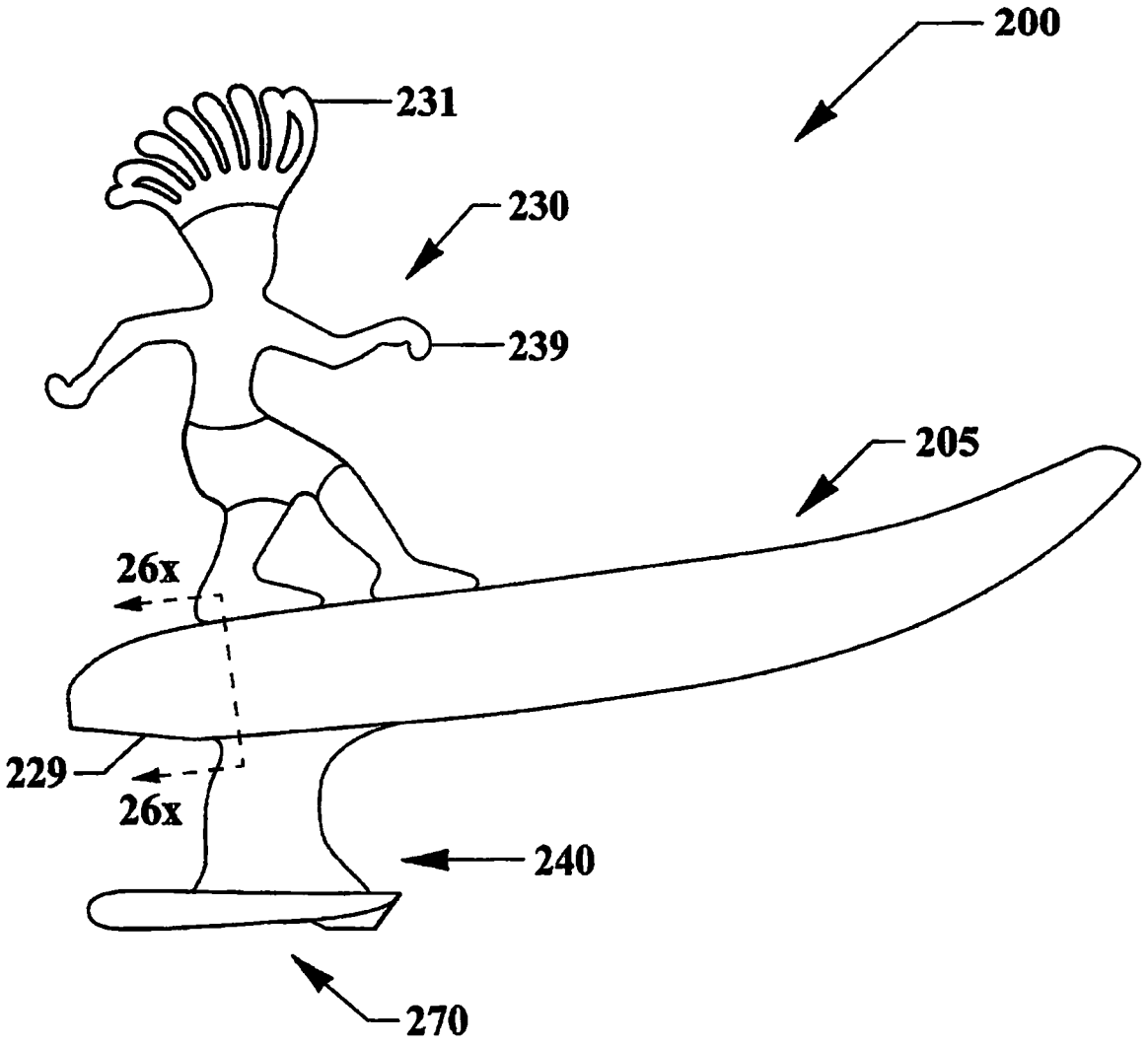

FIG. 23 is a side assembled view of the toy with figurine, flotation device, skeg and main wing of FIG. 22.

Figure 24:
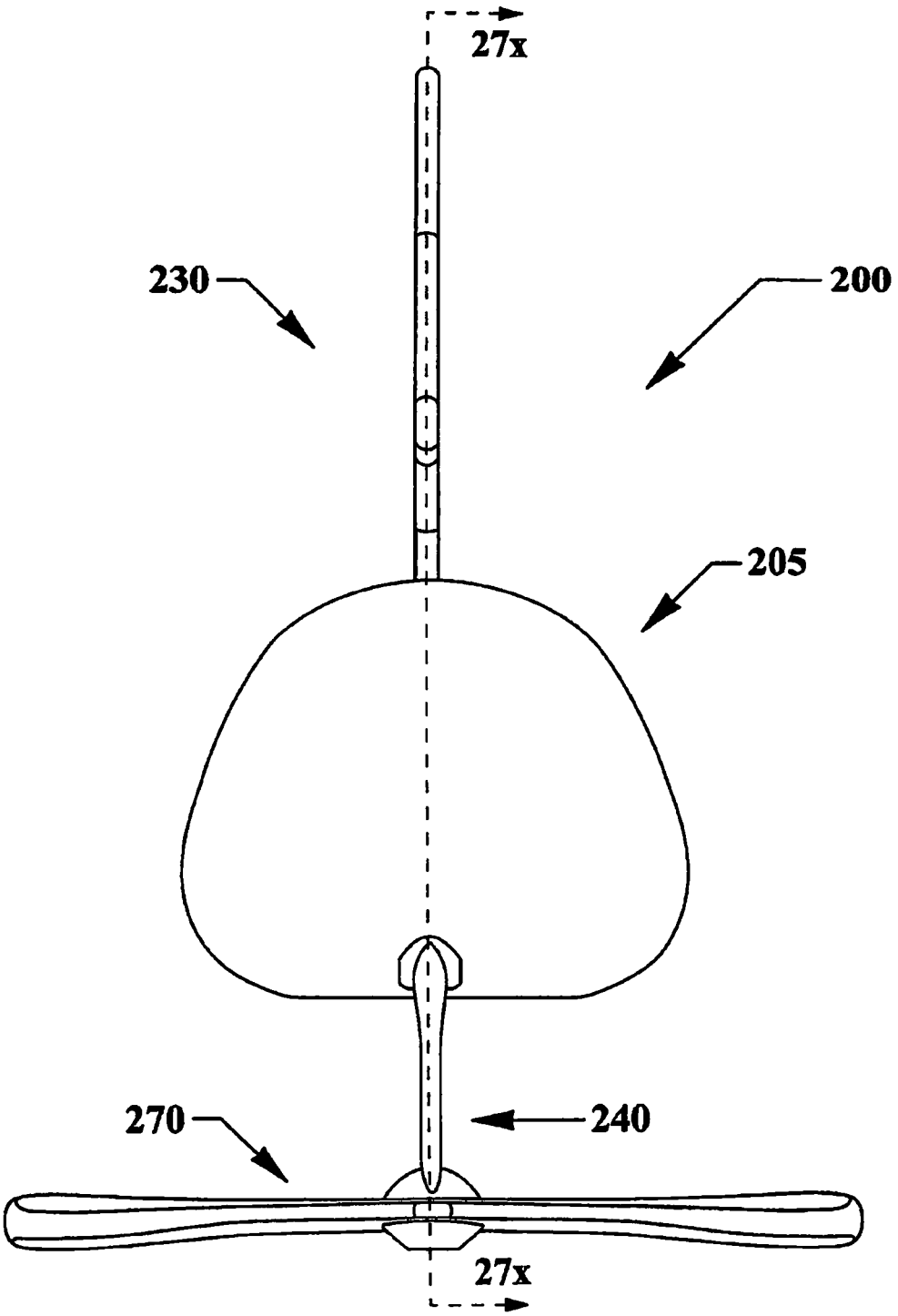

FIG. 24 is a front view of the assembled toy of FIG. 23.

Figure 25:
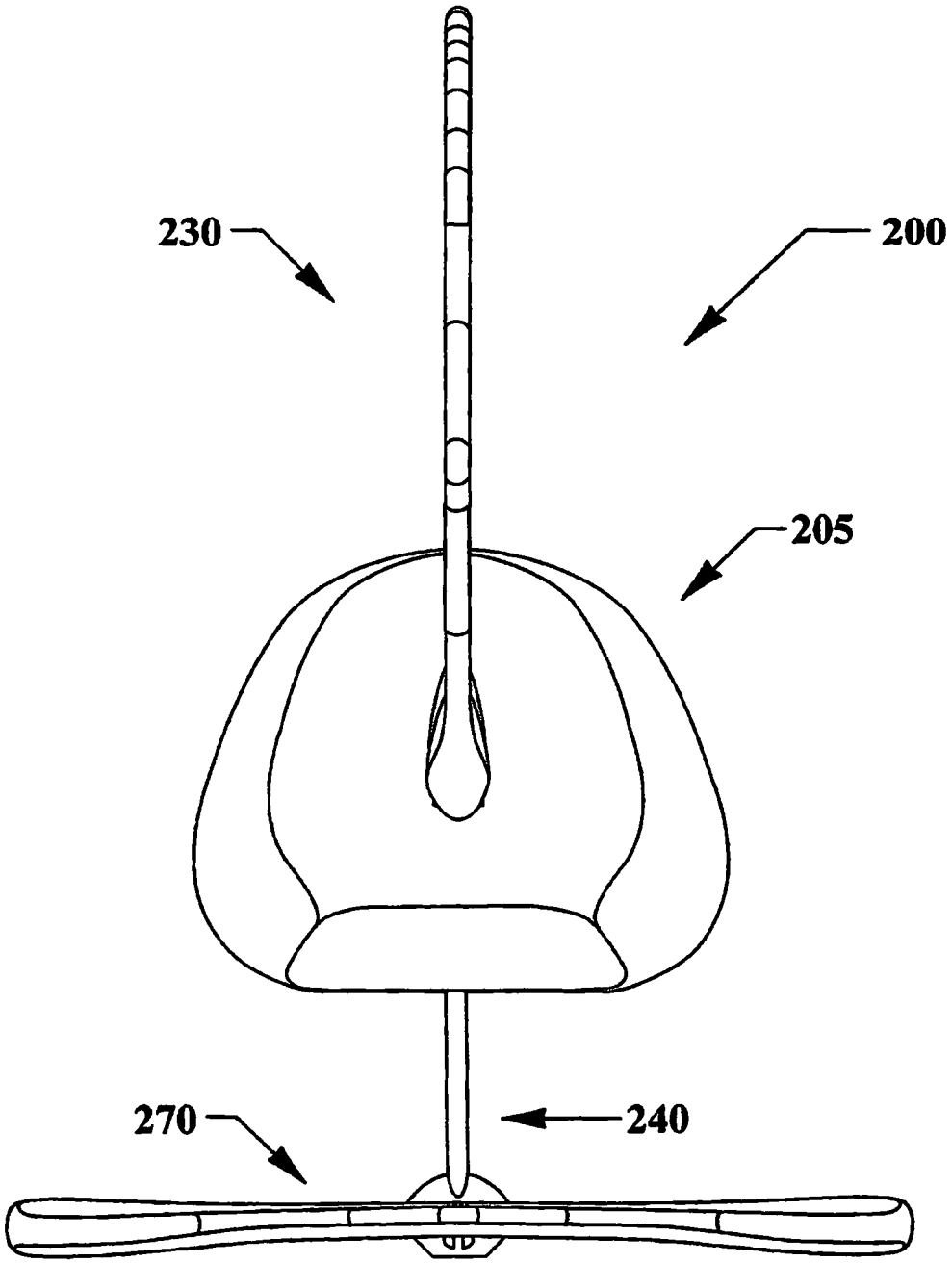

FIG. 25 is a rear view of the assembled toy of FIG. 23.

Figure 26:
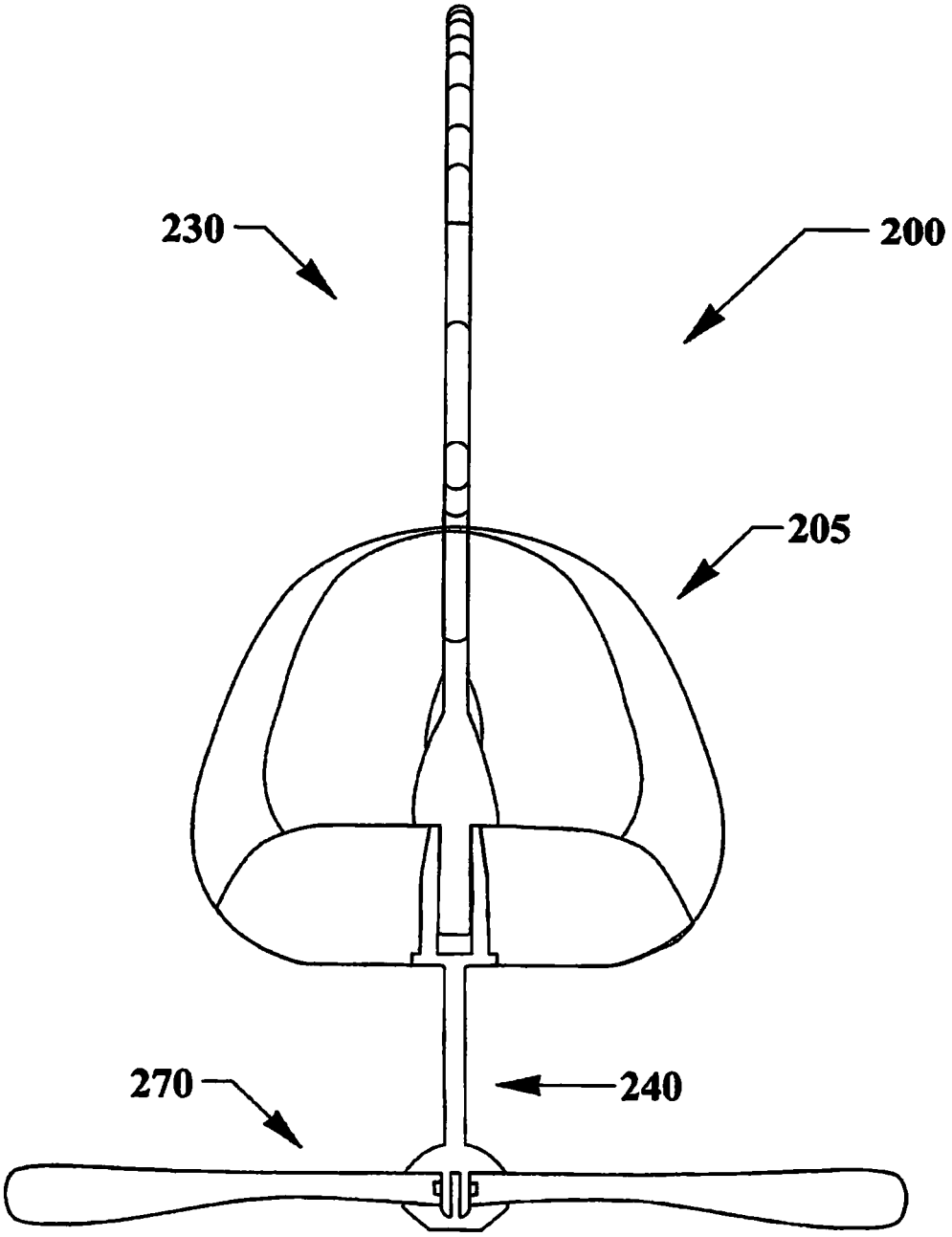

FIG. 26 is a cross-sectional view of the assembled toy of FIG. 23 along arrows 26X.

Figure 27:
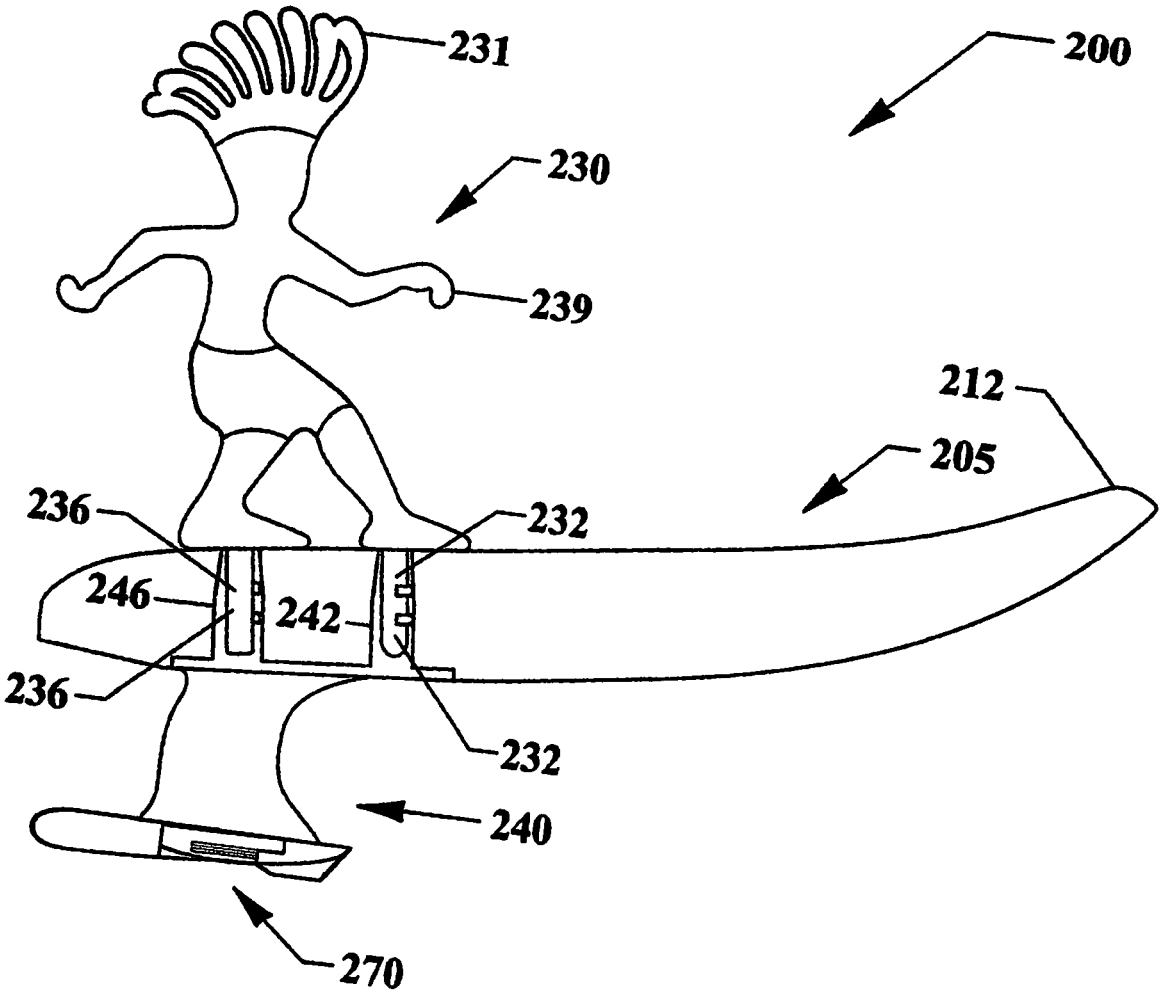

FIG. 27 is a side cross-sectional view of the assembled toy of FIG. 24 along arrows 27X.

Figure 28:
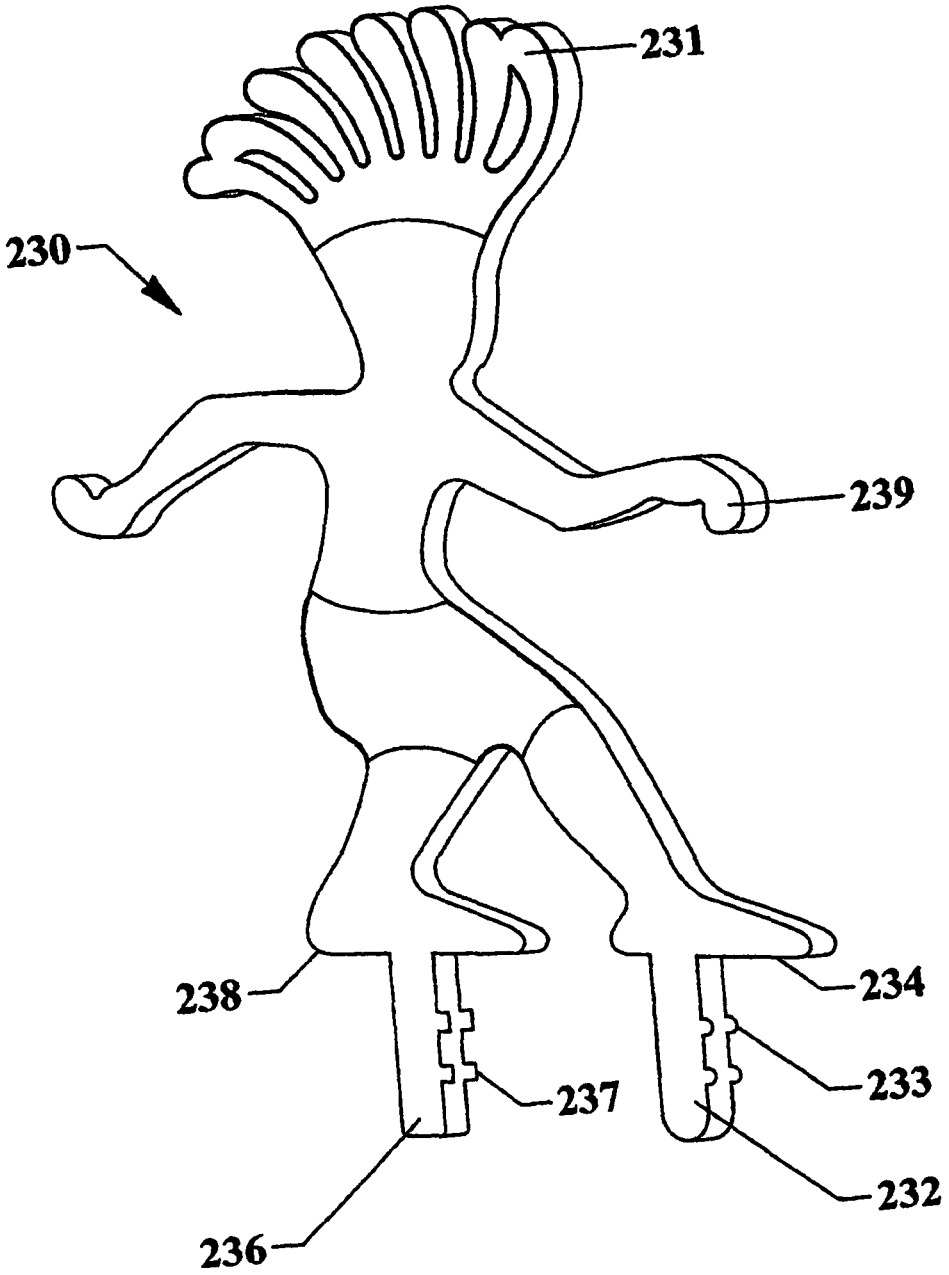

FIG. 28 is an enlarged perspective view of the separated figurine of FIGS. 22-27.

Figure 29:
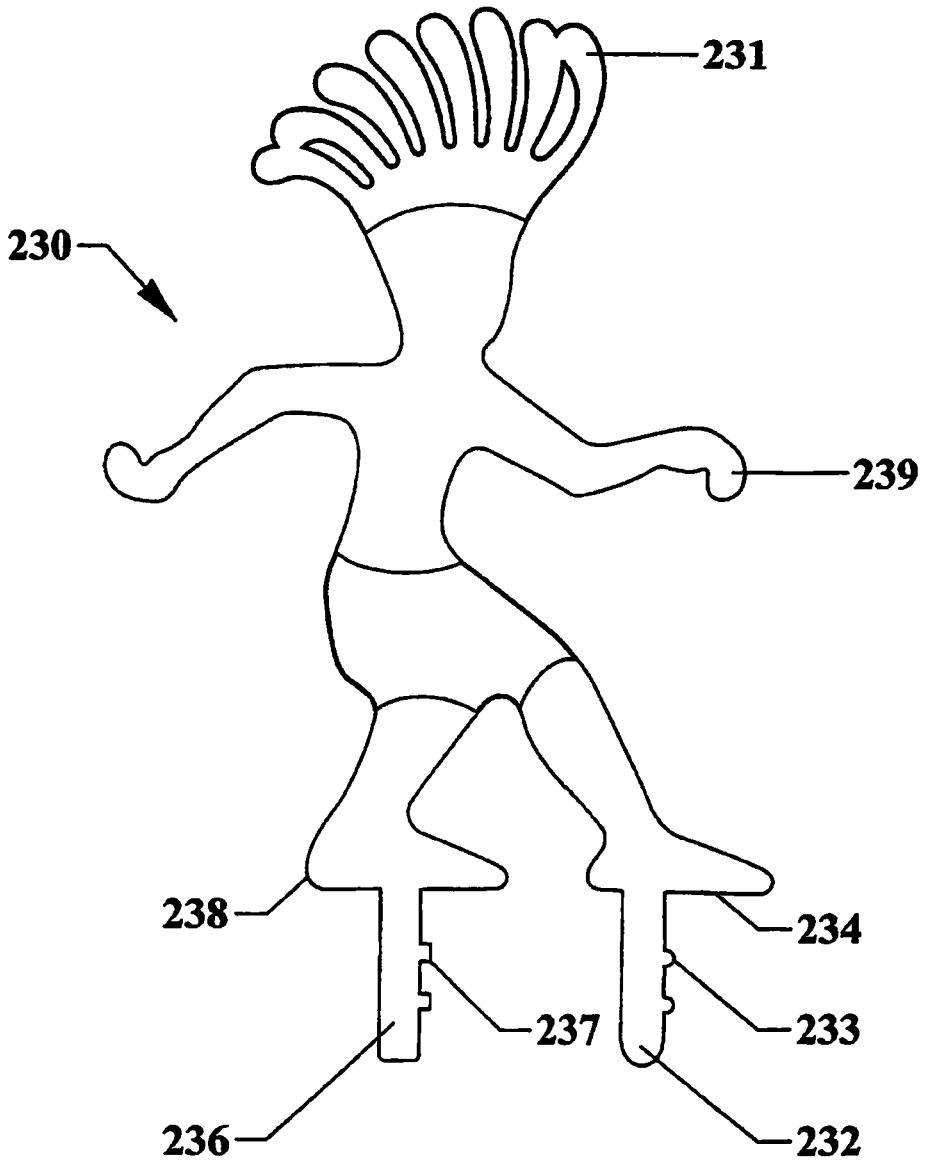

FIG. 29 is a side view of the figurine of FIG. 28.

Figure 30:
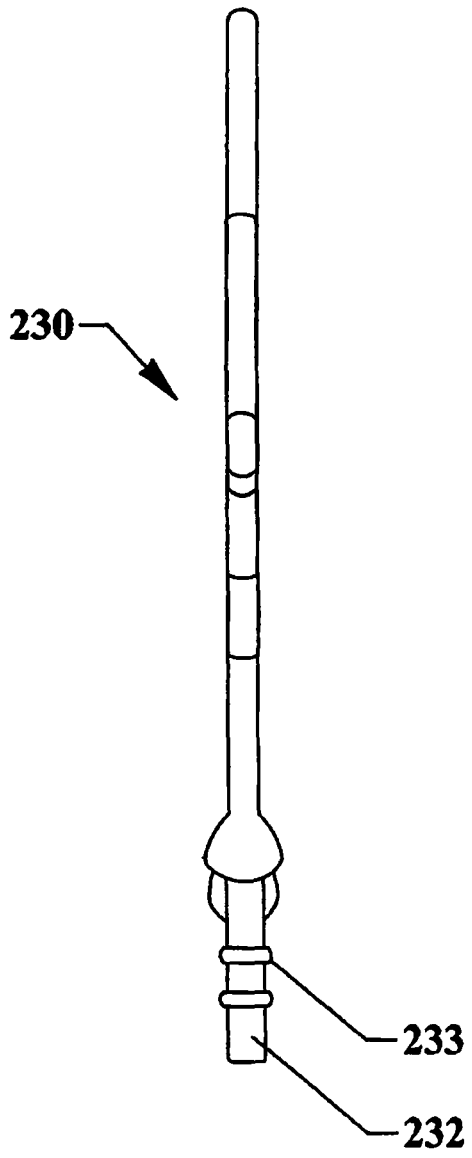

FIG. 30 is a front view of the figurine of FIG. 28.

Figure 31:
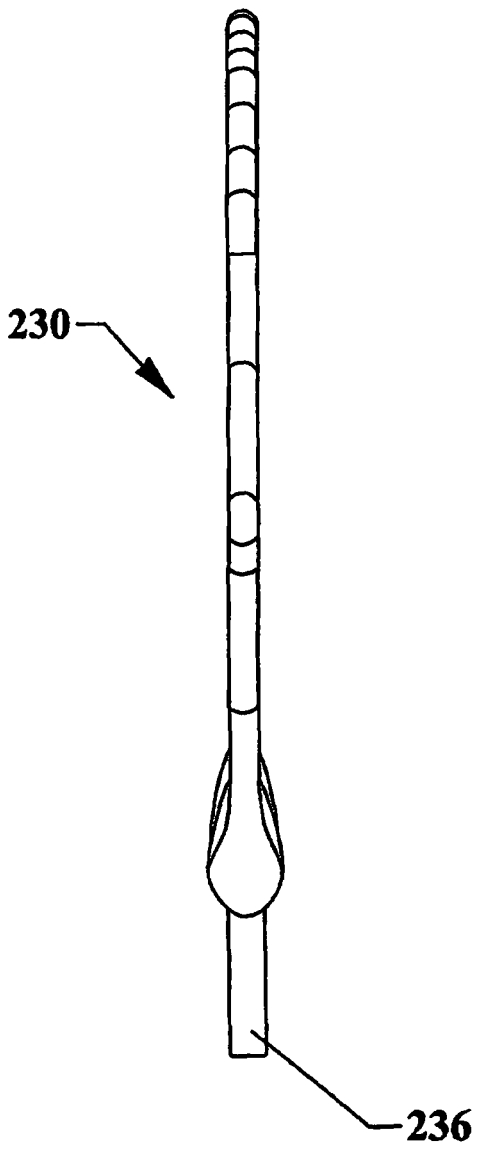

FIG. 31 is a rear view of the figurine of FIG. 28.

Figure 32:
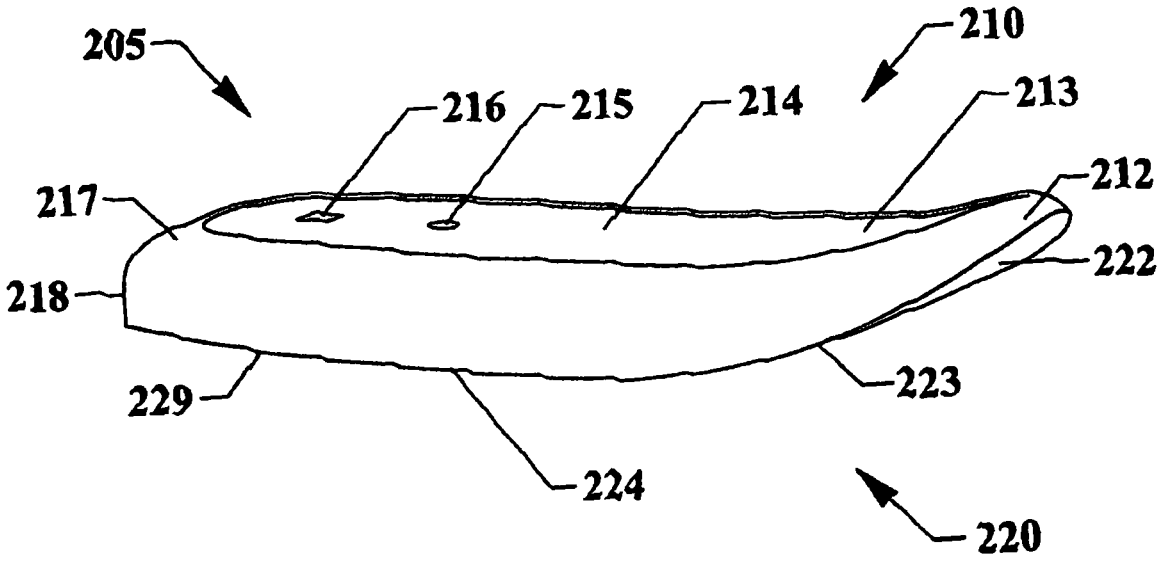

FIG. 32 is an enlarged perspective view of the separated flotation device of FIGS. 22-27.

Figure 33:
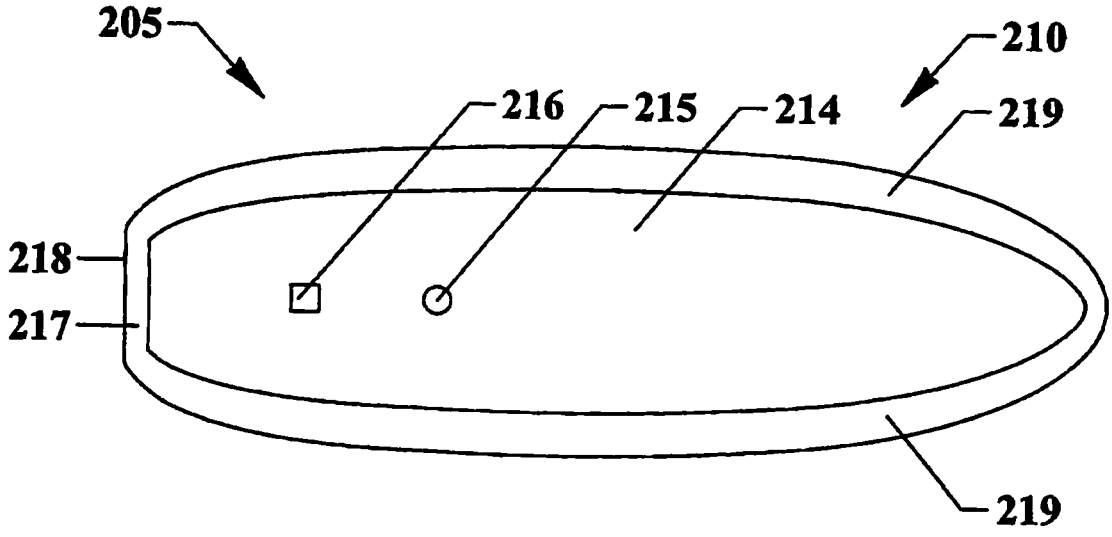

FIG. 33 is a top view of the flotation device of FIG. 32.

Figure 34:
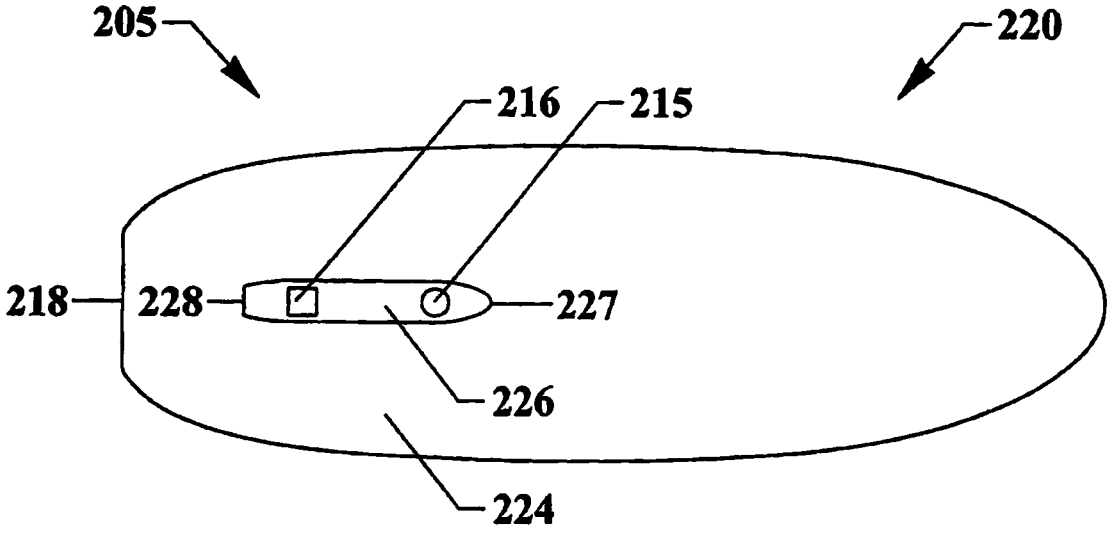

FIG. 34 is a bottom view of the flotation device of FIG. 32.

Figure 35:
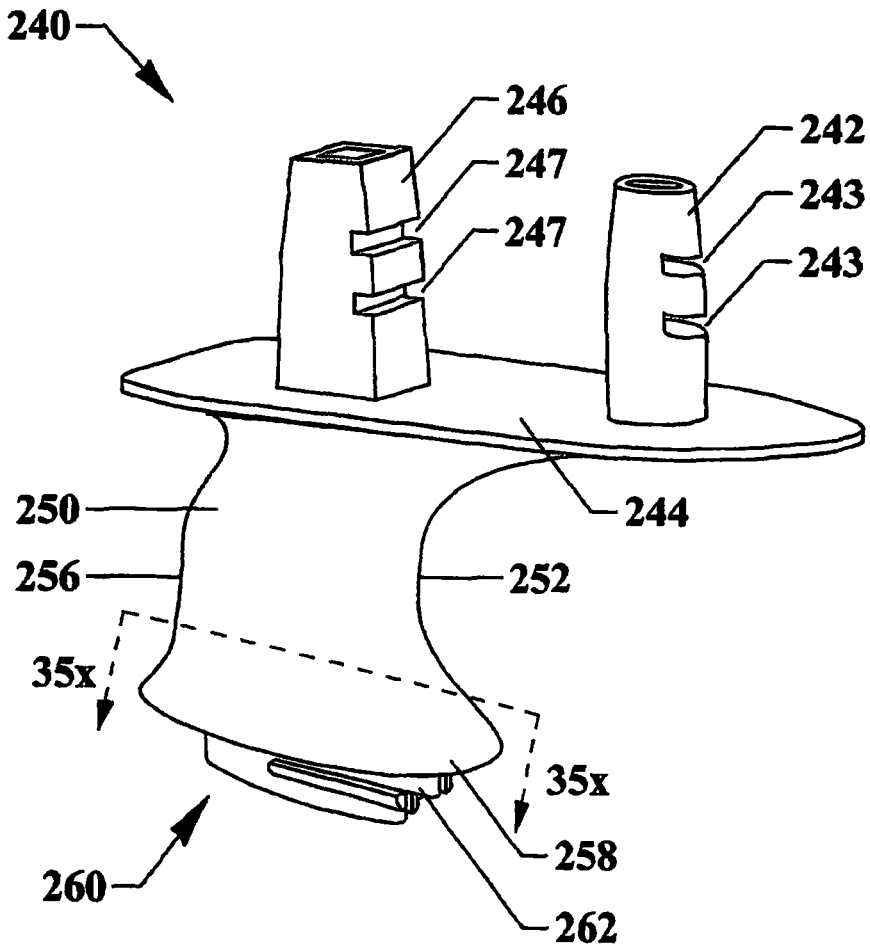

FIG. 35 is an enlarged perspective view of the separated keel/strut member (skeg) of FIGS. 22-27.

Figure 35A:
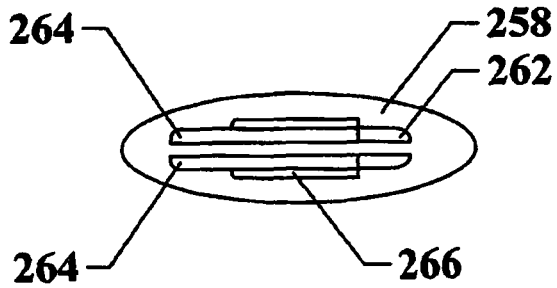

FIG. 35A is a bottom view of the skeg of FIG. 35 along arrow 35X.

Figure 36:
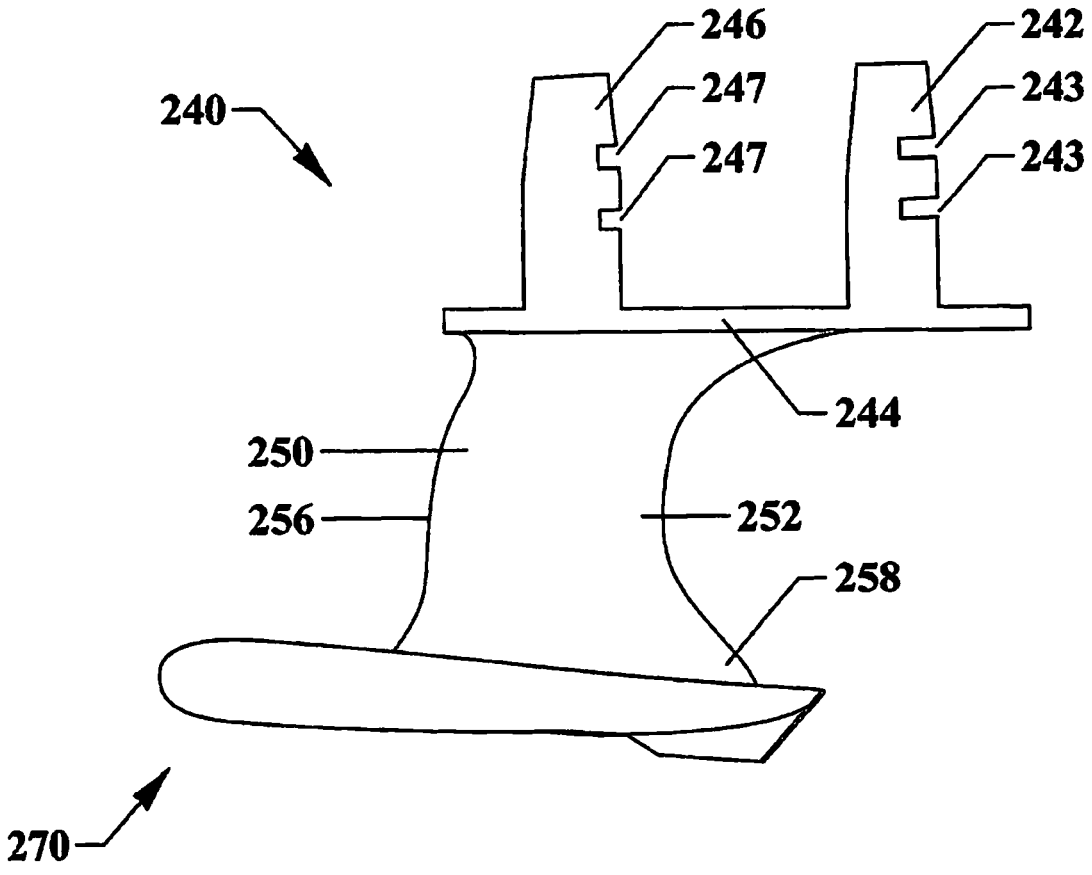

FIG. 36 is a side view of the skeg from FIG. 35 assembled to the separate wing of FIGS. 22-27.

Figure 37:
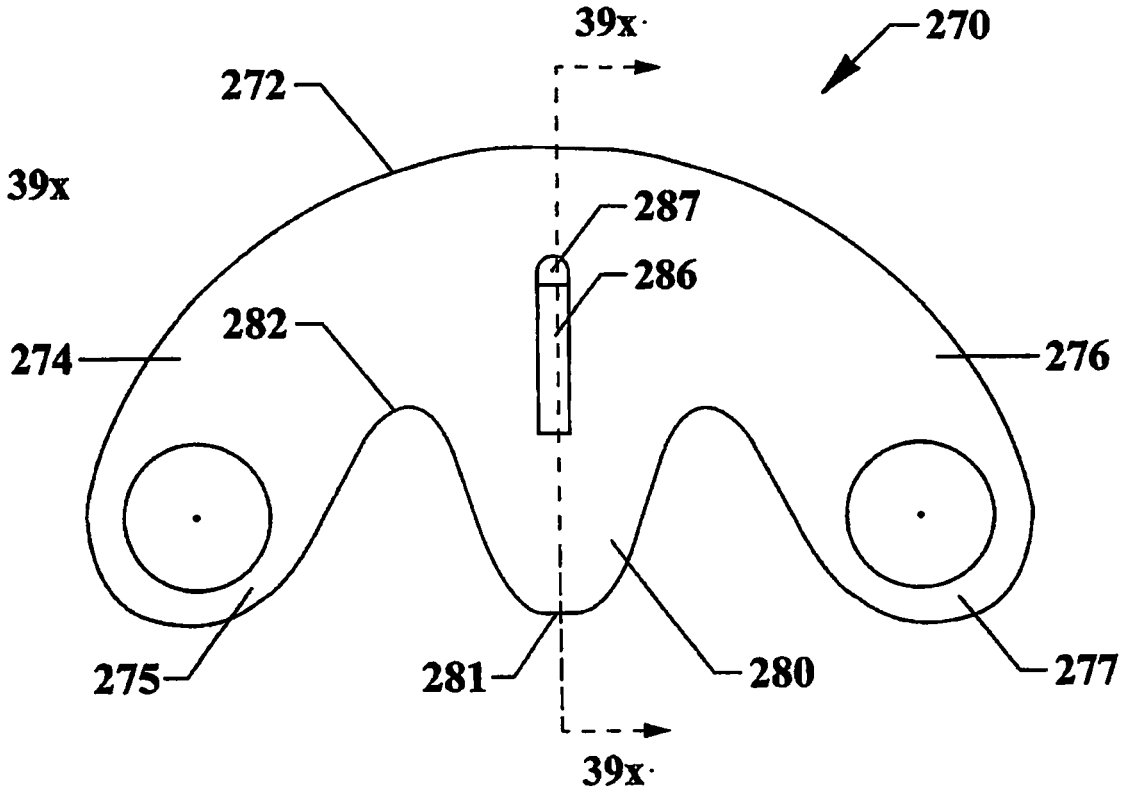

FIG. 37 is a top view of the separate wing of FIGS. 22-27 and 36.

Figure 38:
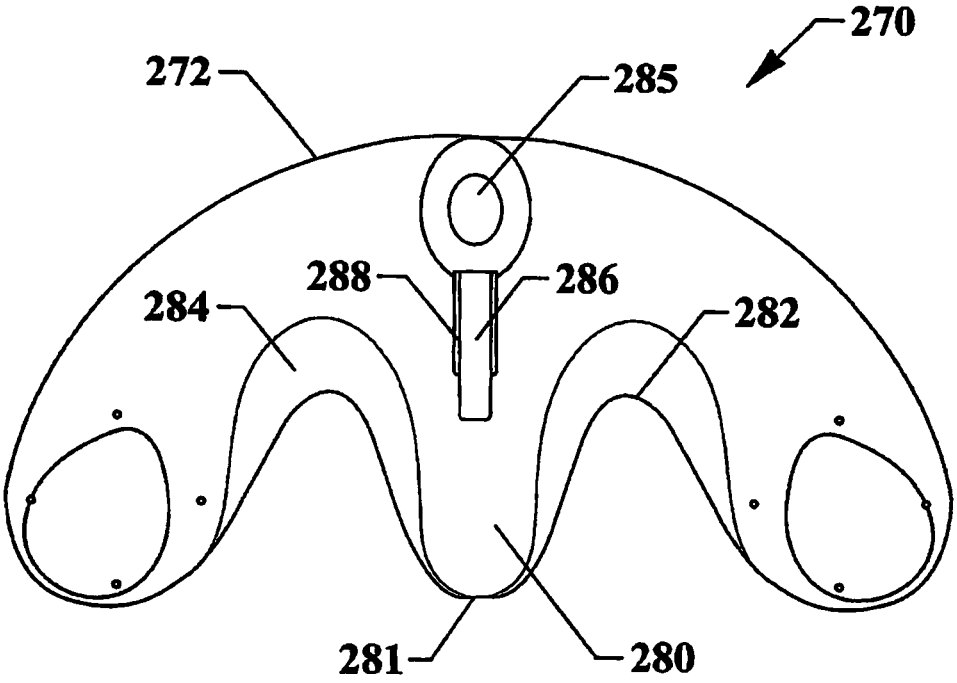

FIG. 38 is a bottom view of the wing of FIG. 37.

Figure 39:
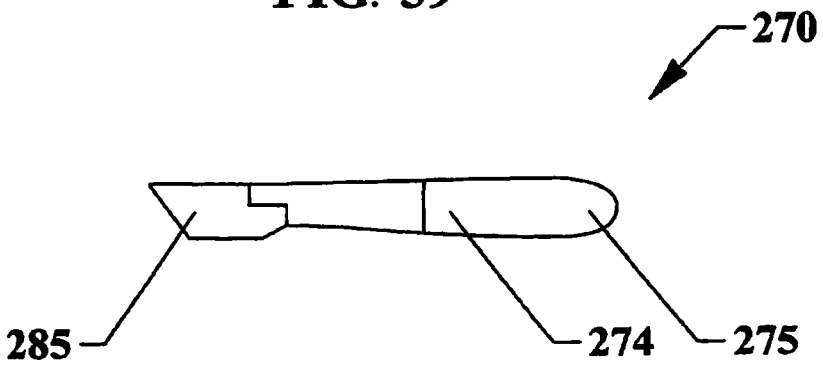

FIG. 39 is a side view of the wing of FIG. 37 along arrow 39X.

Figure 40:
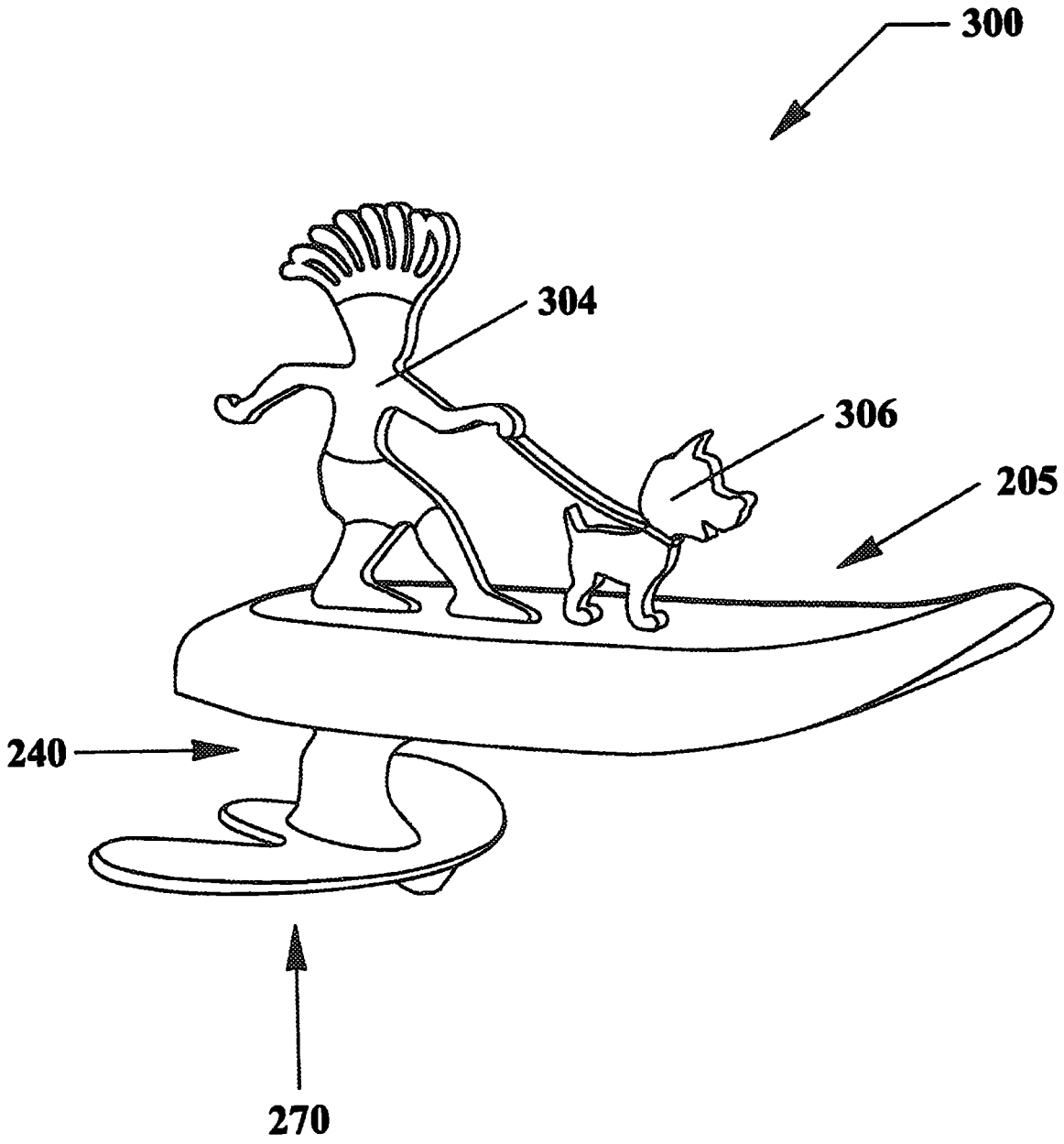

FIG. 40 is a right perspective view of the toy with hydrofoil and mounted figurine and animal.

Figure 41:
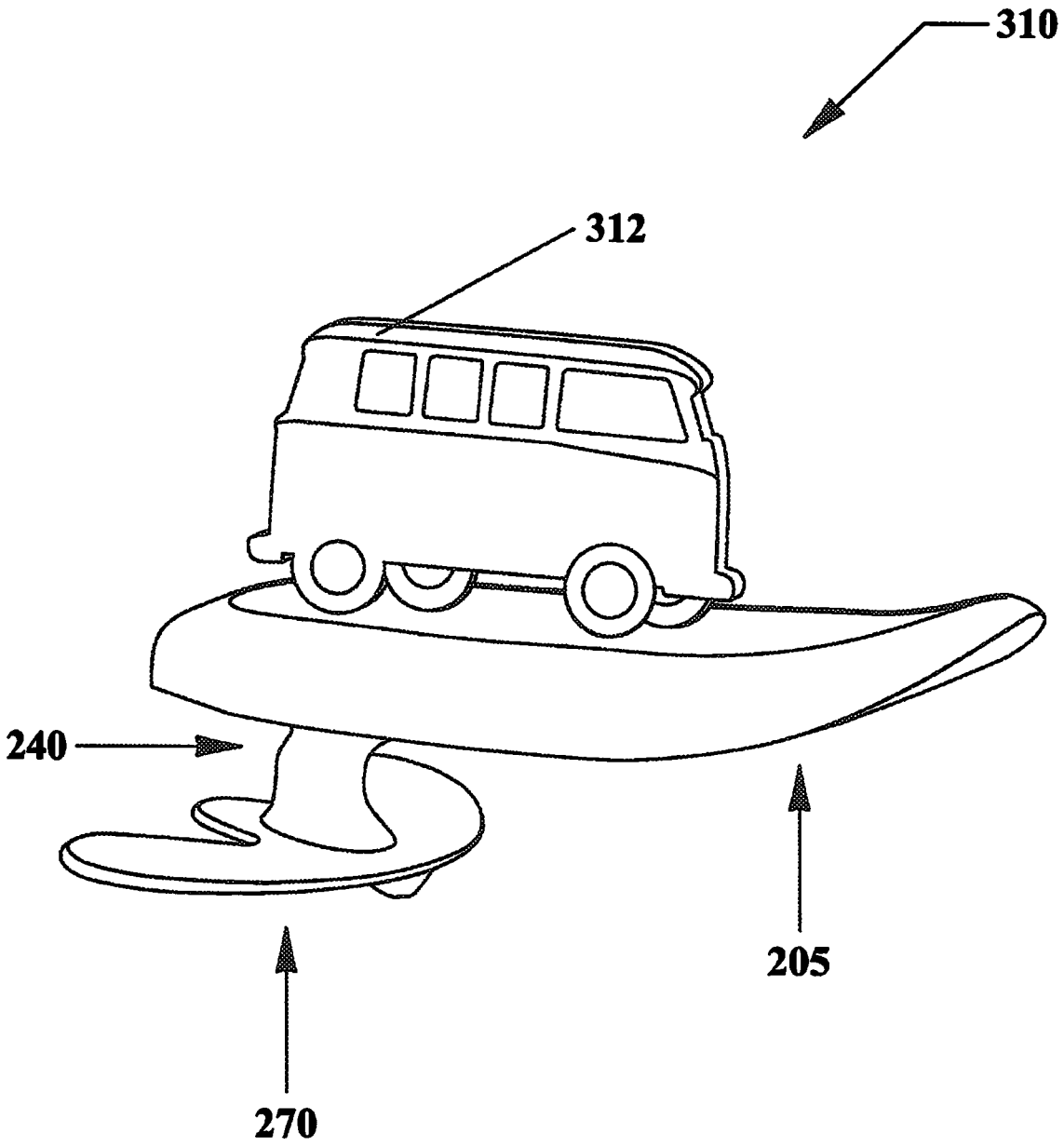

FIG. 41 is a right perspective view of the toy with hydrofoil and mounted vehicle.

Figure 42:
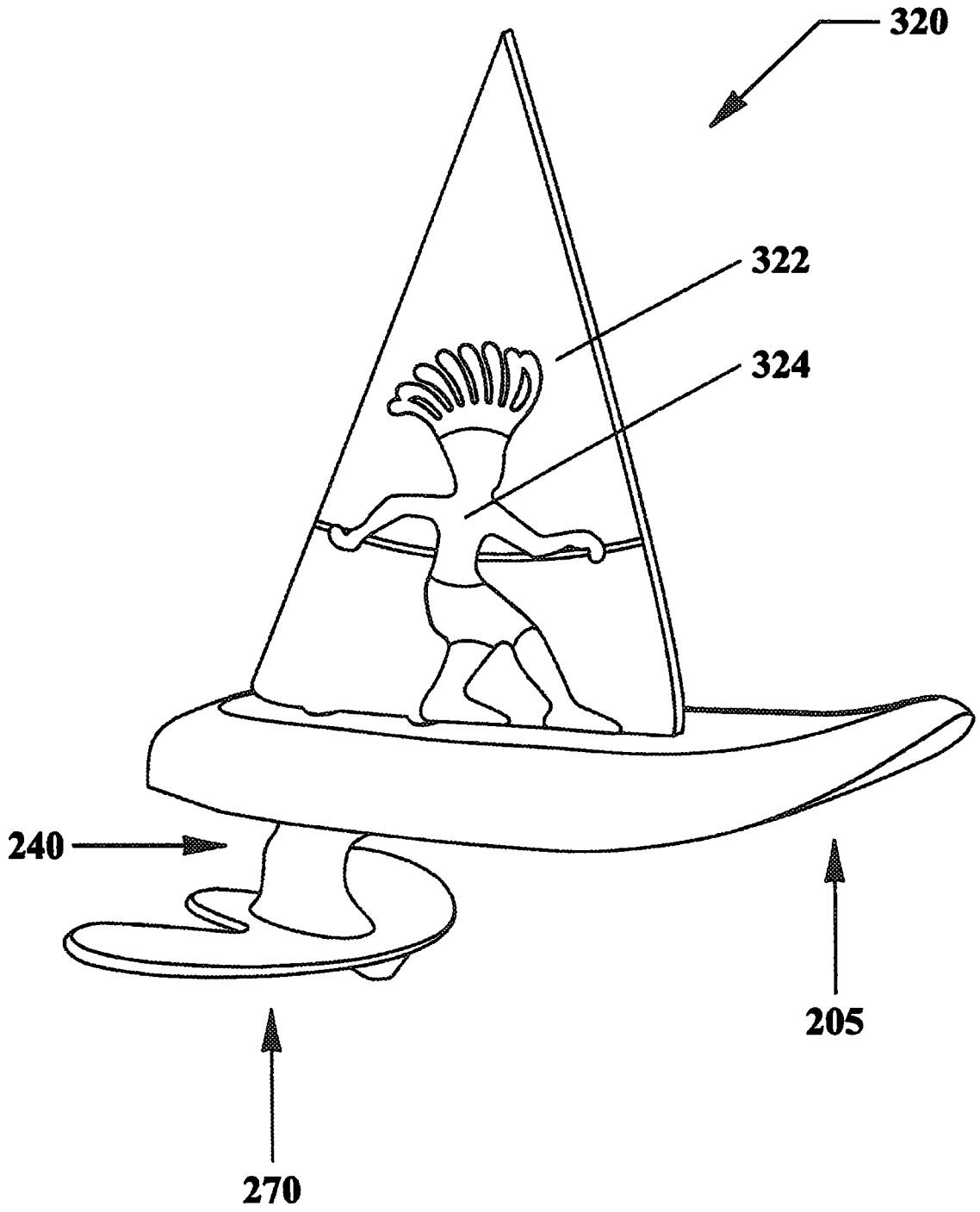

FIG. 42 is a right perspective view of the toy with hydrofoil and mounted sail.

Figure 43:
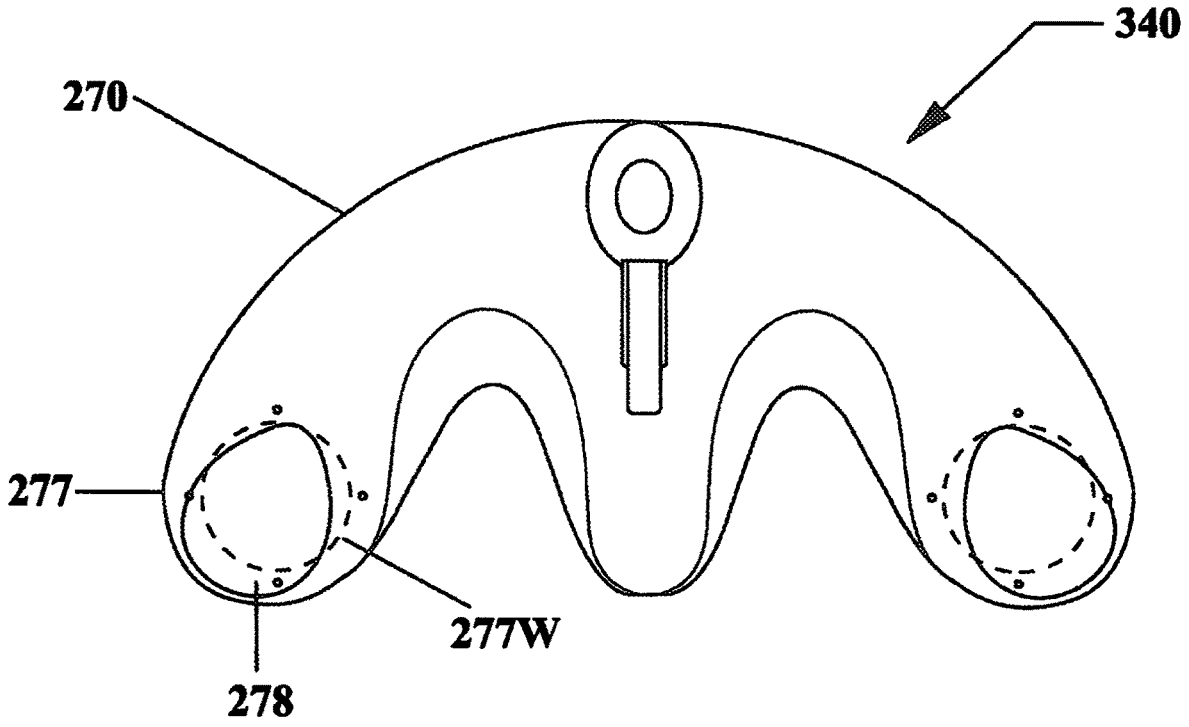

FIG. 43 is a bottom view of the wings of the hydrofoil with dotted lines indicating locations of weights.

Figure 44:
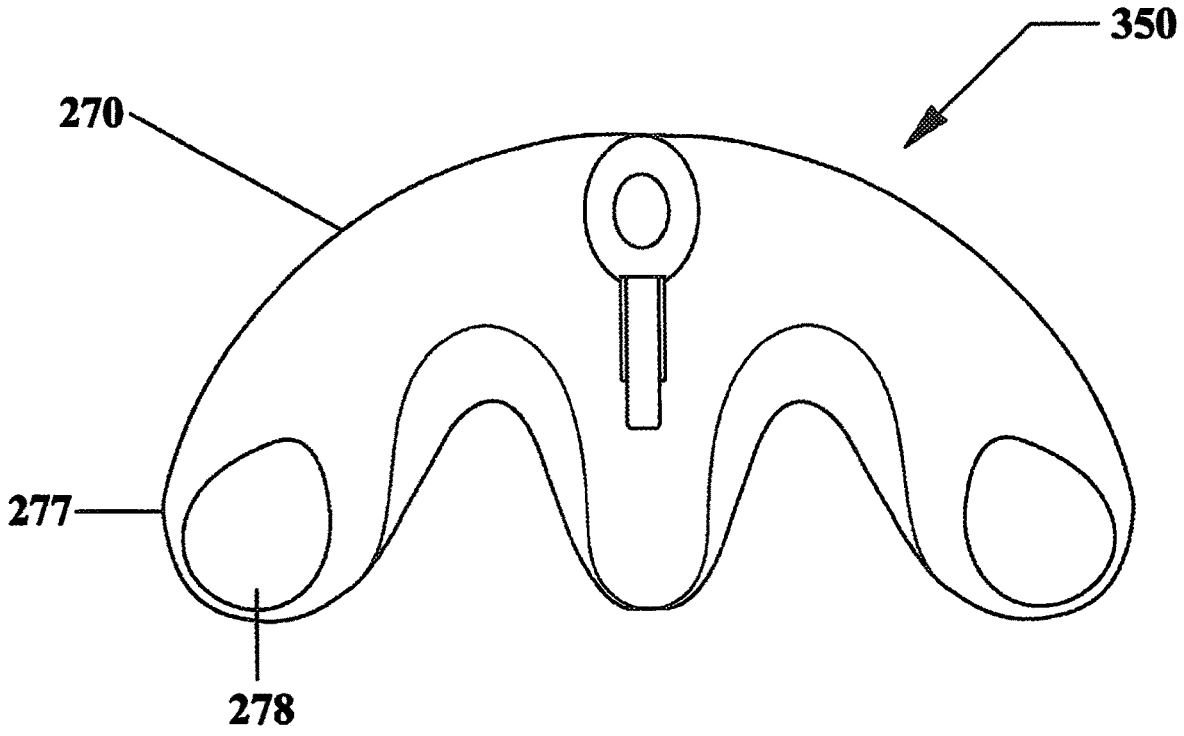

FIG. 44 is another bottom view of the wings of FIG. 43 with the weights removed from the outer vanes of the main wing.

Figure 45:
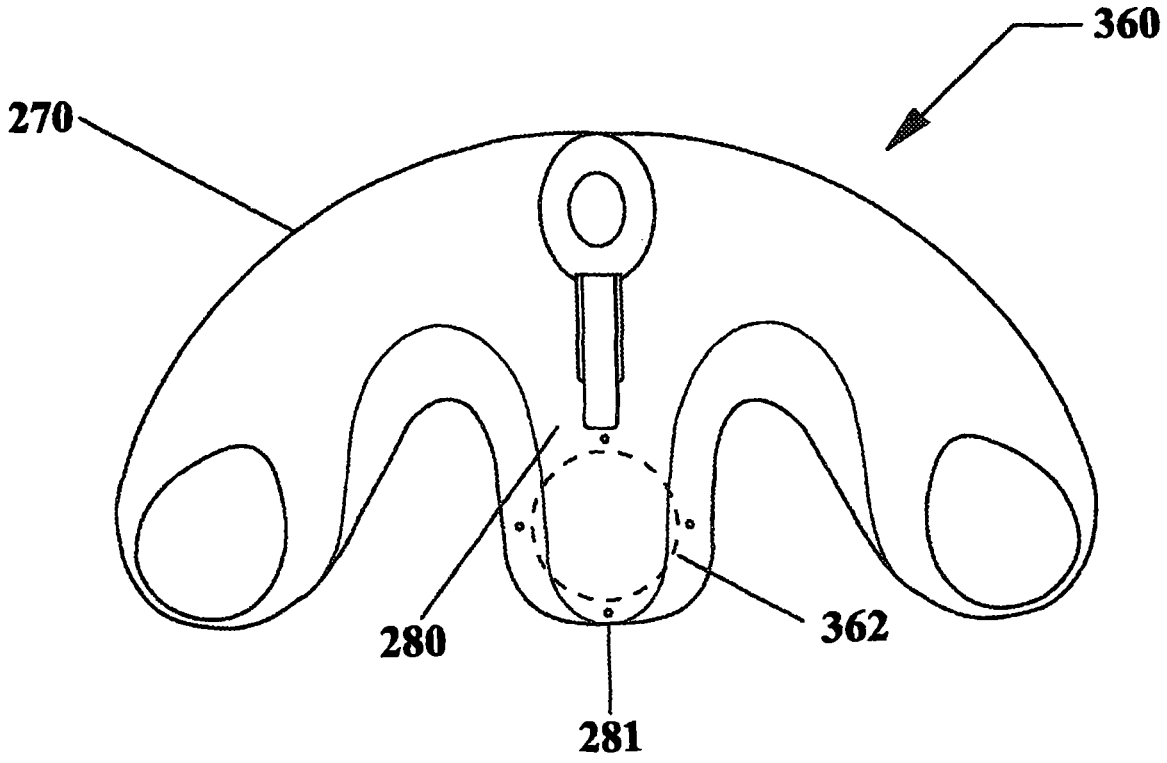

FIG. 45 is another bottom view of the wings of FIG. 44 with weight(s) in dotted lines on the rear tine (tail) of the main wing.

Figure 46:
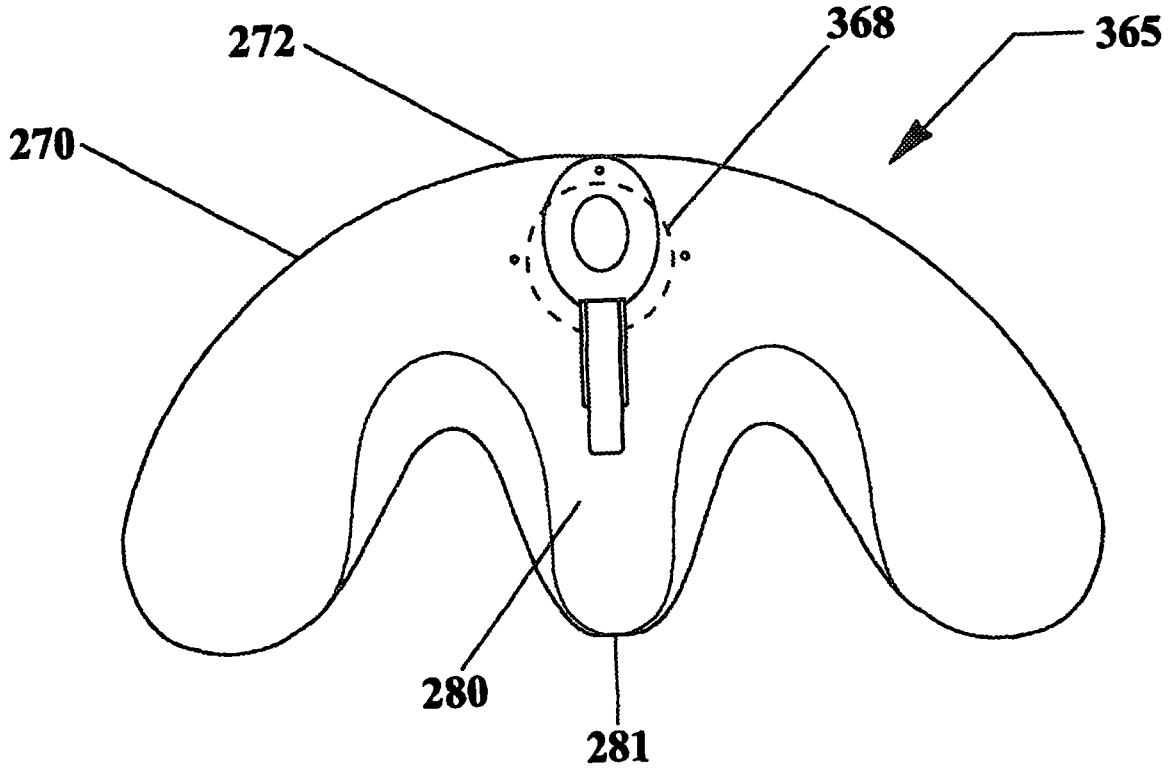

FIG. 46 is another bottom view of the wings of FIG. 44 with weight(s) centered on the middle front end of the main wing.

Figure 47:
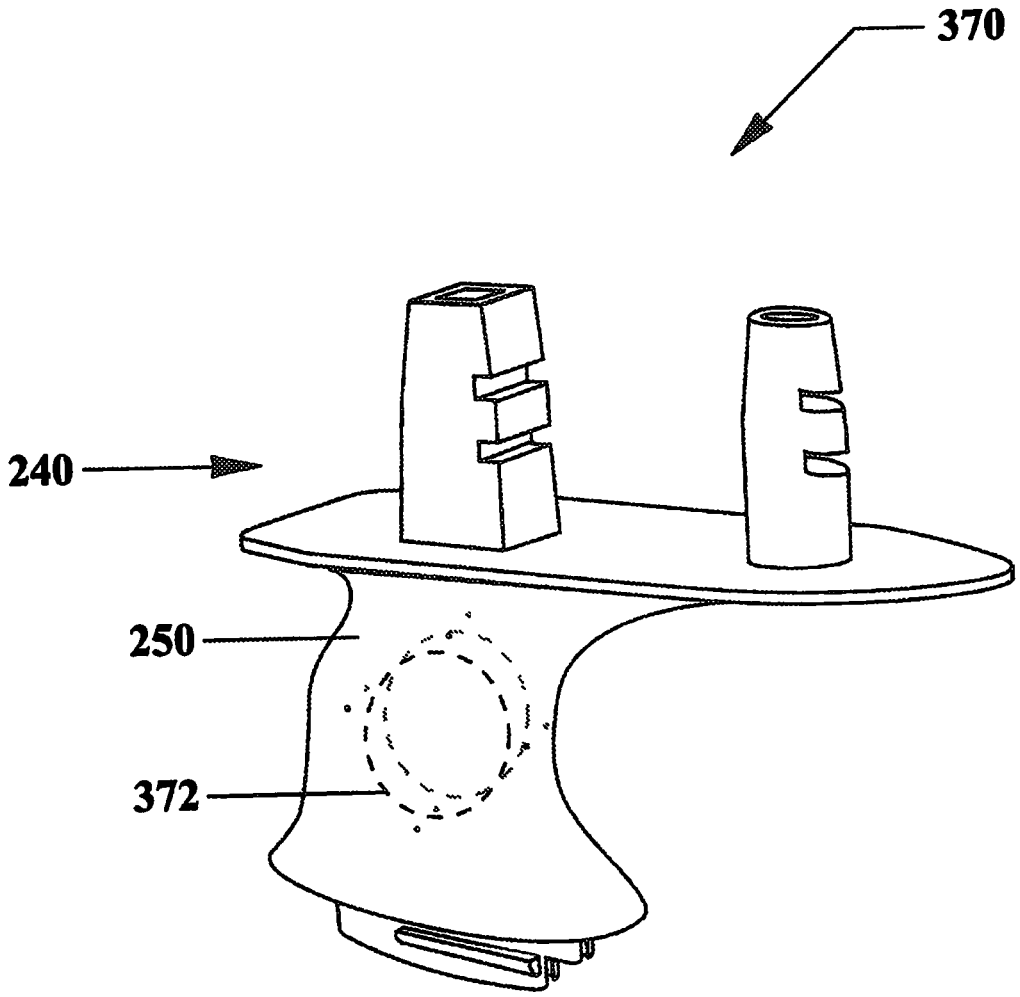

FIG. 47 is a side perspective view of the skeg used to attach the wings of the hydrofoil to the toy with weight(s) on the skeg.

Figure 48:
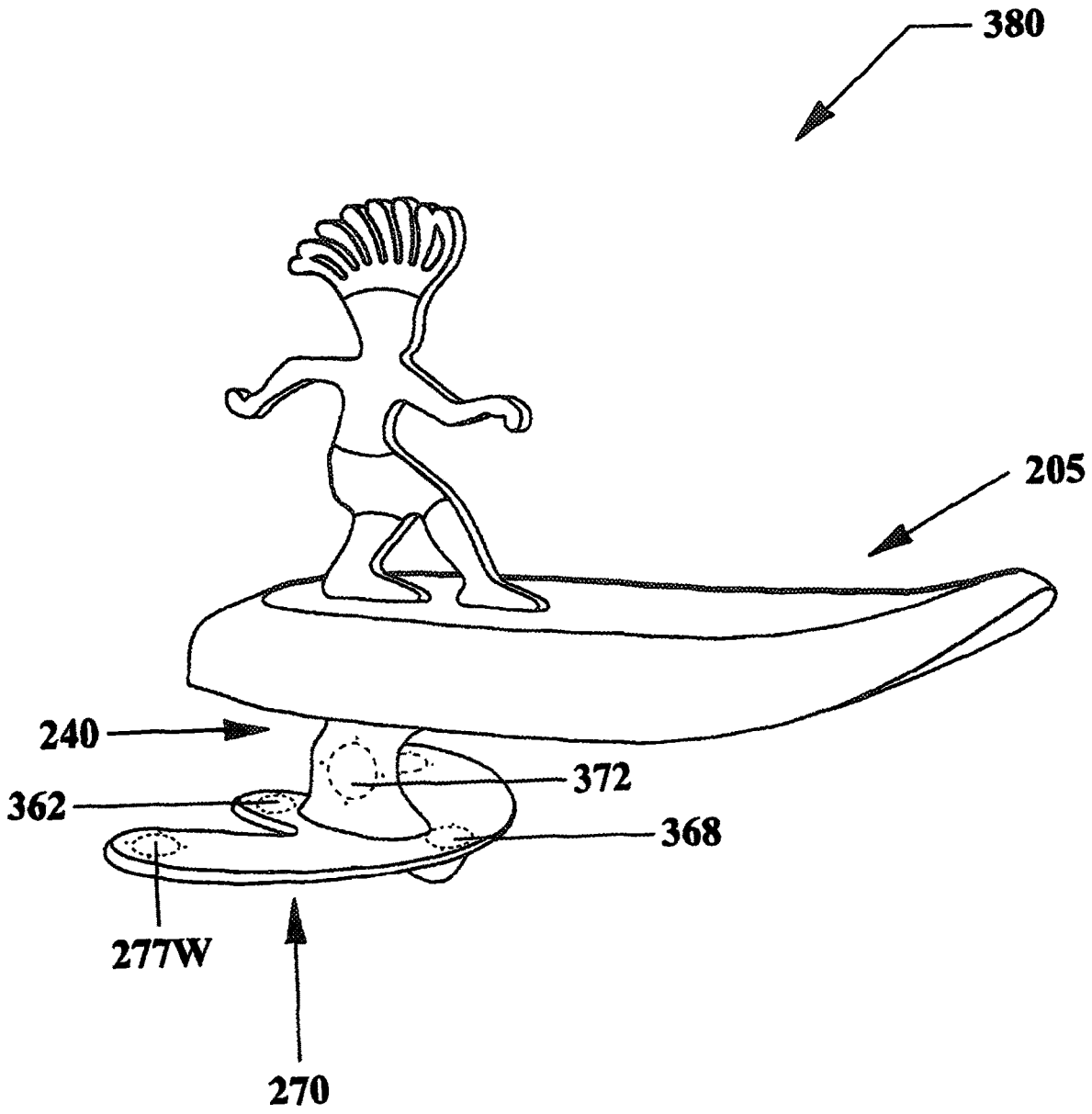

FIG. 48 is an assembled view of the toy showing weights at different possible locations on the skeg and main wing.

Figure 49A:
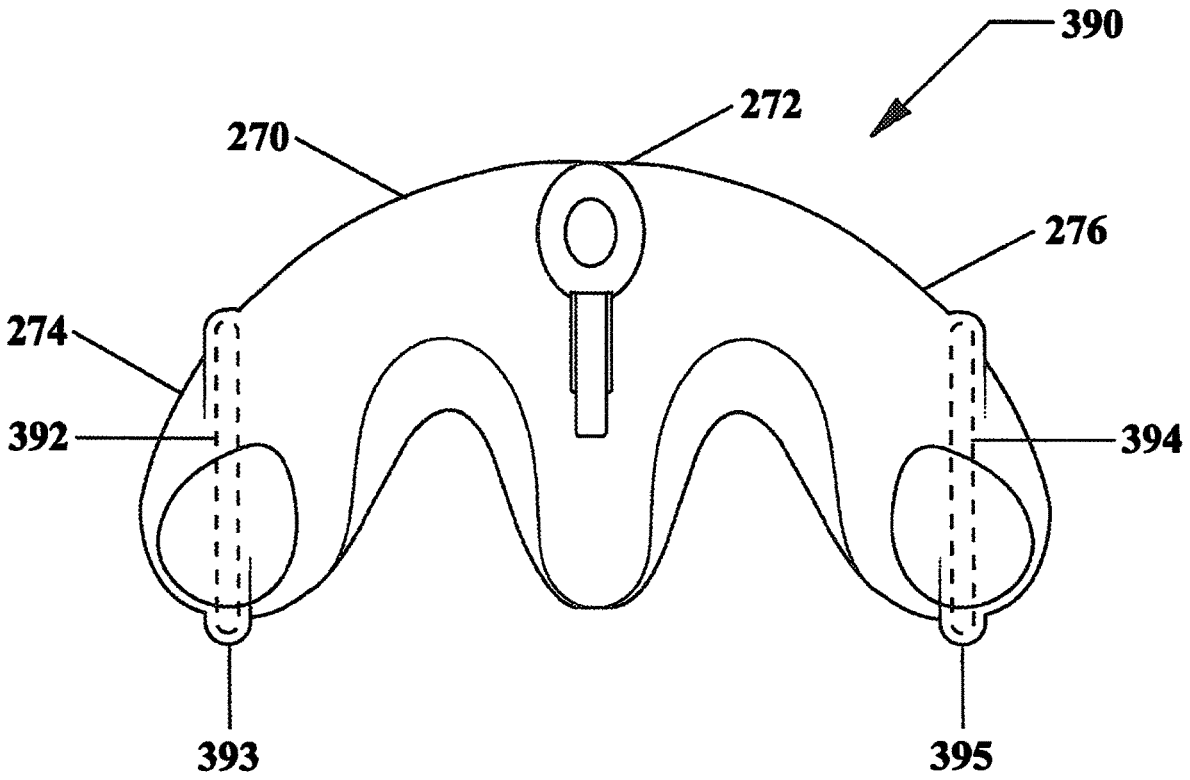

FIG. 49A is a bottom view of the wings of the hydrofoil showing the internal location of torpedo shaped weights.

Figure 49B:
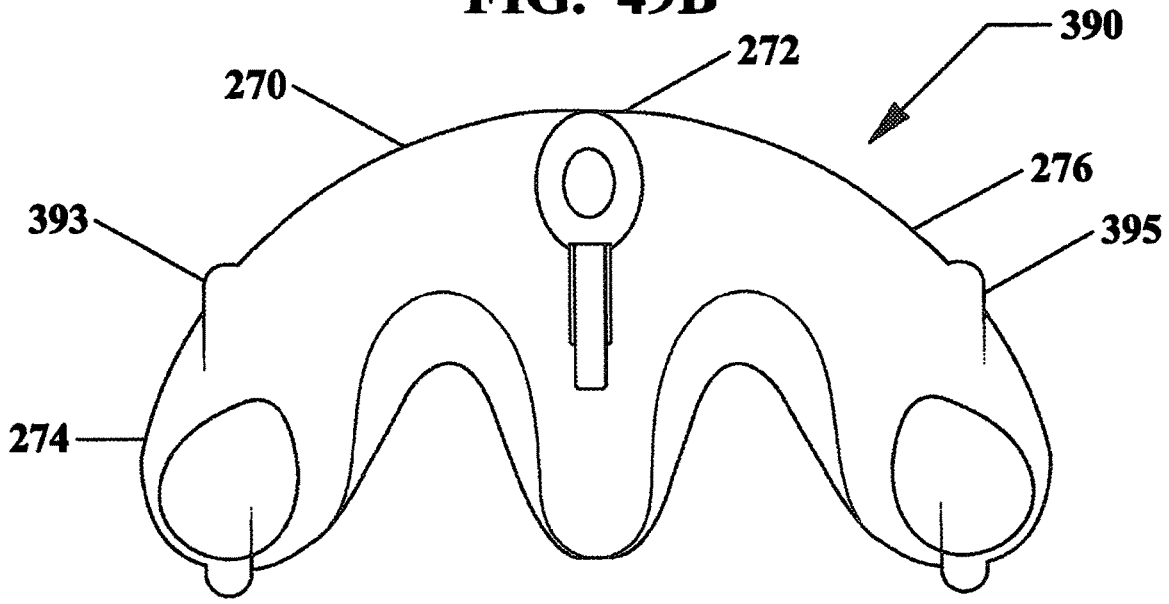

FIG. 49B is another bottom view of the wings of FIG. 49A showing the weights molded into the main wing.

Figure 50:
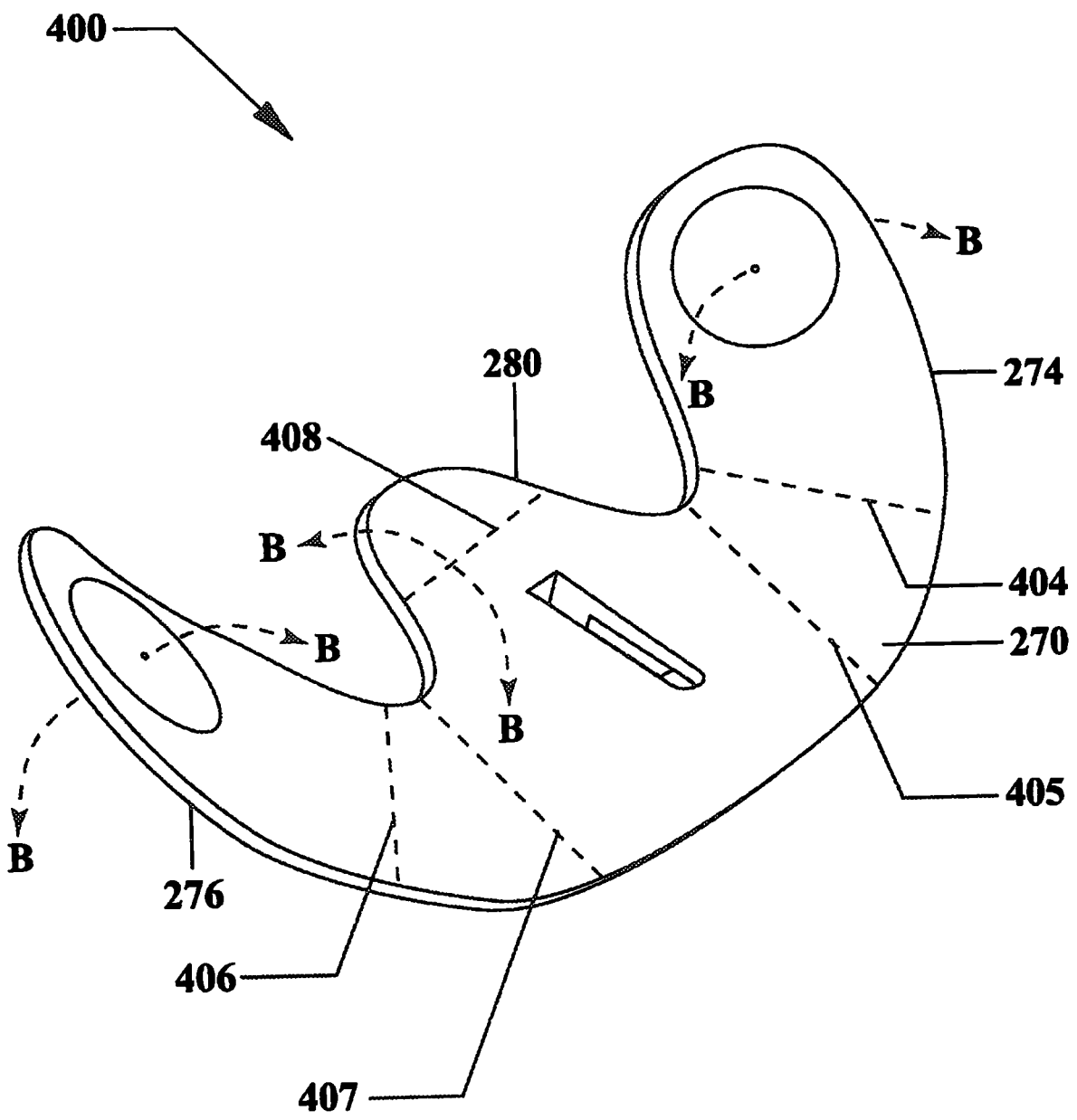

FIG. 50 is a top view of the wings with portions being flexible to bend at different locations.

Figure 51A:
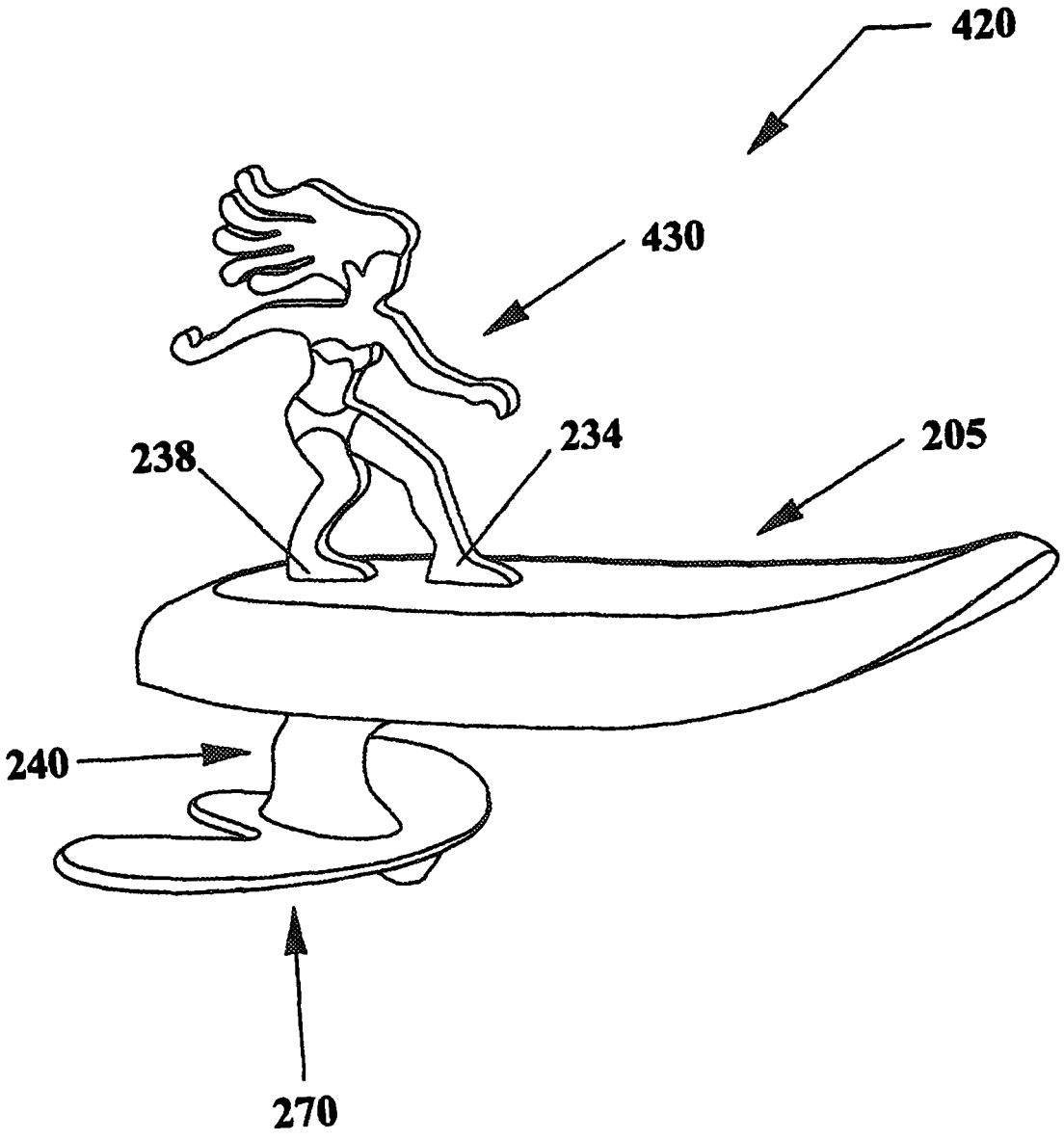
Figure 51B:
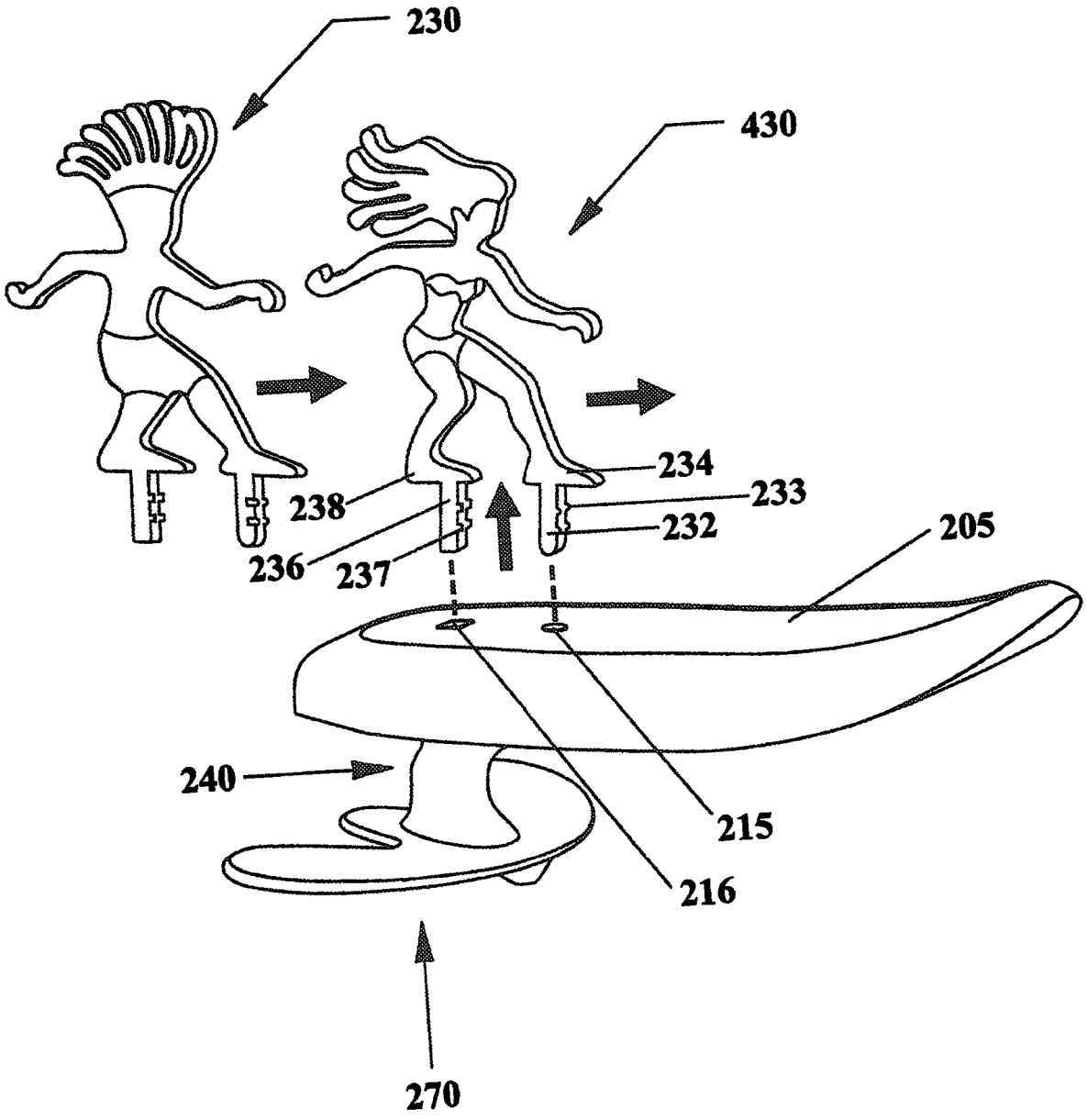
Figure 51C:
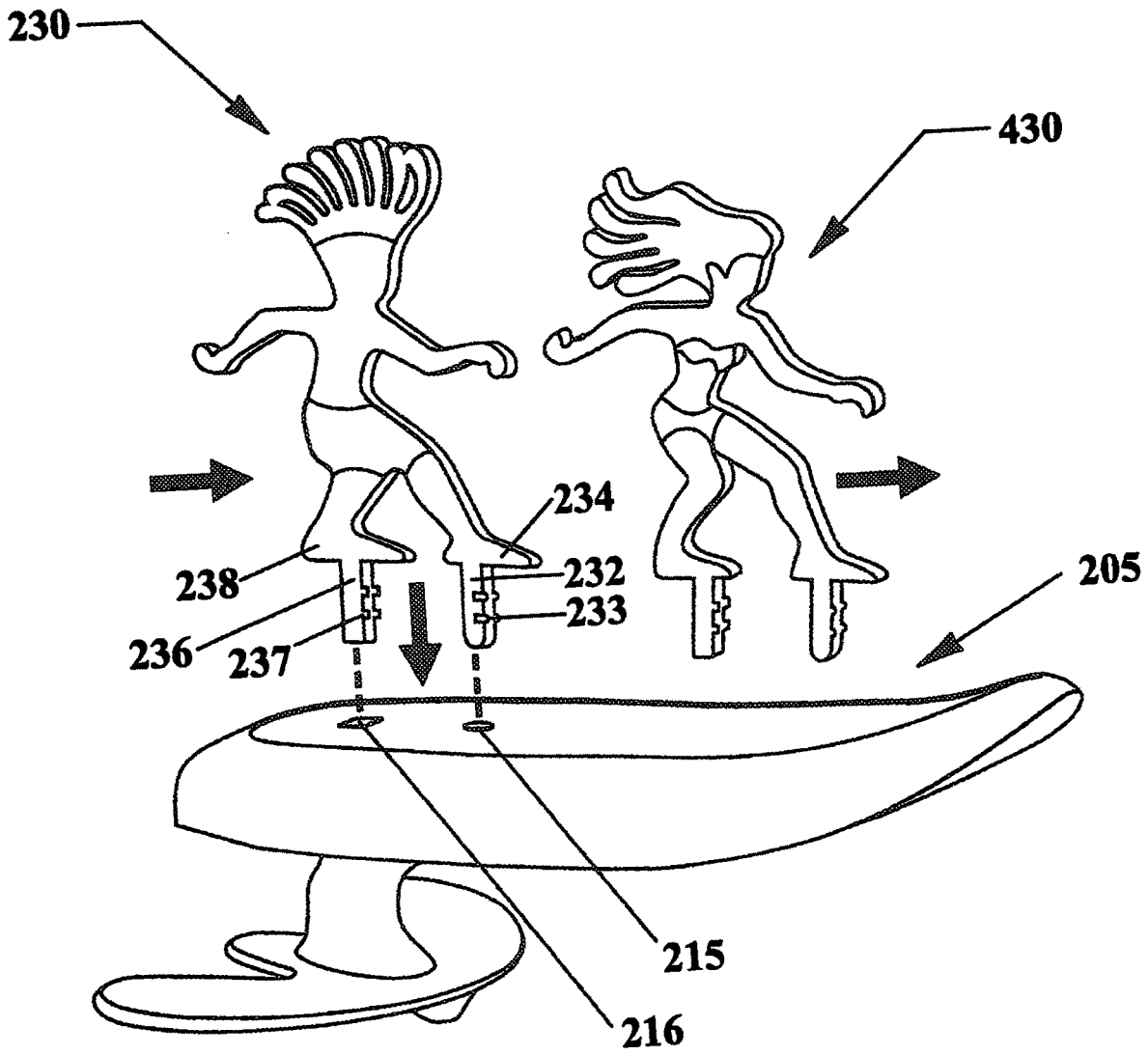

FIGS. 51A, 51B and 51C show the toy with attachable and detachable figurines that can be removed and replaced by the user.

Figure 52:
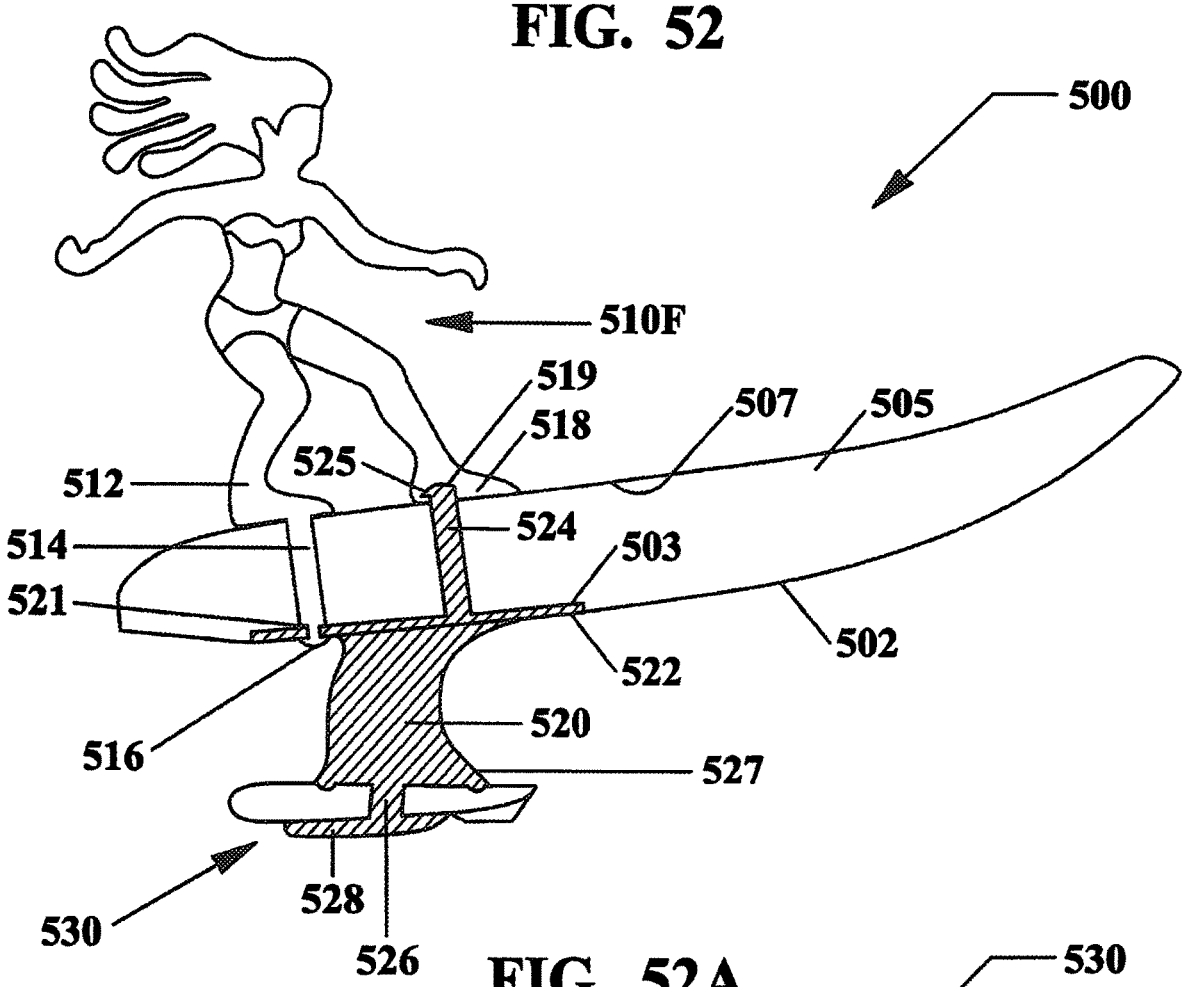

FIG. 52 is a cross-sectional view of the toy with downwardly extending fastener from the figurine in combination with upwardly extending fastener from the skeg.

Figure 52A:
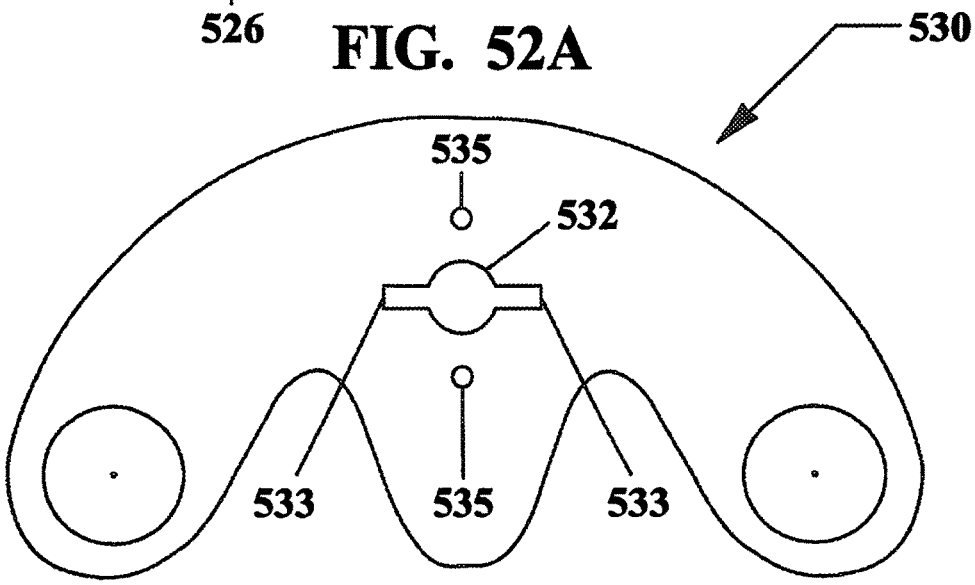

FIG. 52A is a top view of the removable main wing that can twist onto the bottom of the skeg shown in FIG. 52.

Figure 53:
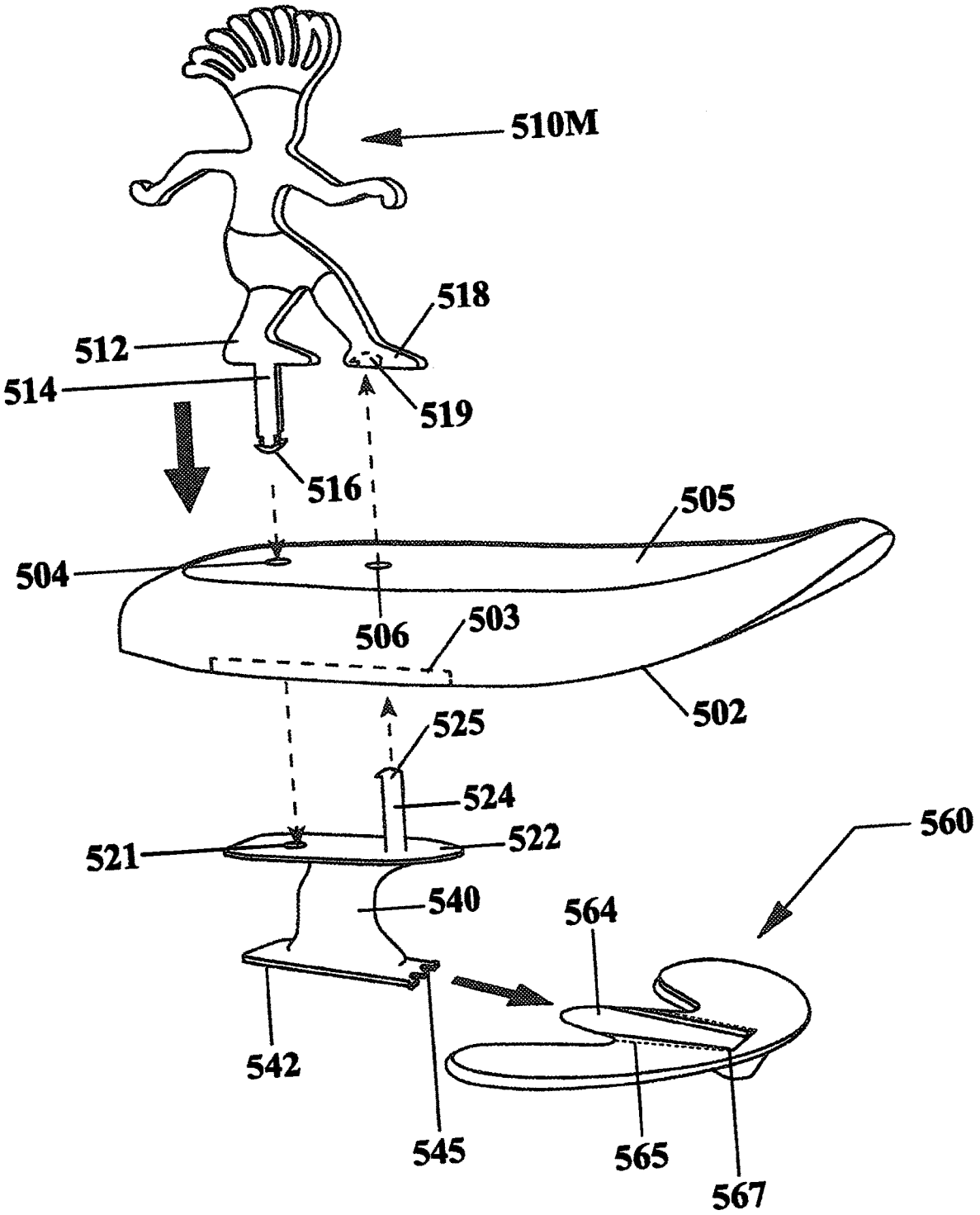

FIG. 53 is an exploded view of using figurine and skeg fastener attachments similar to FIG. 52 along with a slide on wing.

Figure 54:
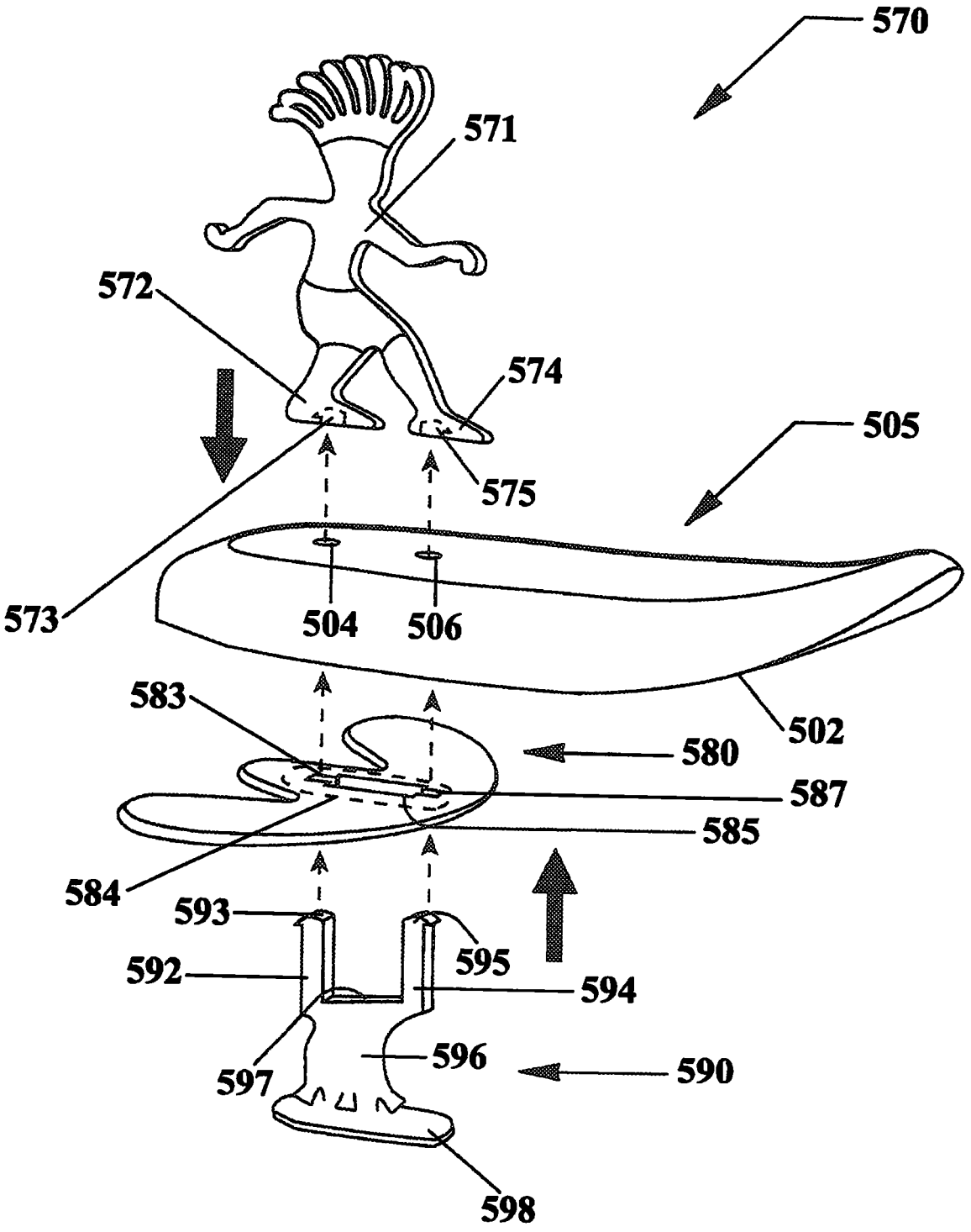

FIG. 54 is an exploded view of another attachment arrangement of attaching the figurine, flotation device and main wing by a skeg having upwardly protruding fasteners.

Figure 55A:
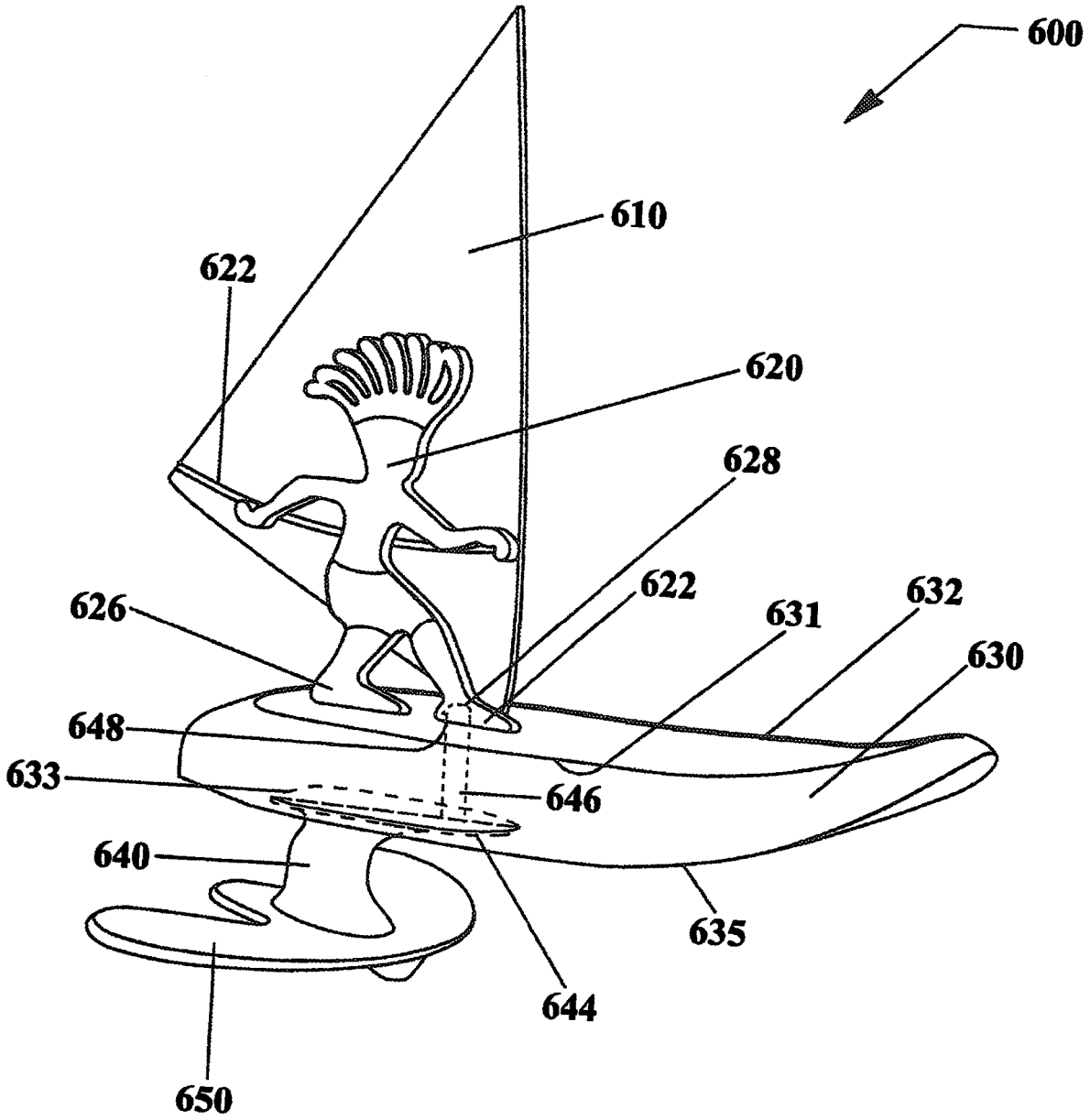

FIG. 55A a perspective view of the toy with rotatable sail mast.

Figure 55B:
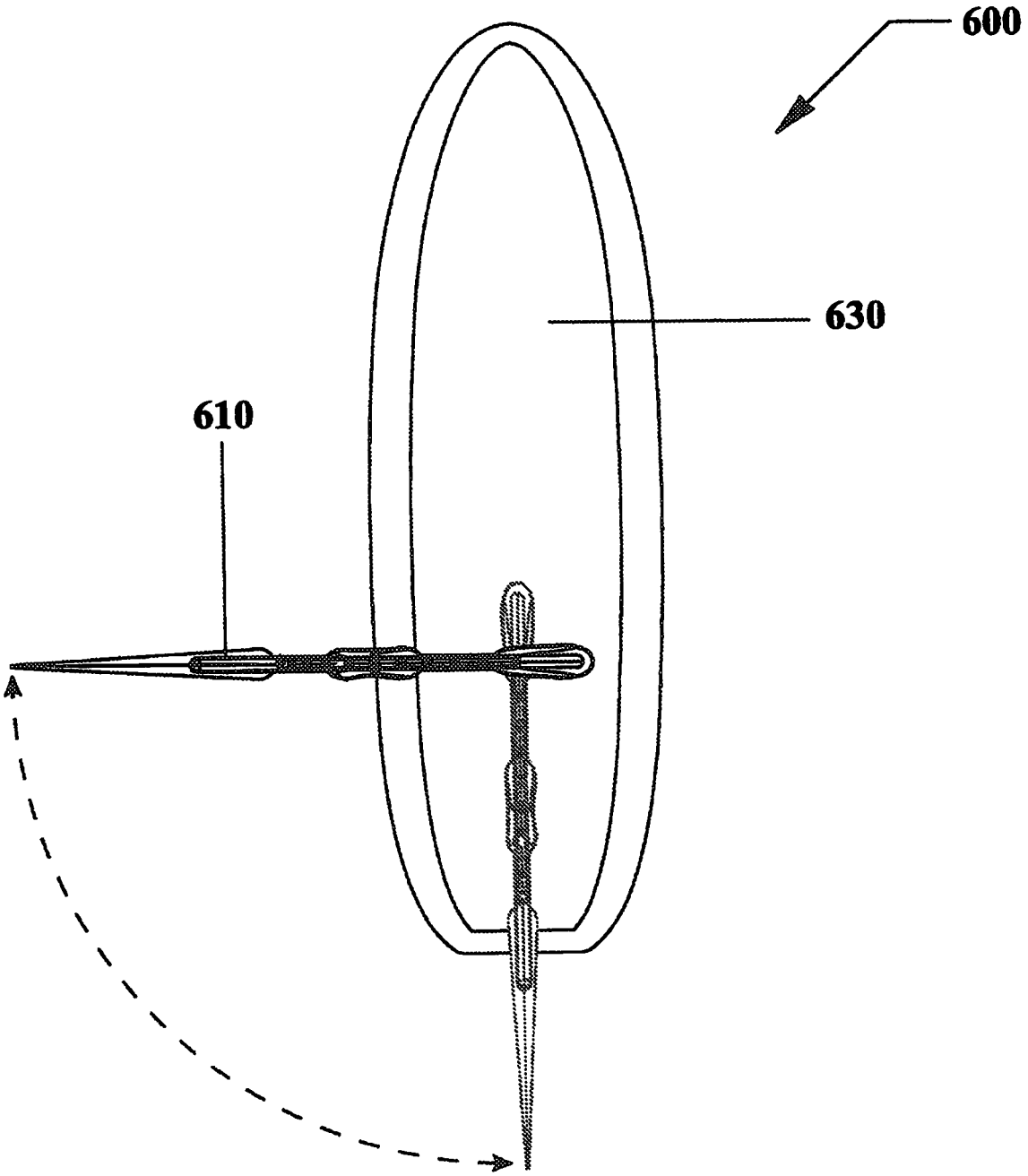

FIG. 55B is a top view of the toy of FIG. 55A with sail rotated to the left side.

Figure 55C:
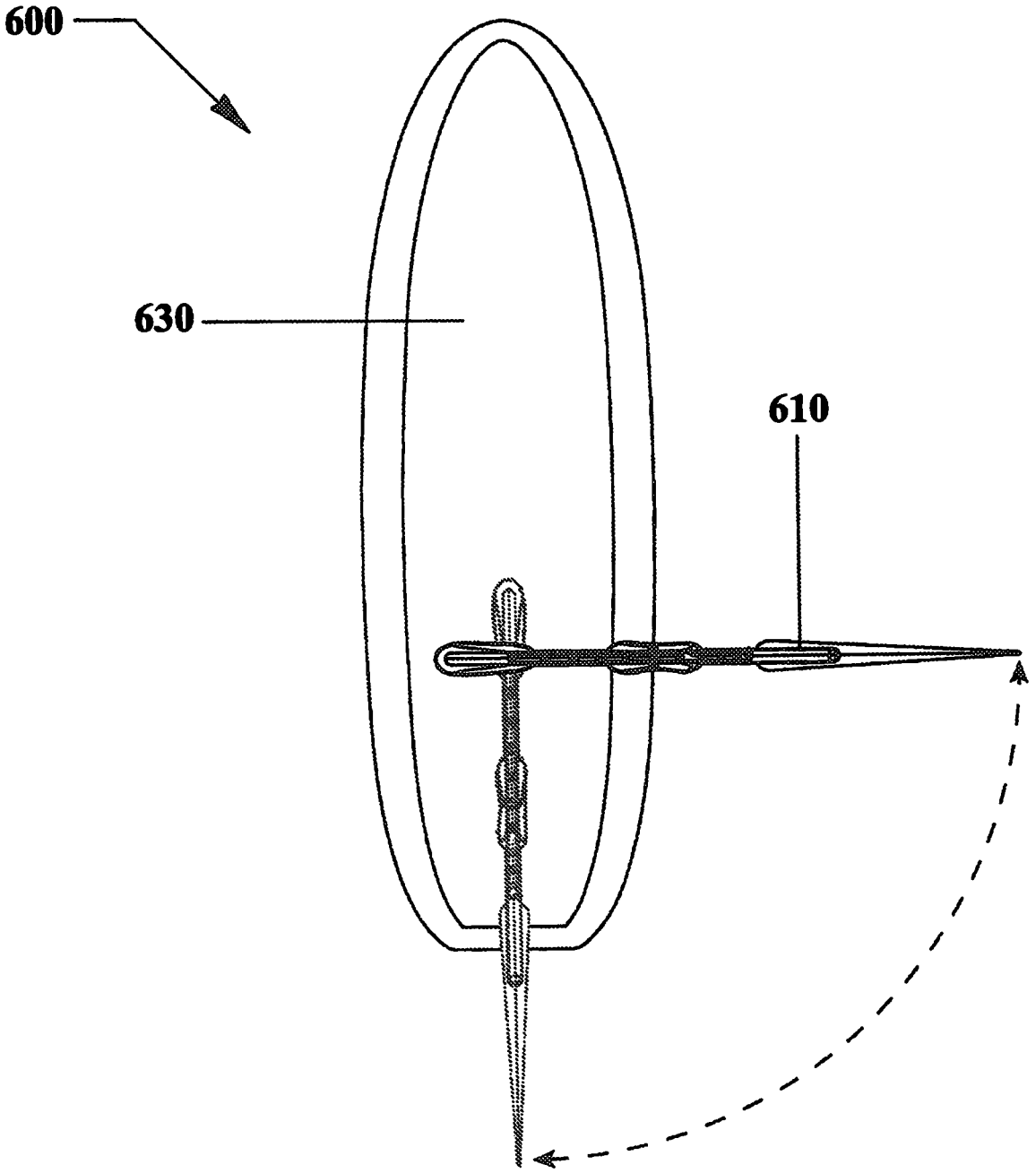

FIG. 55C is a top view of the toy of FIG. 55A with sail rotated to the right side.

Figure 56:
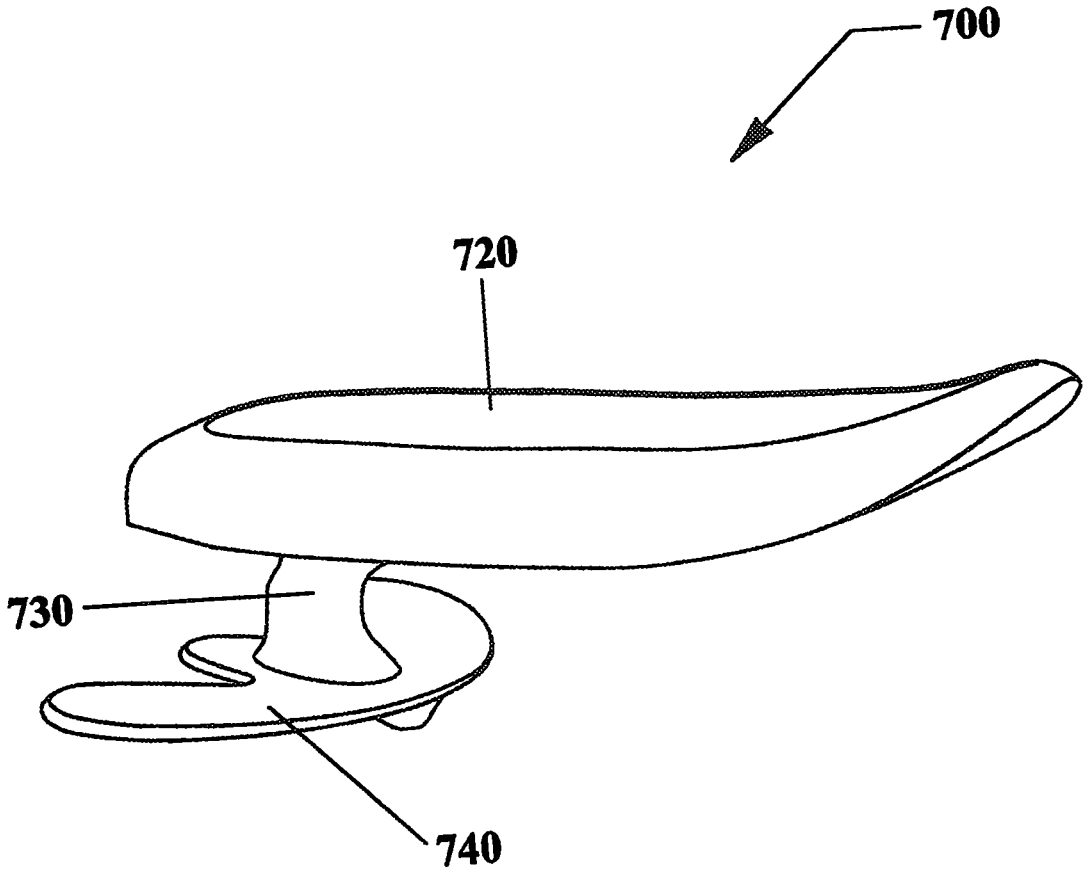

FIG. 56 is a side perspective view of the toy with hydrofoil without any upwardly protruding objects (such as figurines, animals, vehicles, sails, and the like).

Figure 57:
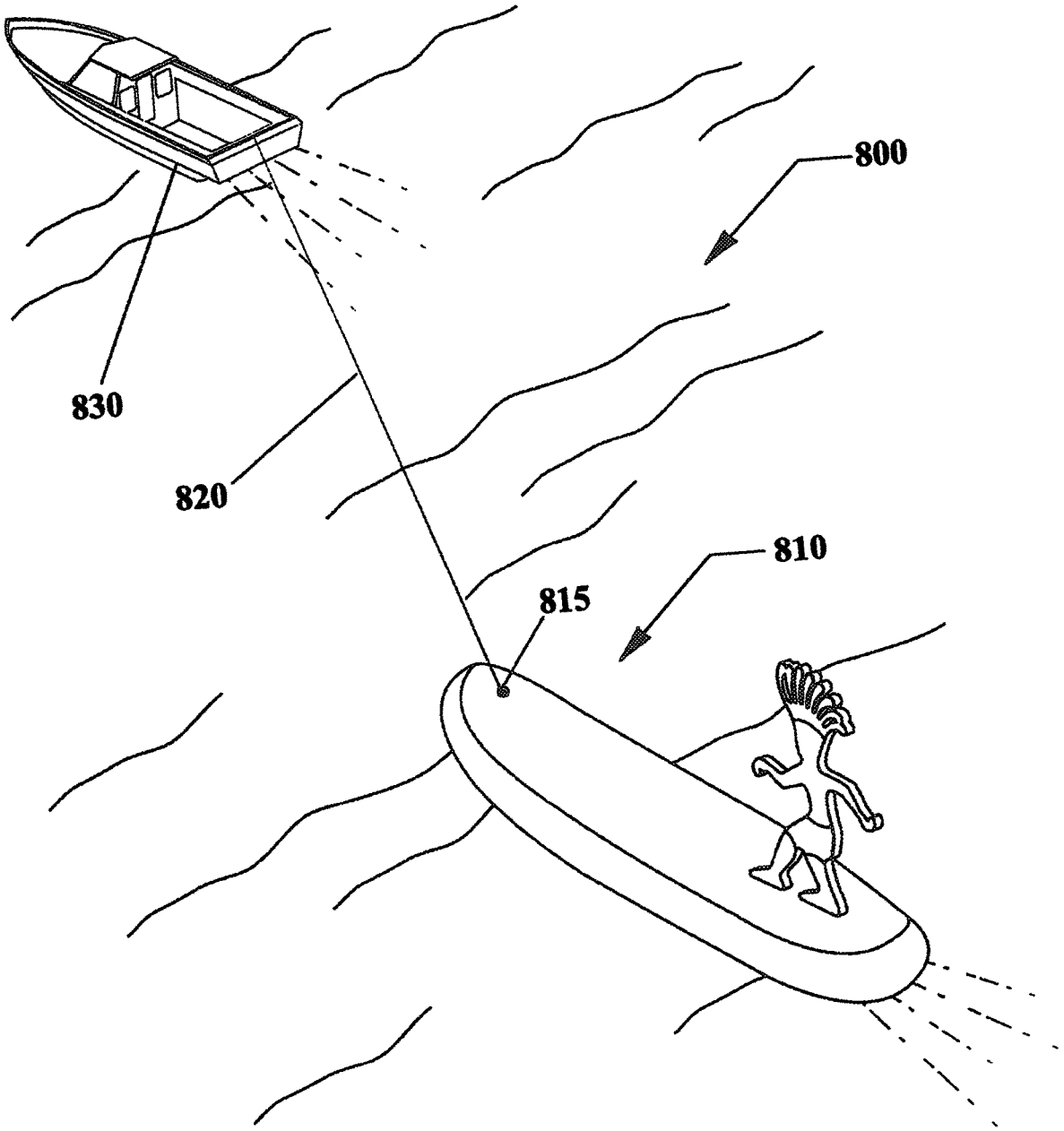

FIG. 57 shows the toy of the preceding figures being tethered to be pulled by a motorboat.

Figure 58:
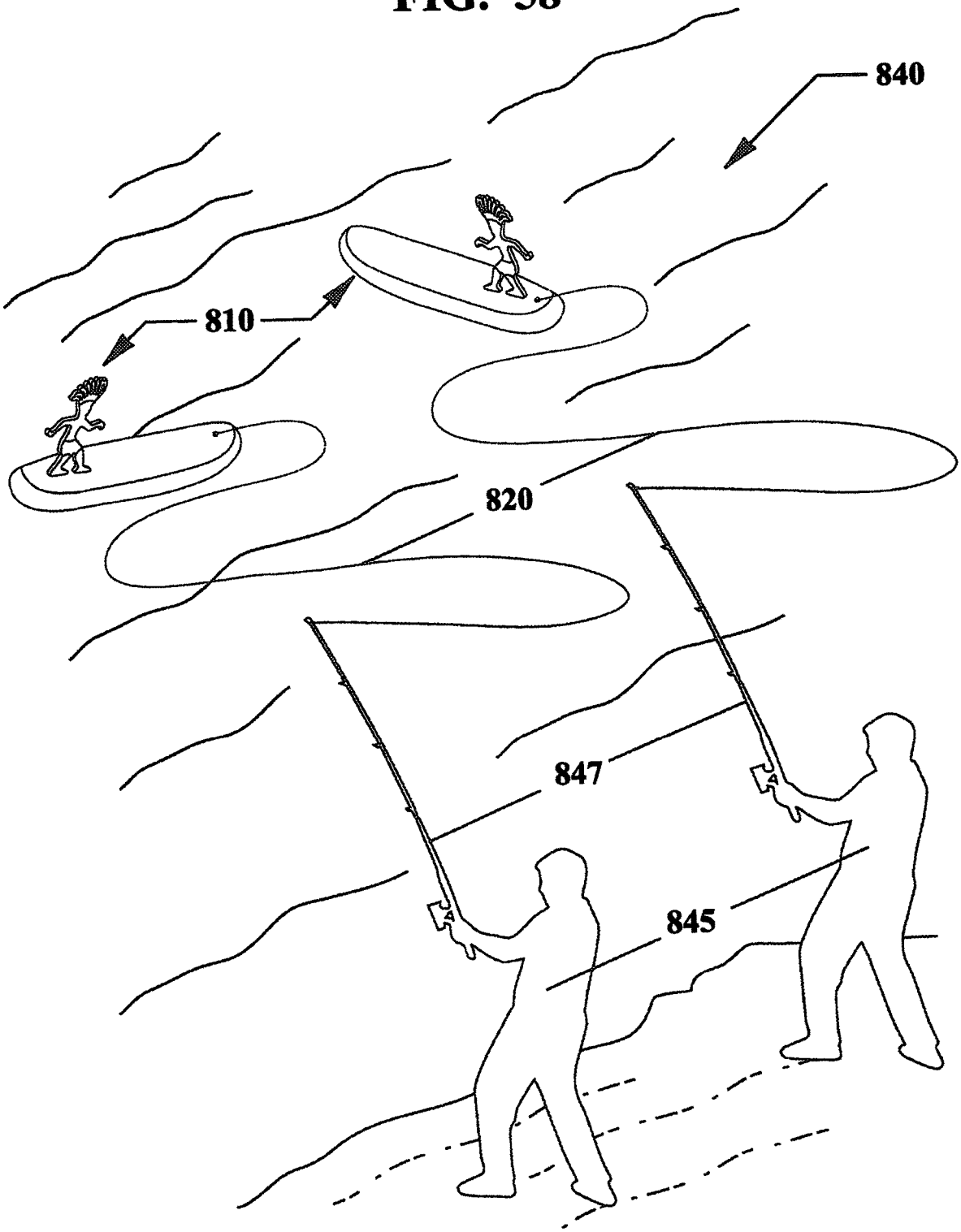

FIG. 58 shows the toy of the preceding figures tethered to a fishing rod, as a float(s).

Figure 59:
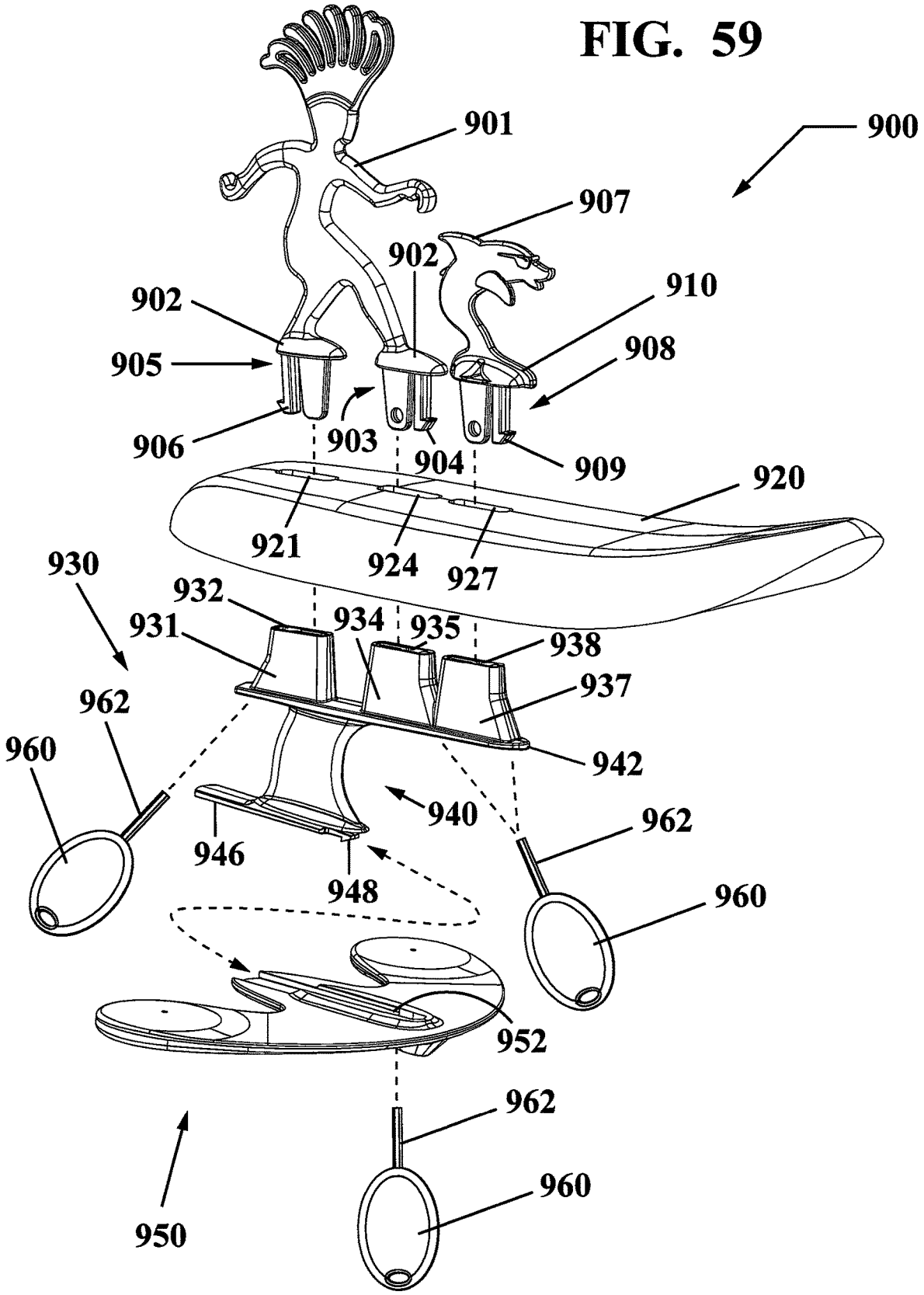

FIG. 59 is an exploded perspective view of a surfing toy with attachable and detachable interchangeable figurines and hydrofoil parts of a skeg and main wing/vanes.

Figure 60:
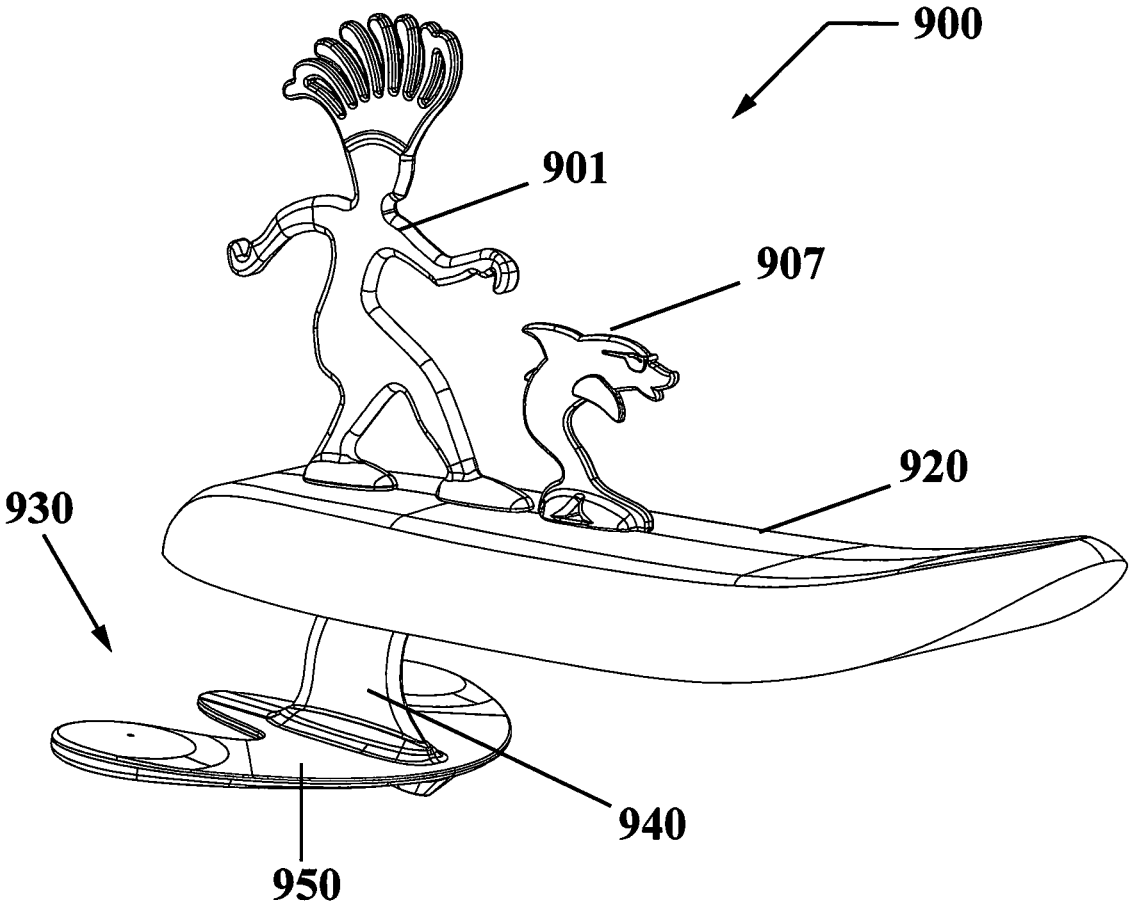

FIG. 60 is an assembled perspective view of the surfing toy with attached figurines and hydrofoil parts that can include a skeg and main wing/vanes.

Figure 61:
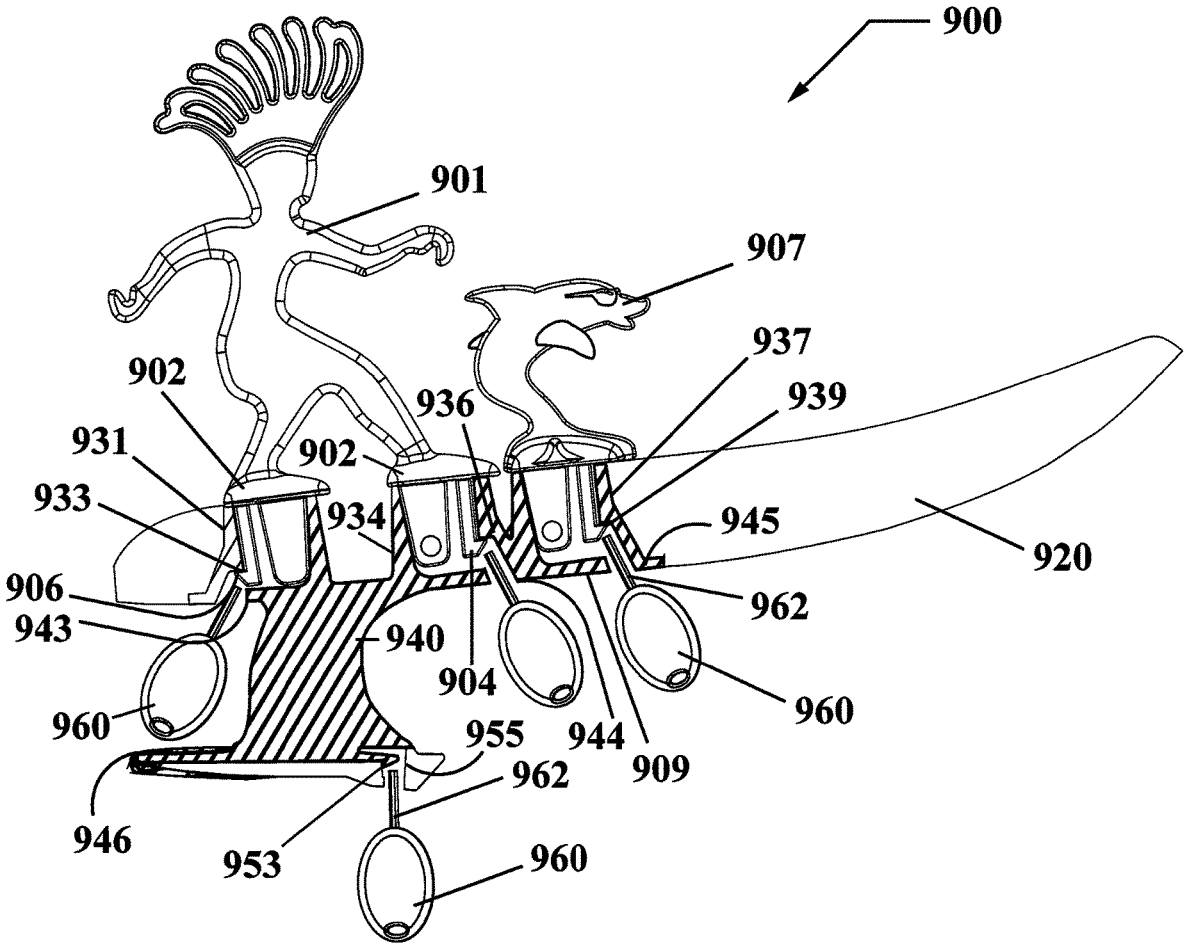

FIG. 61 is a cross-sectional view of the assembled surfing toy of FIG. 60.

Figure 62:
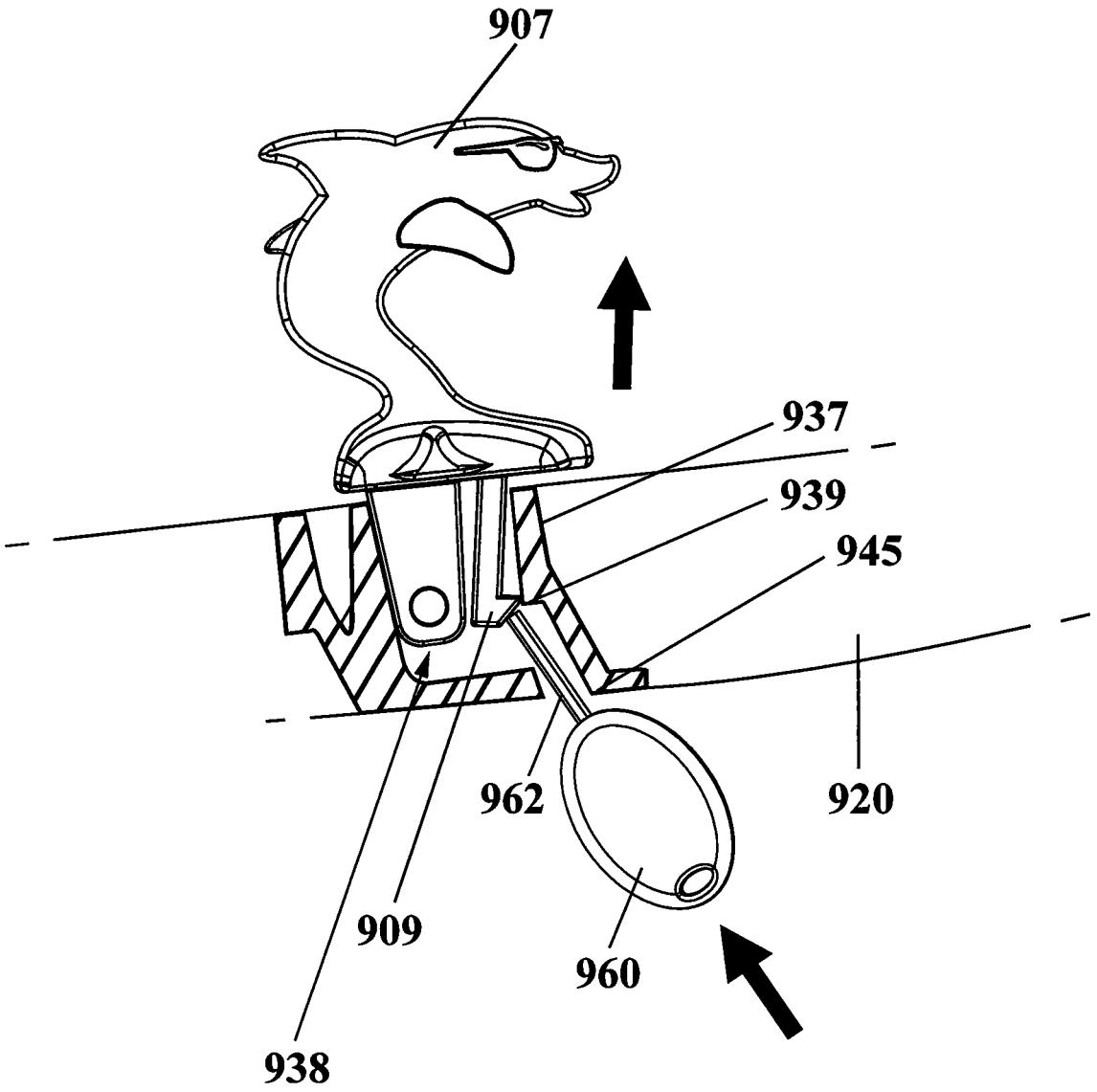

FIG. 62 is an enlarged view of the forward figurine shown in FIG. 61.

Figure 63:
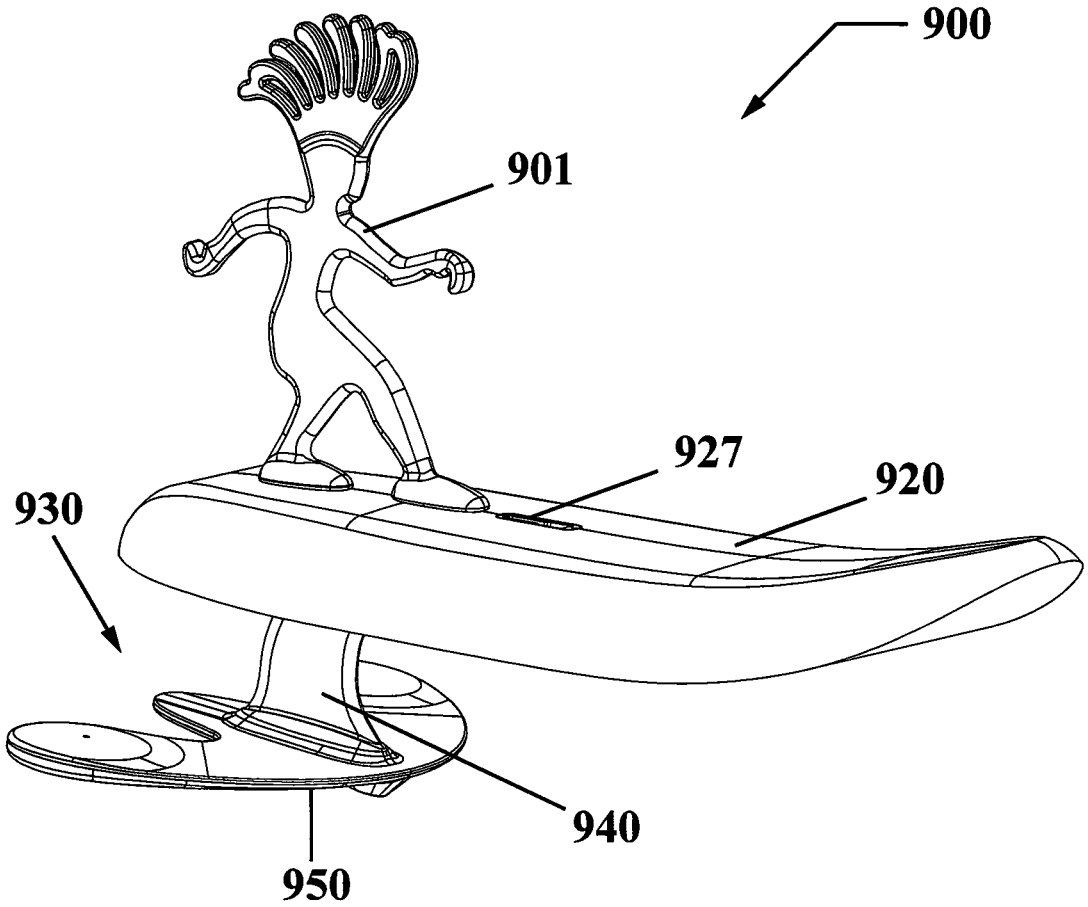

FIG. 63 is another perspective view of the assembled surfing toy of the preceding figures with one figurine.

Figure 64:
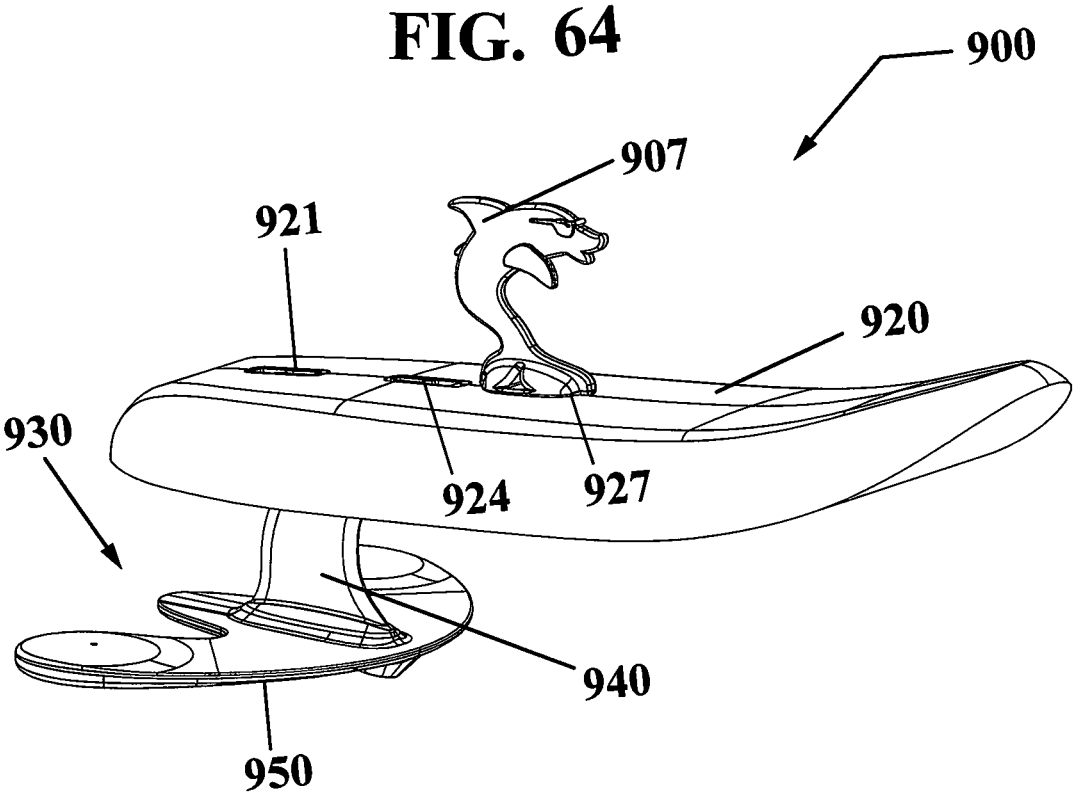

FIG. 64 is another perspective view of the assembled surfing toy of the preceding figures with dolphin figurine.

Figure 65:
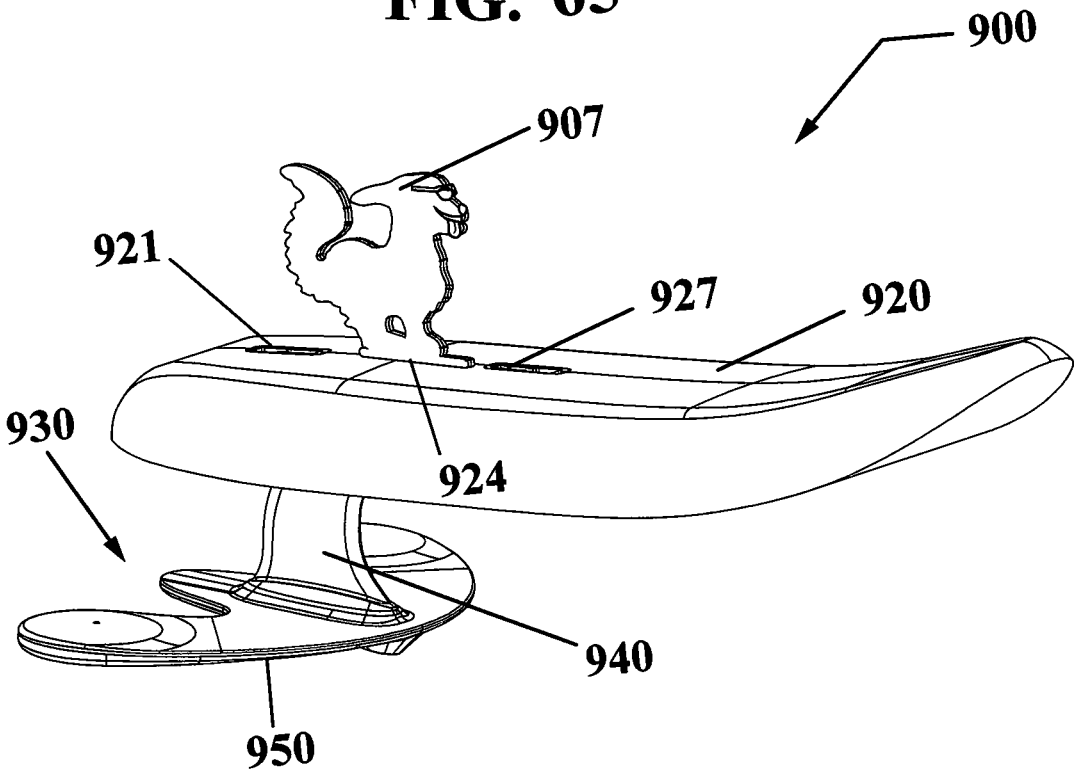

FIG. 65 is another perspective view of the assembled surfing toy of the preceding figures with dog figurine.

Figure 66:
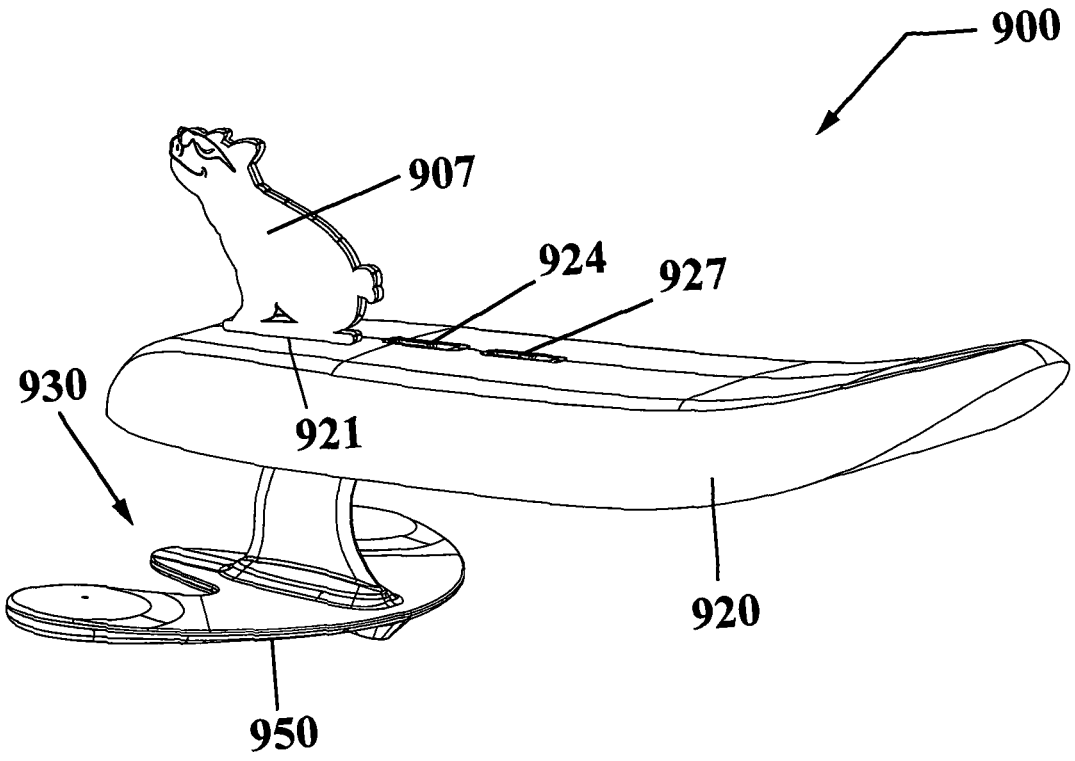

FIG. 66 is another perspective view of the assembled surfing toy of the preceding figures with pig figurine.

Figure 67:
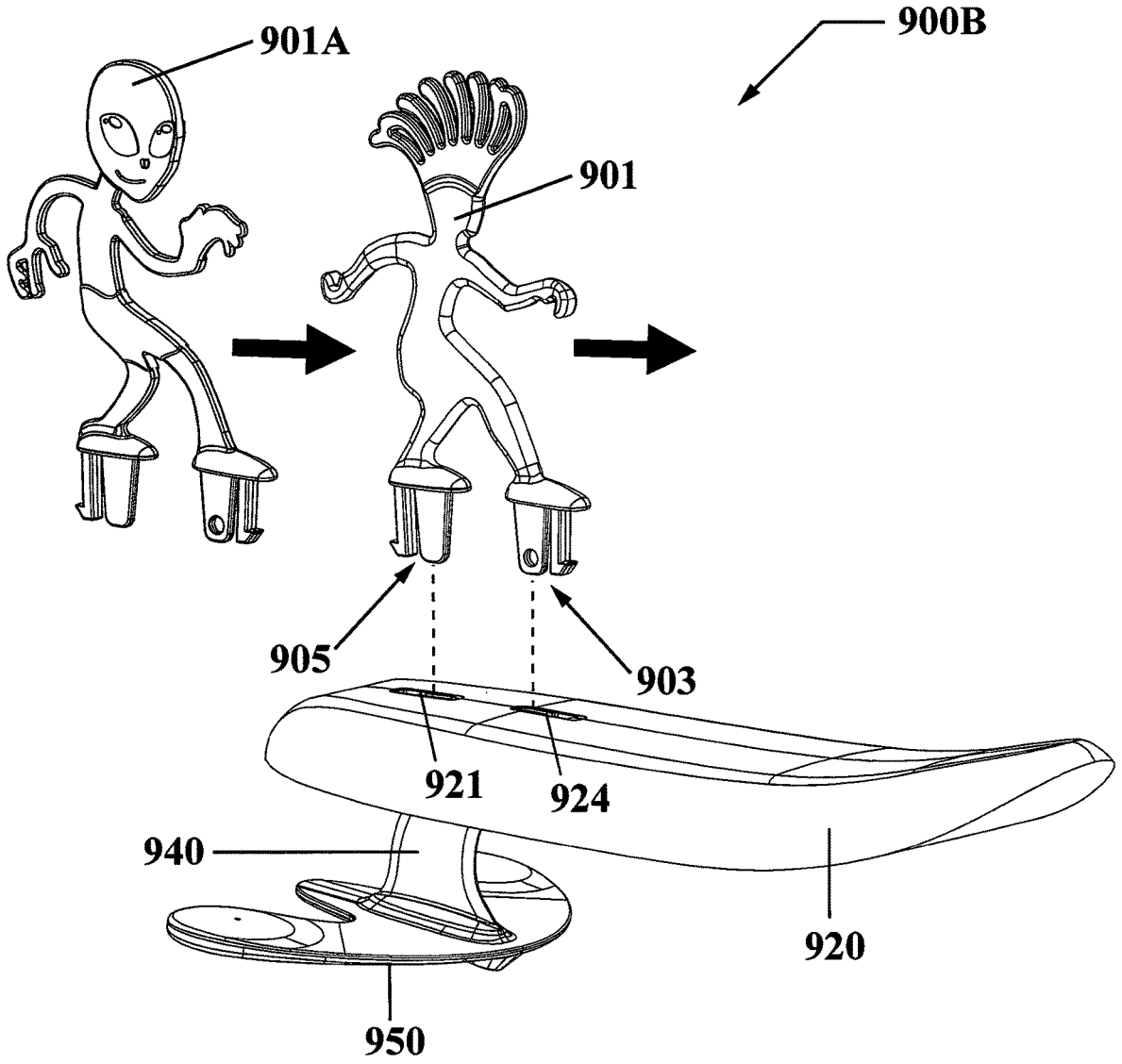

FIG. 67 is another perspective view of an assembled surfing toy of the preceding figures with two top slots for interchangeably mounting different figurines.

Figure 68:
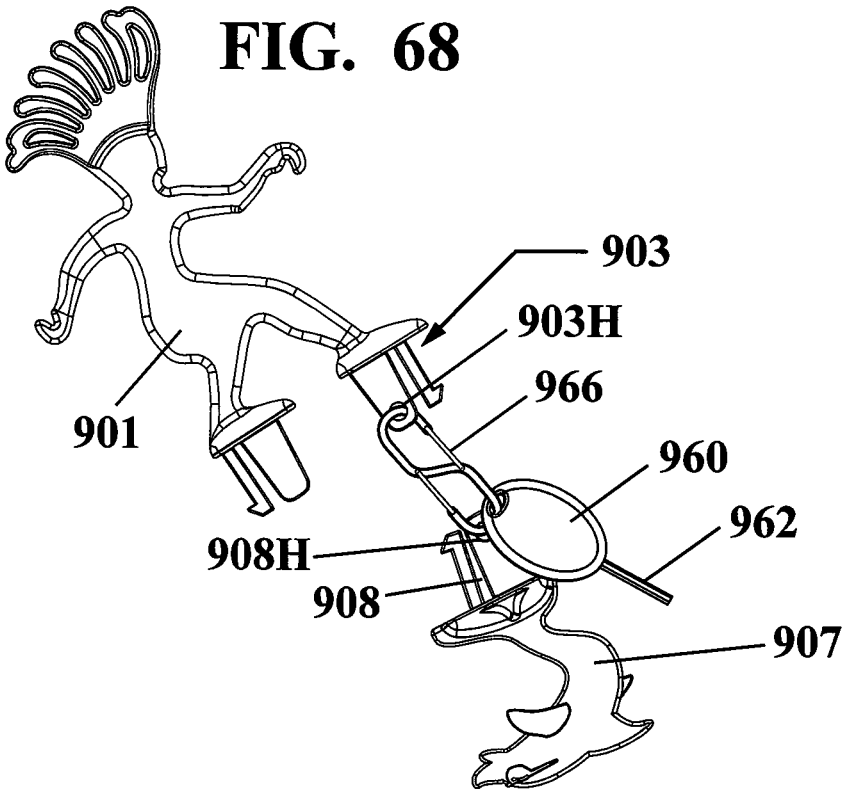

FIG. 68 is a perspective view of attaching one of the interchangeable figurines and key to a keychain.

Figure 69:
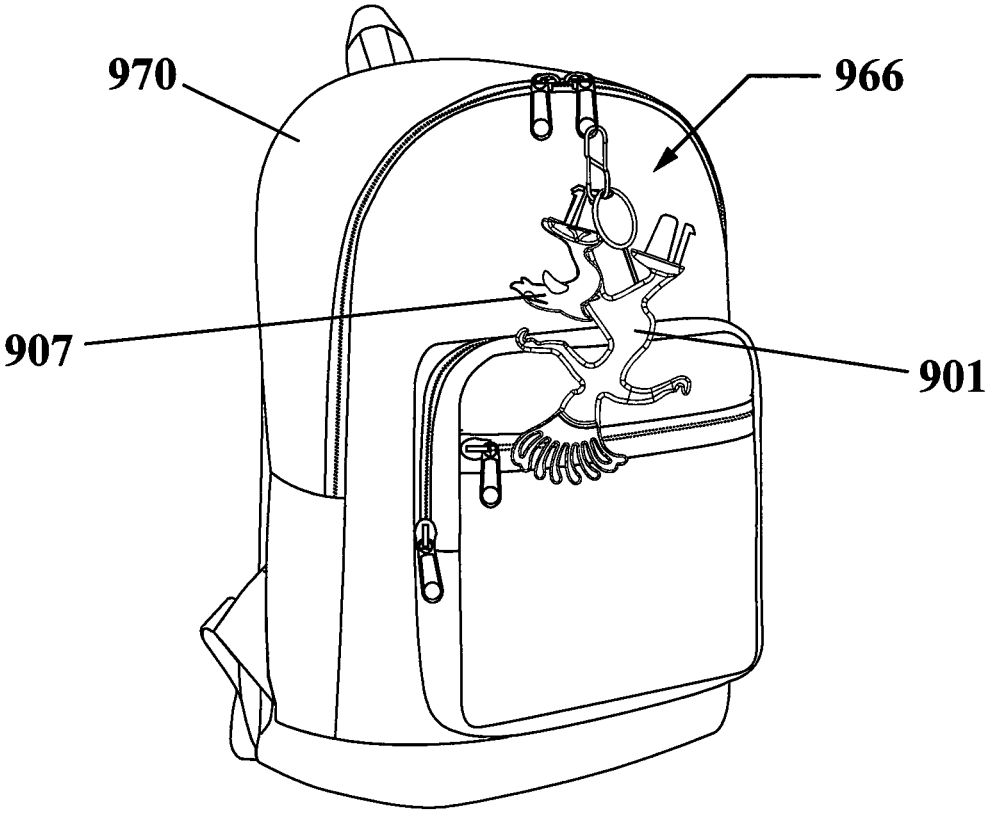

FIG. 69 is a perspective view of the attaching the keychain with figurine and key to a backpack.

Figure 70:
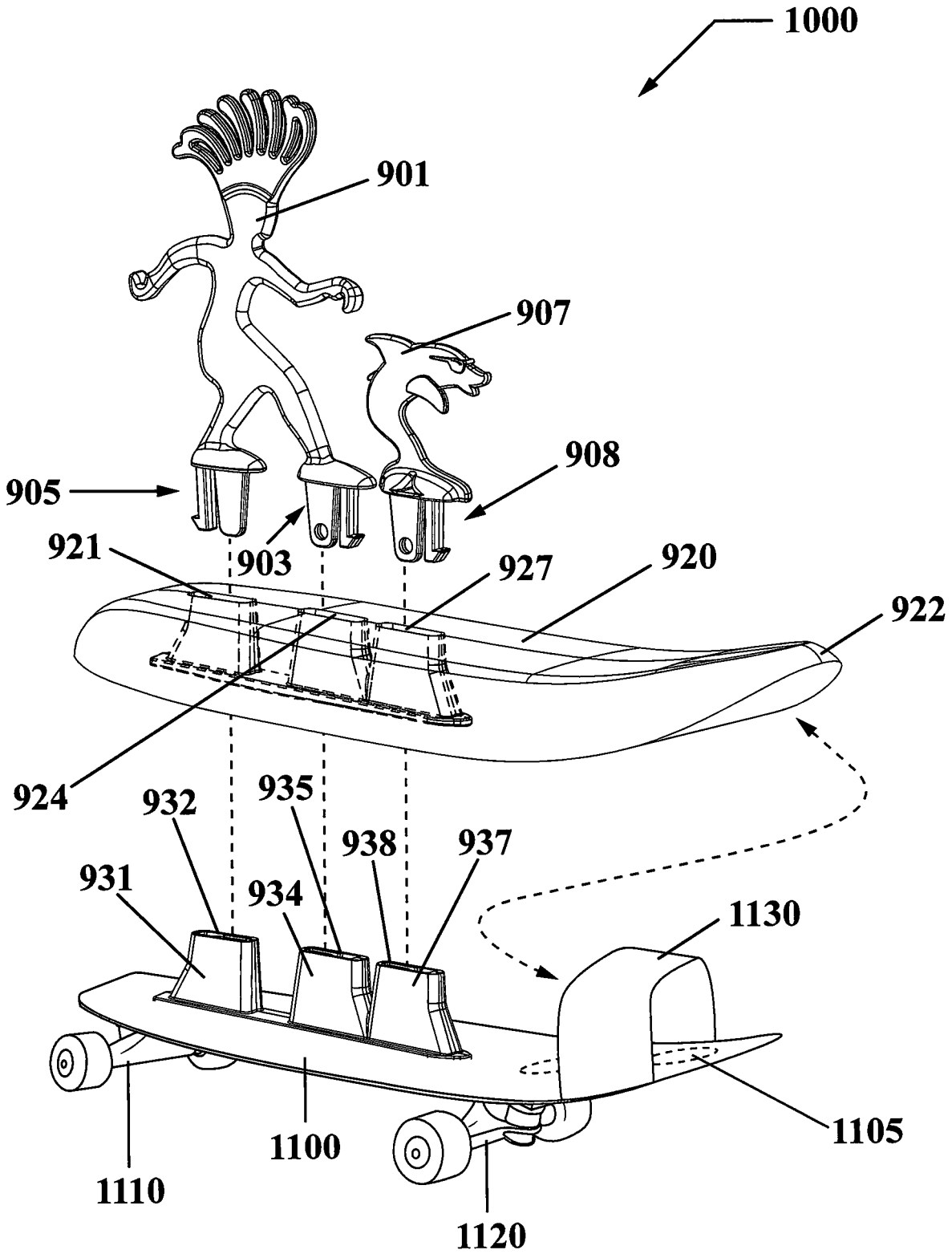

FIG. 70 is an exploded perspective view of figurines and surfboard of the preceding figures and a skateboard base.

Figure 71:
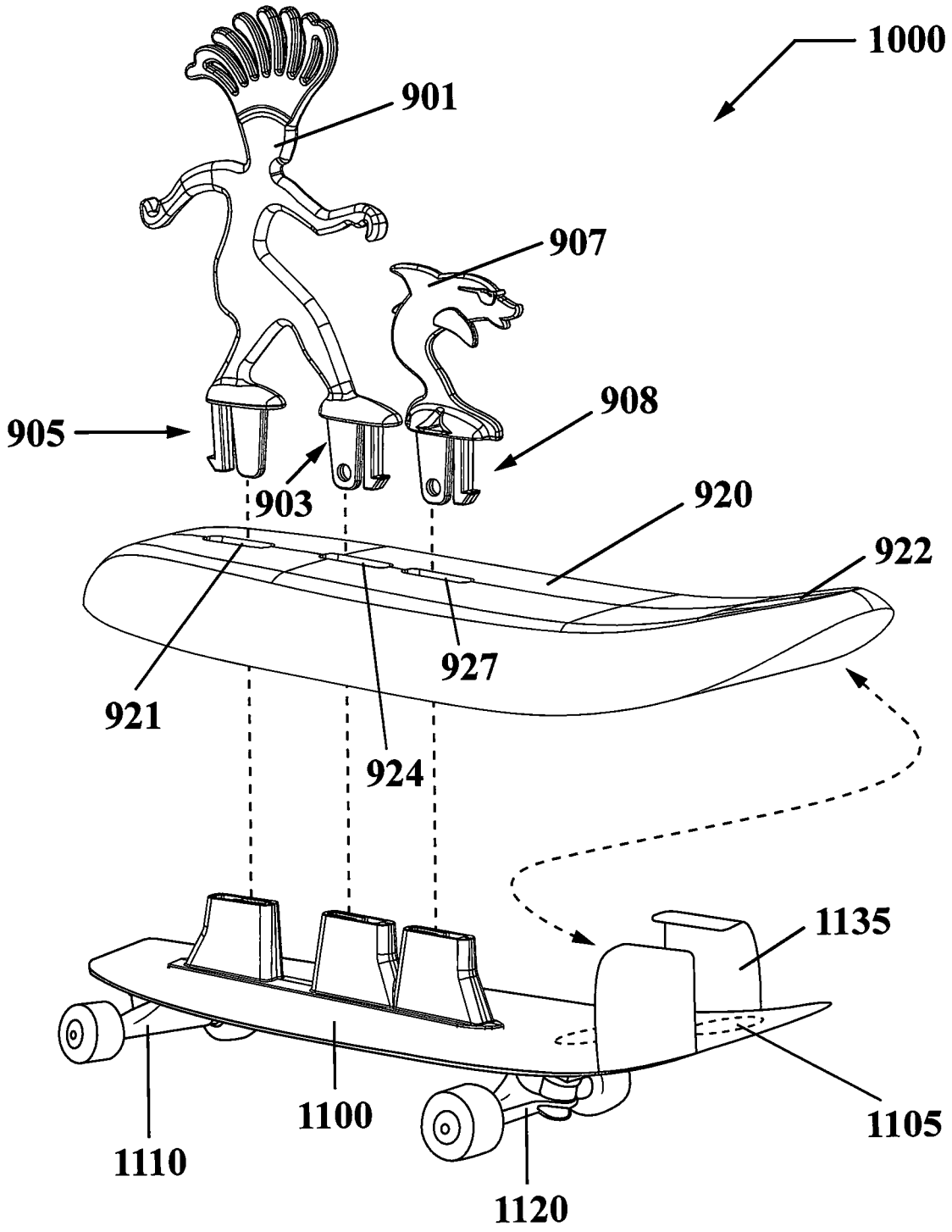

FIG. 71 is another exploded perspective view of a figurines, surfboard of the preceding figures and another skateboard base.

Figure 72:
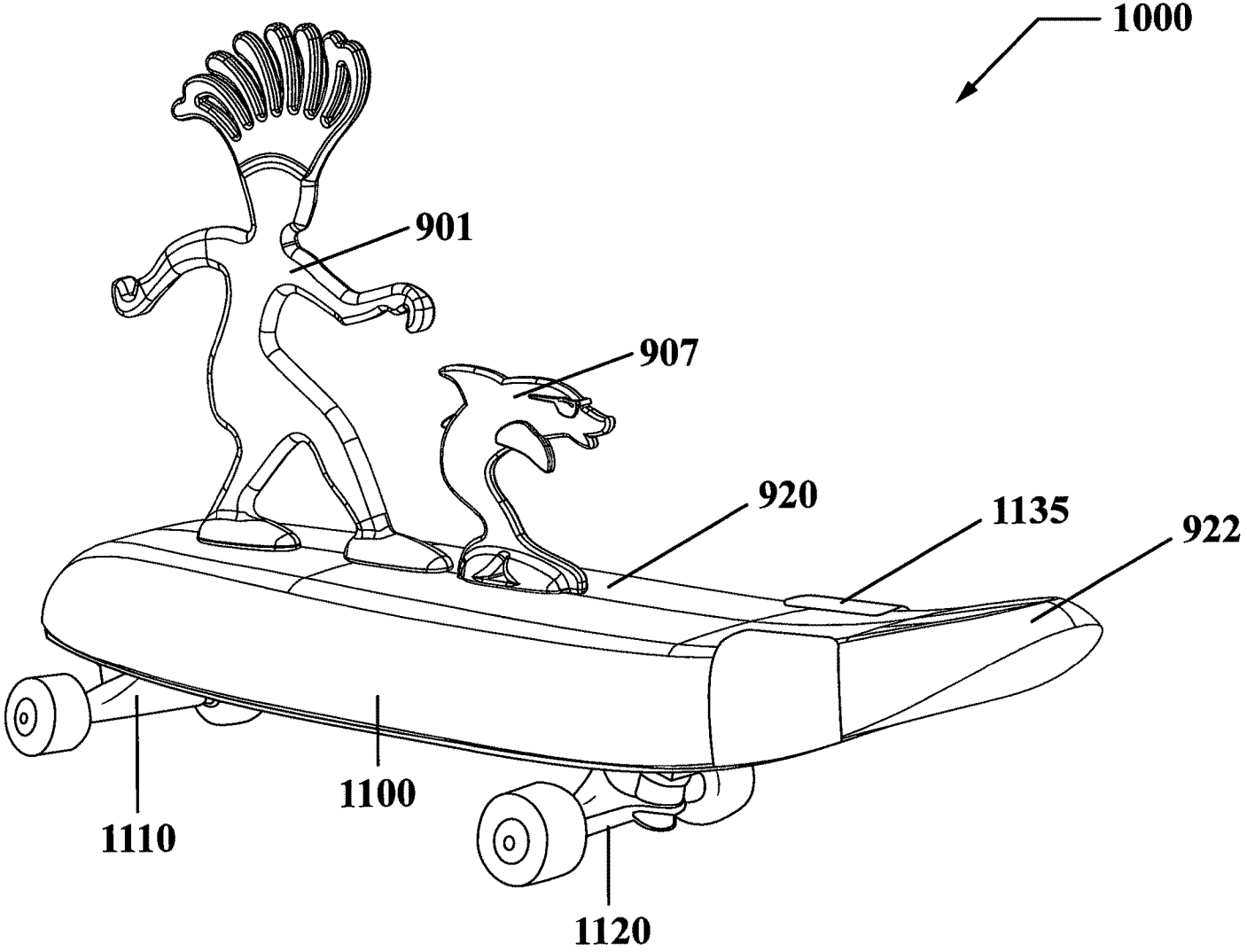

FIG. 72 is a perspective assembled view of FIG. 71 with the figurines mounted to the surfboard which is mounted to the skateboard base.

Figure 73:
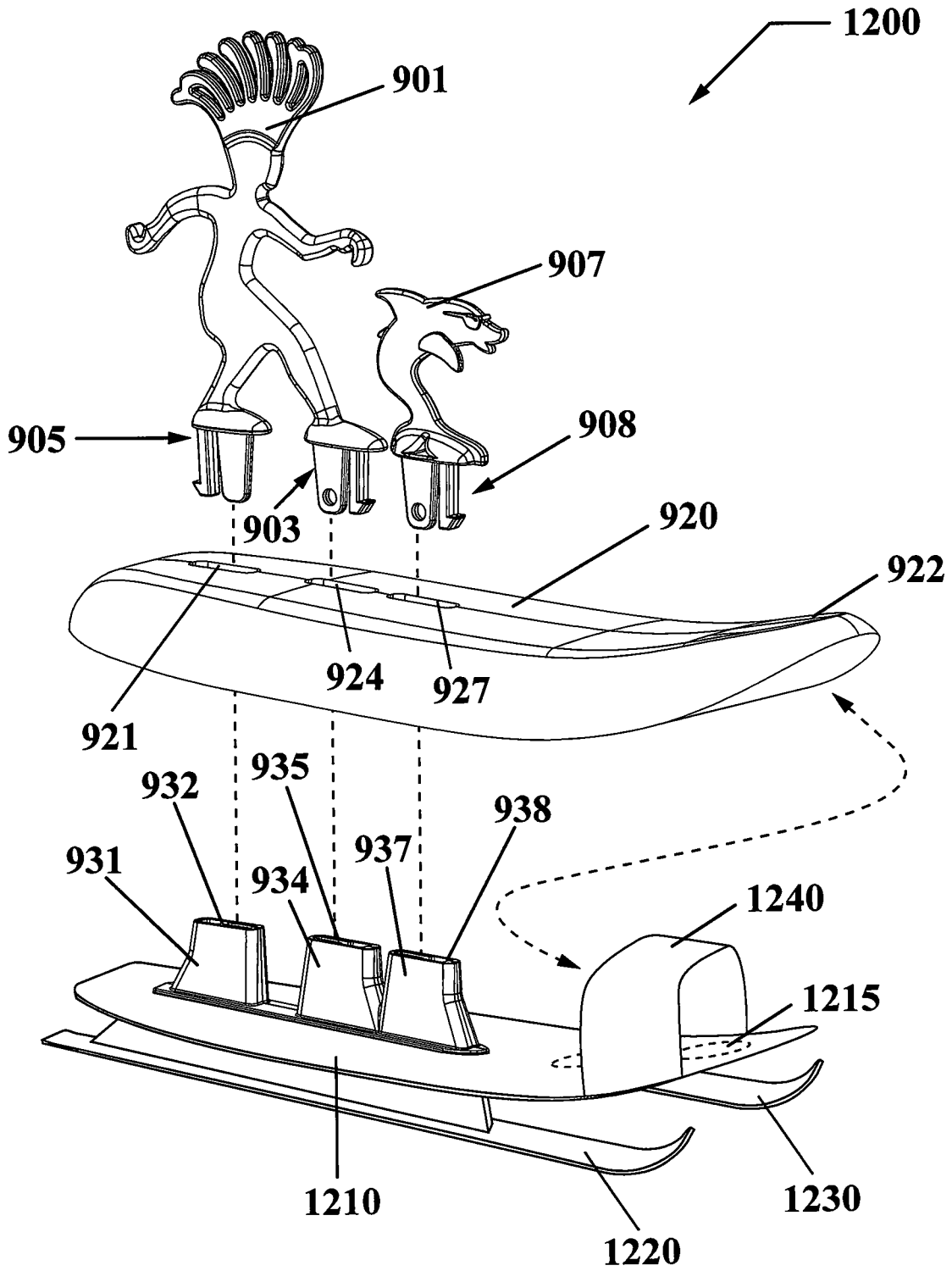

FIG. 73 is an exploded perspective view of figurines and surfboard of the proceeding figures and a sled base.

Figure 74:
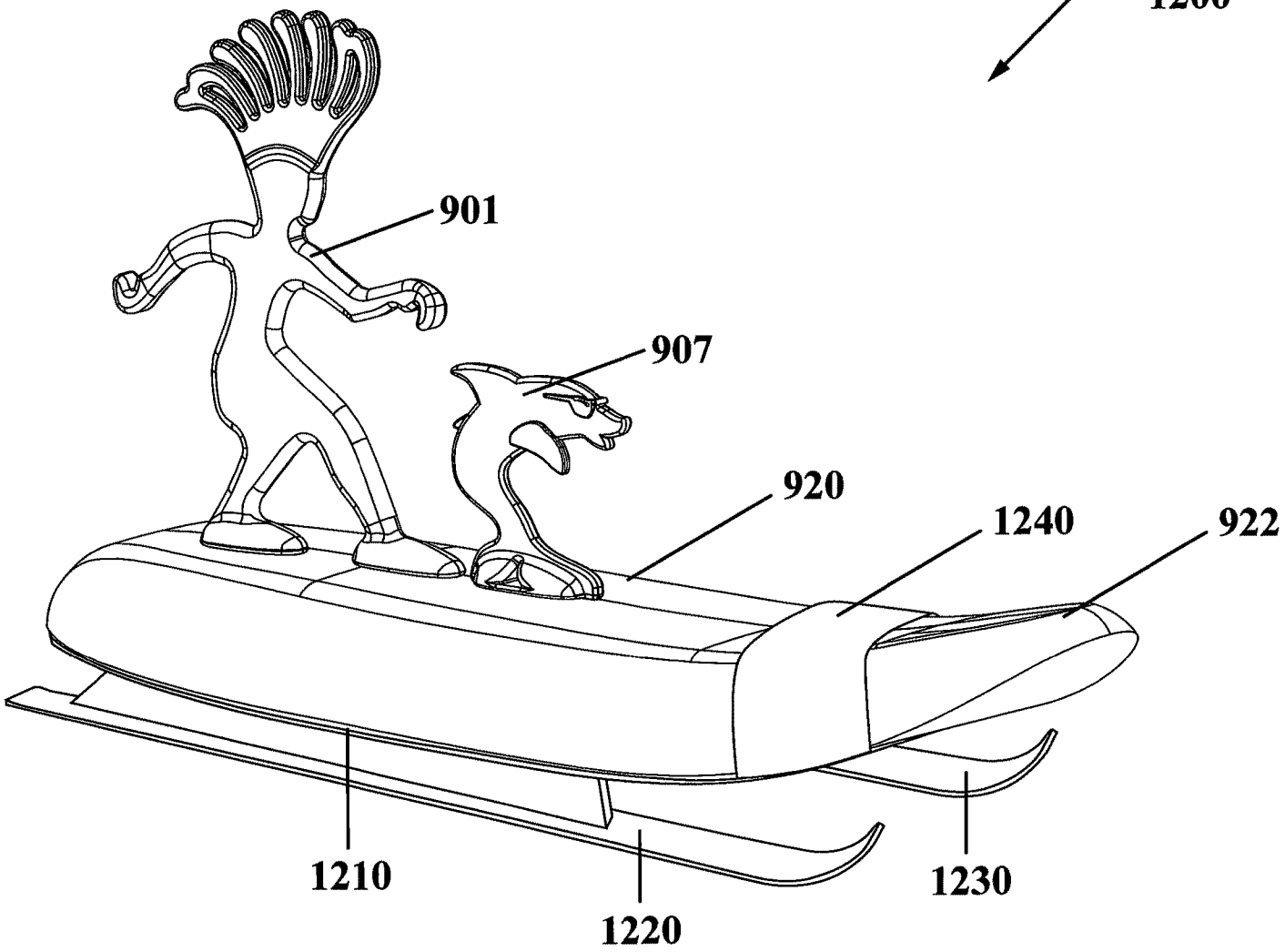

FIG. 74 is a perspective assembled view of FIG. 73 with the figurines mounted to the surfboard which is mounted to the sled base.

Figure 75:
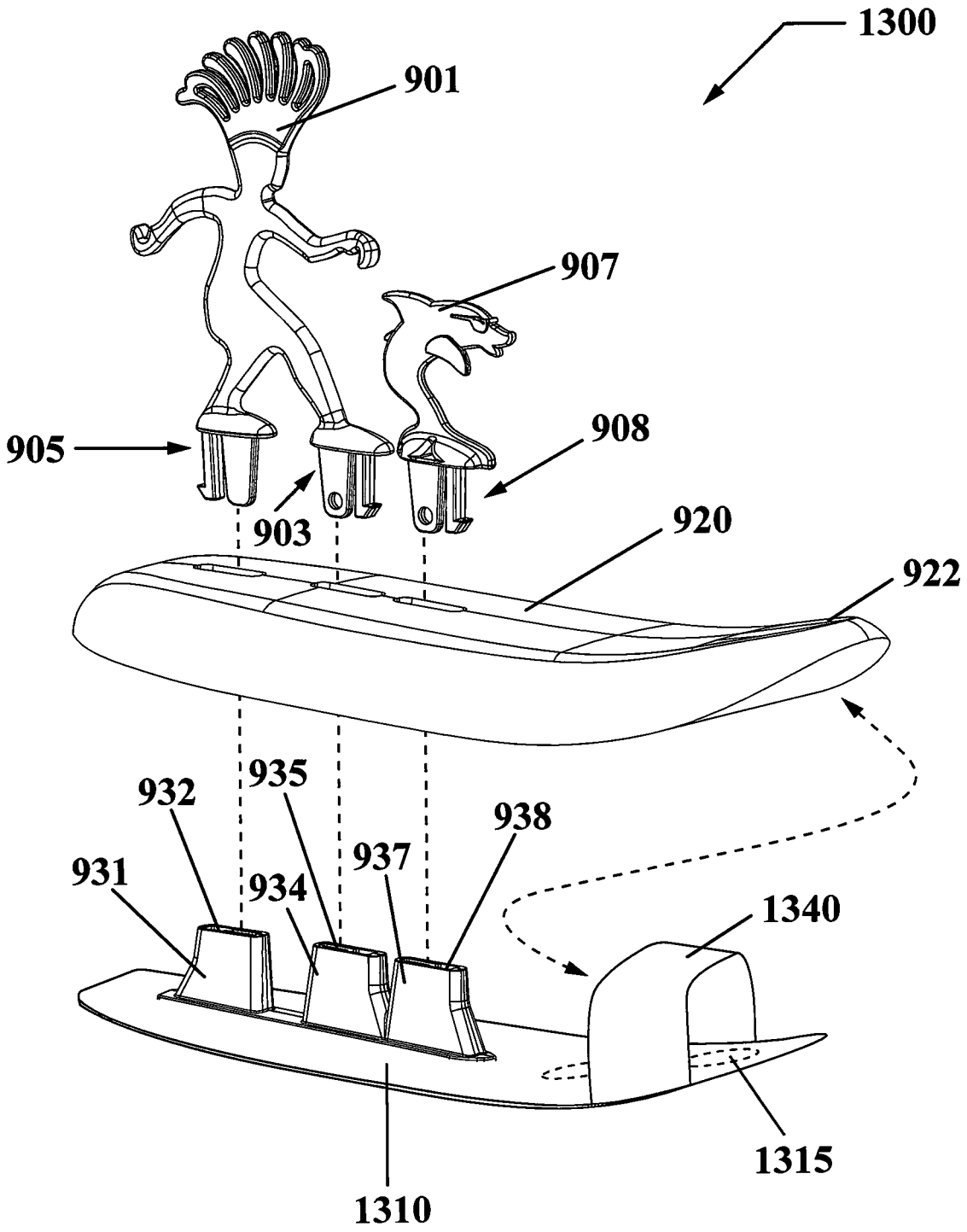

FIG. 75 is an exploded perspective view of the figurines and surfboard of the preceding figures and a snowboard base.

Figure 76:
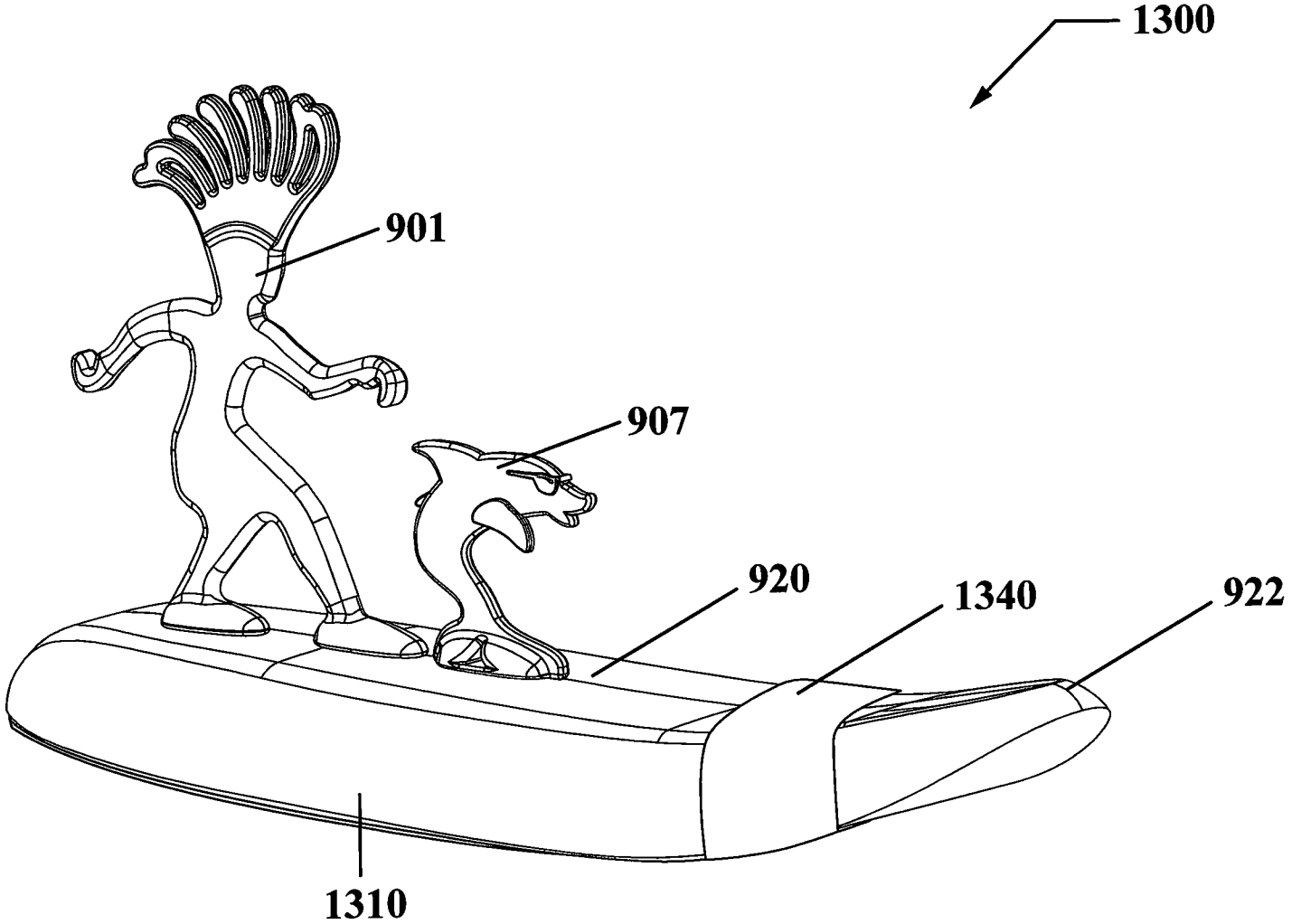

FIG. 76 is perspective assembled view of FIG. 75 with the figurines mounted to the surfboard which is mounted to the snowboard base.

Figure 77:
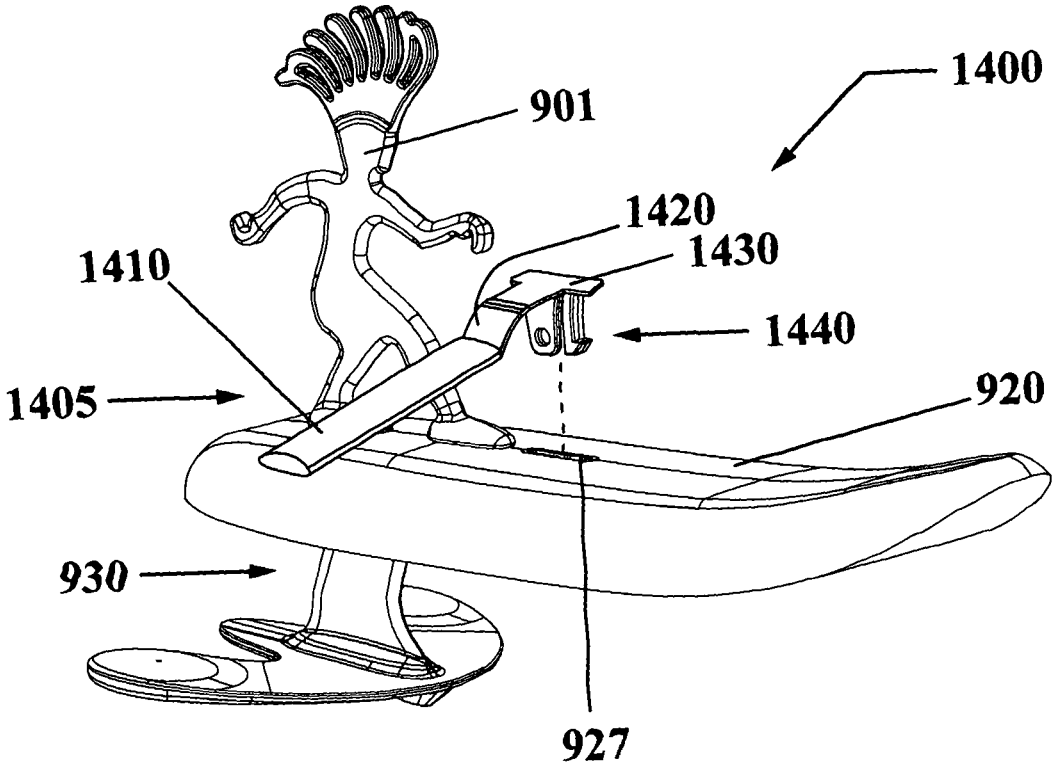

FIG. 77 is an exploded view of the surfboard with interchangeable figurines and detached carve stick.

Figure 78:
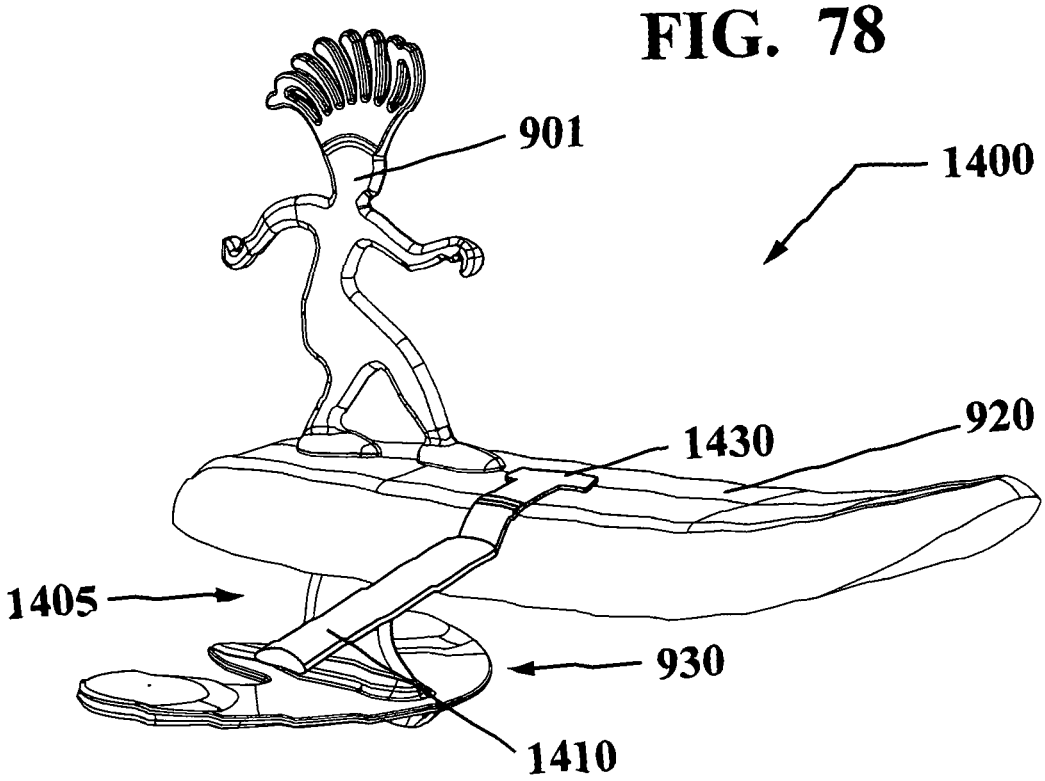

FIG. 78 is an assembled view of the surfboard with attached figurine and carve stick attached to the surfboard.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of the components referenced in the figures will now be described.

10 Water toy
20 Flotation device
22 front upwardly curving end (nose)
24 top surface
26 bottom surface
28 rear end
30 Figurine
40 Hydrofoil-generally V or boomerang shape (weighted)
42 left wing/vane
44 apex
46 right wing/vane
48 stabilizing tail/rudder
50 wing end stabilizers/weights (curved portions or disc shapes)
60 figurine mounting pegs
70 figurine mounting holes in flotation device
80 Keel/strut member (skeg)
82 mount tenon (male member)
90 Keel mount mortise in bottom of flotation device
100 Shore surf
110 Small breaking shore wave
120 Person
130 Water line
140 Flotation zone of toy
150 Pivot point around which Surfer Dude assembly rotates when acted upon by a breaking wave Second Embodiment

200 Second embodiment water toy
205 flotation device
210 top of flotation device
212 front generally beveled tip edge
213 upwardly angling tip
214 generally flat surface
215 front cylindrical through-hole
216 rear square (or rectangular) through-hole
217 rounded beveled upper rear surface edge
218 flat rear end
219 rounded and beveled sides
220 bottom of flotation device
222 flat upwardly angling front surface
223 rounded transition surface
224 generally flat lower surface
226 longitudinal indentation
227 angled tip indentation
228 flat rear indentation
229 slightly upwardly angled rear surface
230 figurine
231 rounded enlarged hair tip ends
232 downwardly extending front cylindrical male peg
233 parallel ribs on front face of front peg
234 flat surface under front foot
236 downwardly extending rear square (or rectangular) male peg
237 parallel ribs on front face of rear peg
238 flat surface under rear foot
239 curved hands
240 skeg
242 upwardly extending front cylindrical tube with socket Upper edge rests generally flush with (or slightly recessed from) upper flotation device surface
243 parallel slits/slots in front face of front tube
244 flat upper ledge surface with narrow tip and flat rear to mateably fit into longitudinal indentation 226 in flotation device bottom 220
246 upwardly extending rear square (or rectangular) tube with socket
Upper edge rests generally flush with upper (or slightly recessed from) flotation device surface
247 parallel slits/slots in front face of rear tube
250 strut portion of skeg
252 front concave curved edge
256 rear convex curved edge
258 enlarged lower footer
260 male connector
262 front split step
264 longitudinal split fin portion
266 longitudinal side rib(s)
270 main wing
272 front convex edge
274 rear extending left wing/vane
275 enlarged rounded (weighted) end
276 rear right wing/vane
277 enlarged rounded (weighted) end
277W Extra weight in outer end of wing/vane
278 flattened bottom end portions
280 central rear extending tail
281 rounded tip end of tail
282 concave root ends of tail
284 sculpted surfaces about concave root ends 282
285 raised footer under front of main wing near apex to allow assembled toy to be balanced when placed on a flat surface for display purposes
286 through-hole mounting slot
287 front end indentation step in wing top
288 side indentation steps along slot 286 sides in wing bottom
300 Third embodiment water toy
304 upwardly protruding object (figurines, statutes, cartoon characters, FIGS.
306 animals
310 Fourth embodiment water toy
312 upwardly protruding vehicle, such as but not limited to automobile, van, truck, bus, any other type of toy, and the like
320 Fifth embodiment water toy
322 sail, wind sail, and the like
324 Additional illustration on the sail/wind sail, such as but not limited to figurine, statute, cartoon character, figures, animals as referenced above, vehicles as referenced above, and any other illustration and the like
340 Sixth embodiment, locations of weights in previous embodiments
350 Hydrofoil main wing with no extra weights
360 Hydrofoil main wing with weight(s) in or on tail
362 weight(s) in or on tail 280
365 Hydrofoil main wing with weight(s) in or on front end of main wing
368 weight(s) in or on front end of main wing

370 Hydrofoil skeg with weight(s) in or on skeg
372 weight(s) in or on skeg
380 Hydrofoil main wing with weights and skeg with weight(s) in various possible combination(s)
390 Hydrofoil main wing with torpedo shaped weights in left and right wing vanes
392 extra torpedo shaped weight in left wing vane
393 outer molded surface on torpedo shaped weight
394 extra torpedo shaped weight in right wing vane
395 outer molded surface on torpedo shaped weight
400 Seventh Embodiment hydrofoil with bendable left wing vane and/or right wing vane
404 first bend line for left wing vane 274
405 second bend line for left wing vane 274
406 first bend line for right wing vane 276
407 second bend line for right wing vane 276
408 bend line for tail end of main wing
420 Eighth Embodiment interchangeable upwardly protruding objects
430 interchangeable upwardly protruding object such as female figurine
500 Ninth Embodiment interlocking fasteners for protruding objects
502 bottom of flotation device
503 pocket indentation in bottom of flotation device
504 first through-hole in flotation device
506 second through-hole in flotation device
505 flotation device
507 top of flotation device
510F upwardly protruding object (female figurine)
512 rear foot with flat bottom
514 downwardly extending rear foot peg
516 enlarged head on stem
518 front foot with flat bottom
519 hook shaped slot
520 first version skeg
521 through-hole in rear of upper plate
522 upper plate on skeg
524 upwardly protruding peg
525 upper hook end on peg 524
526 narrow stem between skeg 520 and bottom end 528
527 downward facing protrusions
528 bottom end of skeg
530 twist on main wing
532 key-hole slot
533 narrow outer end slots
535 indentation slots on both sides of key-hole slot 532
540 second version skeg
542 enlarged rectangular bottom
545 front and side facing teeth protrusions
560 slide on main wing
564 rectangular indentation
565 side track-channels in indented top surface
567 front and side edge slots in indentation 564
570 Tenth embodiment
571 upwardly protruding object
572 rear flat bottom foot
573 hook shaped slot in rear foot 572
574 front flat bottom foot
575 hook shaped slot in front foot 574
580 main wing
583 rear narrow through-hole
584 pocket shaped indentation in bottom surface of main wing 580
585 central rectangular through-hole
587 front narrow through-hole
590 slide through skeg
592 rear upwardly protruding peg
593 upper hook end
594 front upwardly protruding peg
595 upper hook end
596 middle section of skeg
597 flat upper end of middle section
598 enlarged bottom flat plate
600 Eleventh embodiment rotatable main sail and windsurf sail
610 Main sail/windsurf sail
620 figurine/character
622 front foot
625 slot in bottom of foot
626 unattached rear foot
630 flotation device
631 through-hole in flotation device
632 top of flotation device
633 pocket indentation in bottom of flotation device 630
635 bottom of flotation device
640 skeg
644 upper enlarged plate
646 upwardly protruding peg
648 fastener head on peg
650 main wing
700 Twelfth toy embodiment with no upwardly protruding object
720 flotation device
730 skeg
740 main wing
800 Thirteenth embodiment with towable toy
810 toy
815 fastening slot in toy
820 tow line
830 power boat
840 Fourteenth embodiment for tethering from shore or fishing
845 person tethering toy or fisherman
847 tethering or fishing rods
900 Fifteenth embodiment of interchangeable figurines and hydrofoil skeg and main wing for easy assembly/disassembly.
901 figurine with two feet
901A interchangeable figurine with two feet
902 footer(s)/base(s)
903 front dual peg
903H hole for keychain
904 front peg catch
905 rear dual peg
906 rear peg catch
907 figurine with one dual peg
908 dual peg
908H hole for keychain
909 peg catch
910 footer/base
920 flotation device (surfboard)
921 first slot
922 upwardly bent front end of flotation device (surfboard)
924 second slot
927 third slot
930 hydrofoil
931 first upwardly protruding member
932 first cavity
933 first ledge/edge
934 second upwardly protruding member
935 second cavity
936 second ledge/edge
937 third upwardly protruding member

938 third cavity
939 third ledge/edge
940 skeg
942 upper plate on skeg
943 first release opening
944 second release opening
945 third release opening
946 bottom plate on skeg
948 front catch
950 main wing
952 elongate slot in main wing
953 ledge/edge for catch
955 release opening through bottom of main wing
960 key ring
962 pin
966 keychain
970 backpack
1000 Skateboard toy conversion
1100 platform base
1105 imbedded weight(s)
1110 rear set of wheels
1120 front set of wheels
1130 closed tip clip
1135 open top tip clip
1200 Sled toy conversion
1210 sled platform base
1215 imbedded weight(s)
1220 left sled rail
1230 right sled rail
1240 tip clip
1300 Snowboard toy conversion
1310 snowboard platform base
1315 imbedded weight(s)
1340 tip clip
1400 Carve Stick Attachment
1405 carve stick
1410 elongated handle
1420 upward bend
1430 top end
1440 dual pegs

First Embodiment

Figure 1:
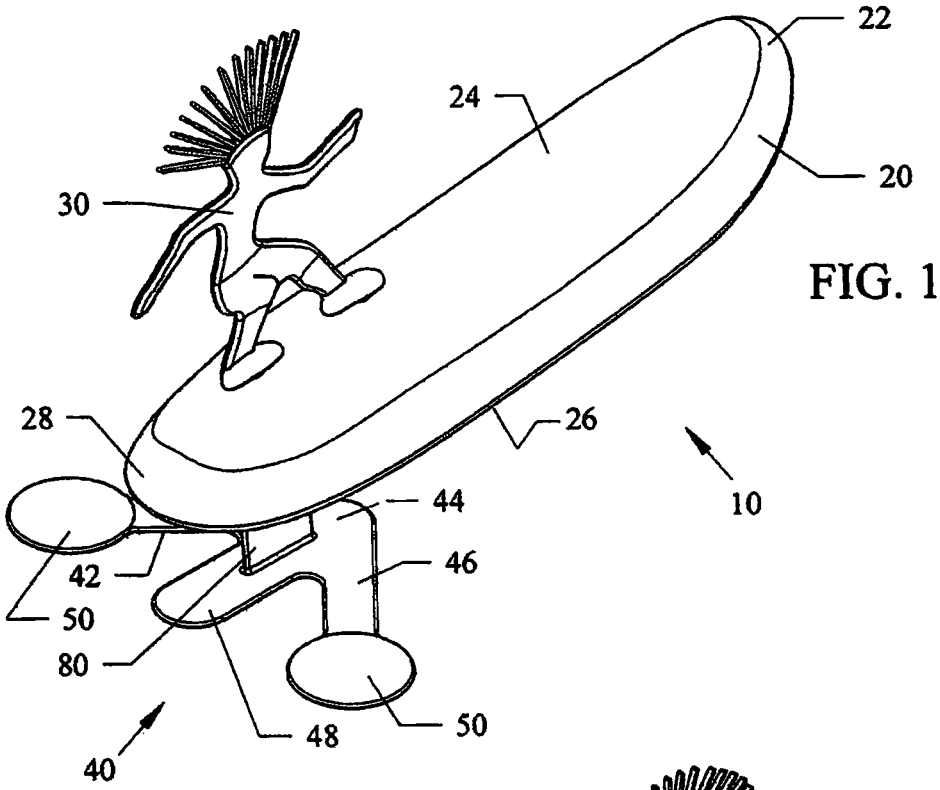
FIG. 1 is a top right perspective view of toy with mounted figurine and hydrofoil.
Figure 2:
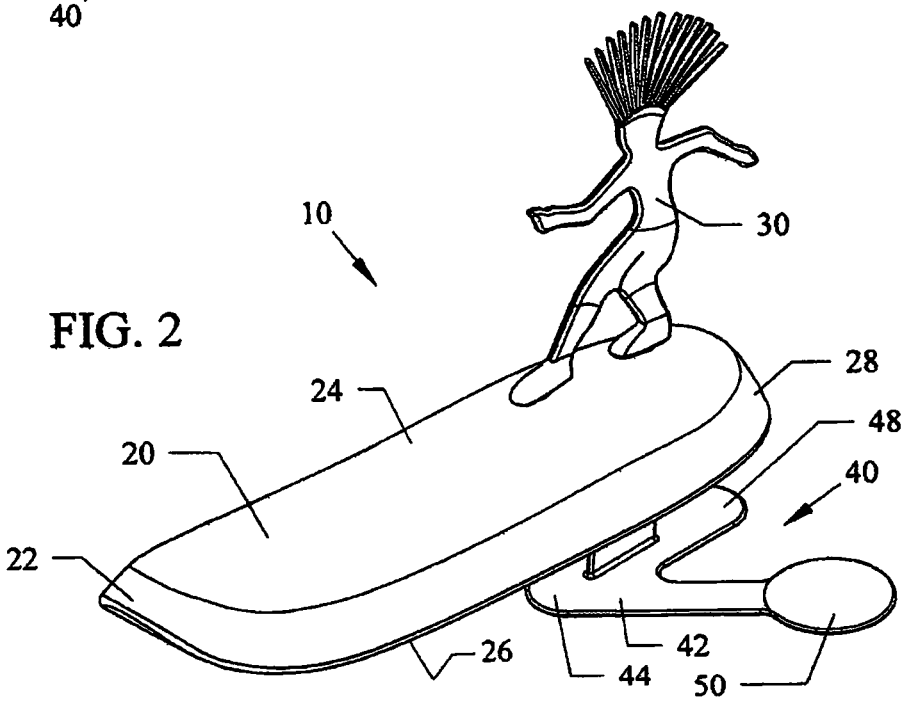
FIG. 2 is a top left perspective view of the toy of FIG. 1.
Figure 3:
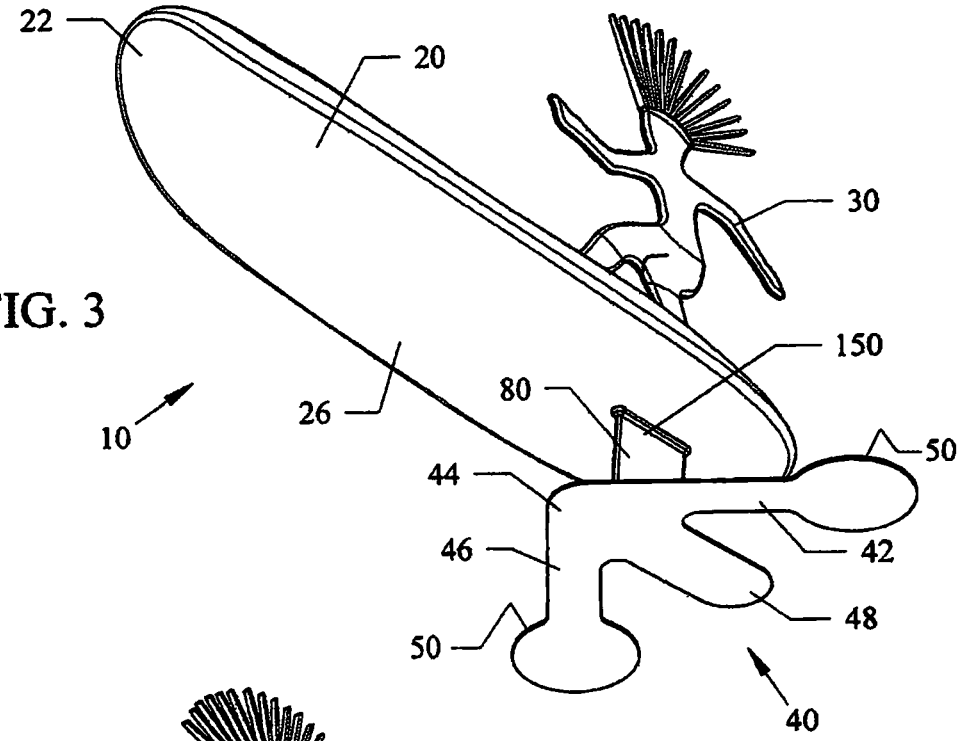
FIG. 3 is a bottom left perspective view of the toy of FIG. 1.
Figure 4:
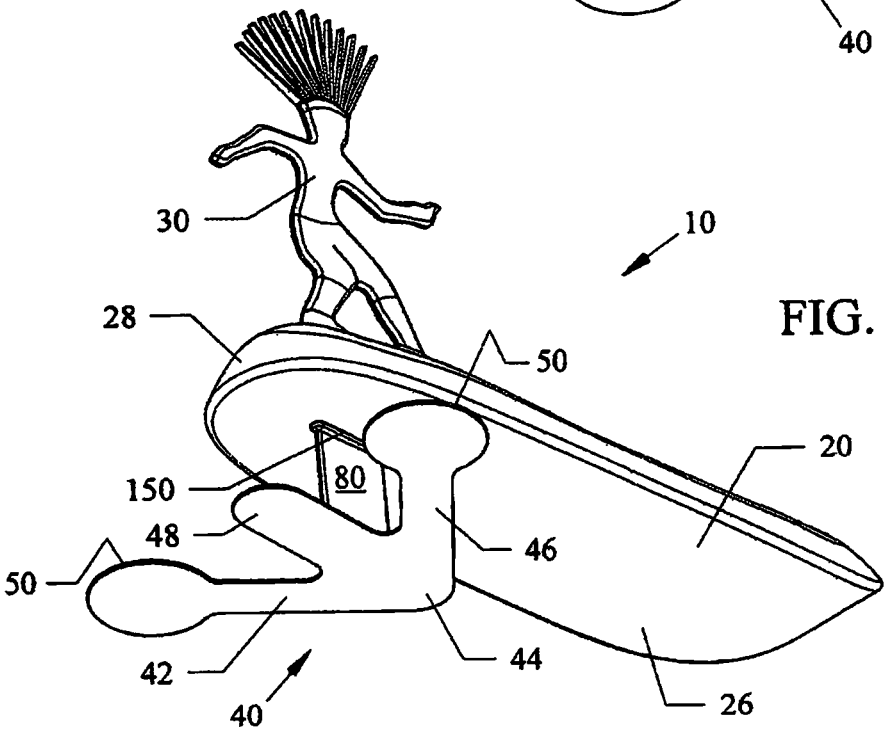
FIG. 4 is a bottom right perspective view of the toy of FIG. 1.

FIG. 1 is a top right perspective view of toy 10 having flotation device 20 with mounted figurine 30 and hydrofoil 40. FIG. 2 is a top left perspective view of the toy 10 of FIG. 1. FIG. 3 is a bottom left perspective view of the toy 10 of FIG. 1. FIG. 4 is a bottom right perspective view of the toy 10 of FIG. 1.

Figure 5:
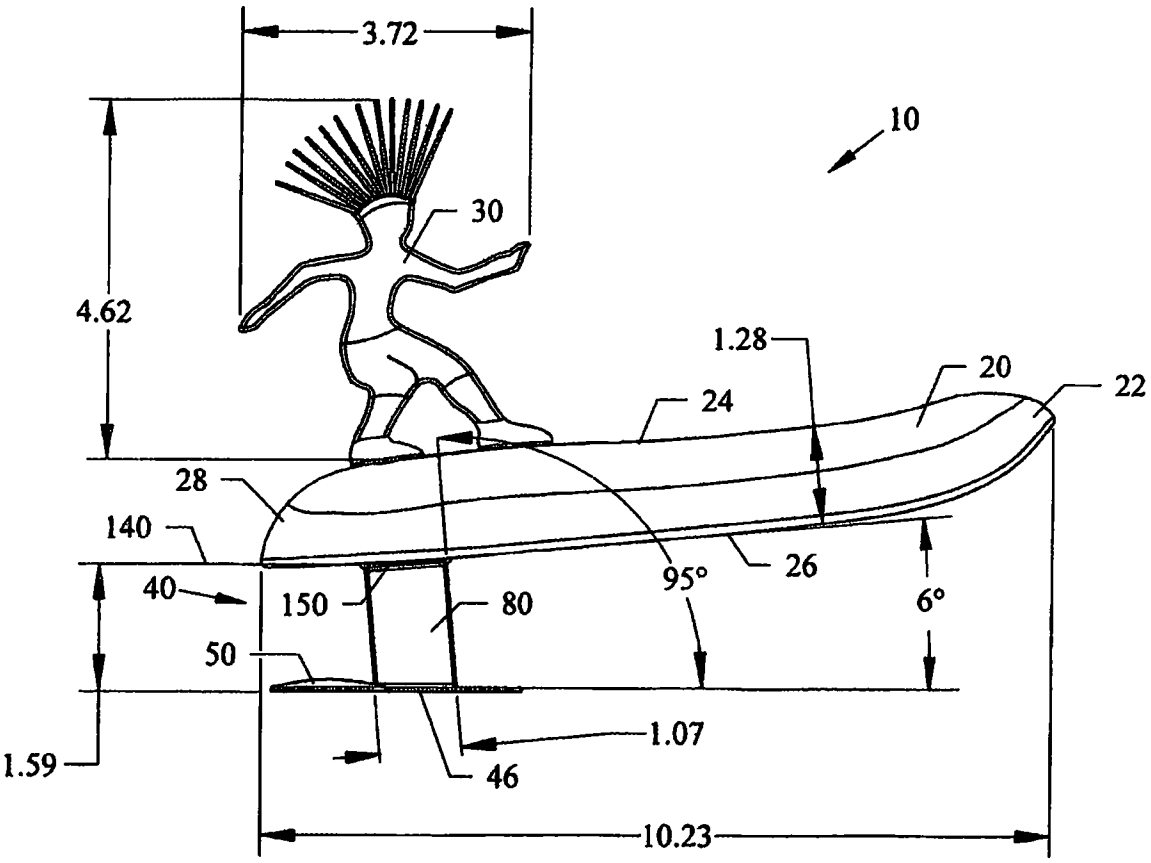
FIG. 5 is a side view of the toy of FIG. 1.
Figure 6:
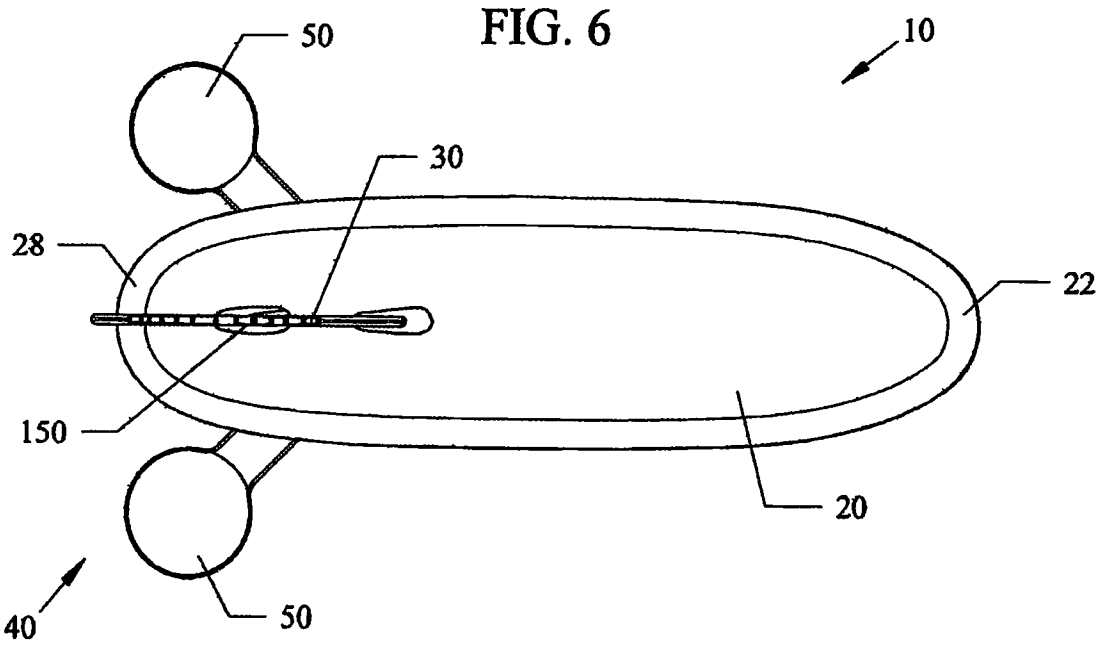
FIG. 6 is a top view of the toy of FIG. 1.
Figure 7:
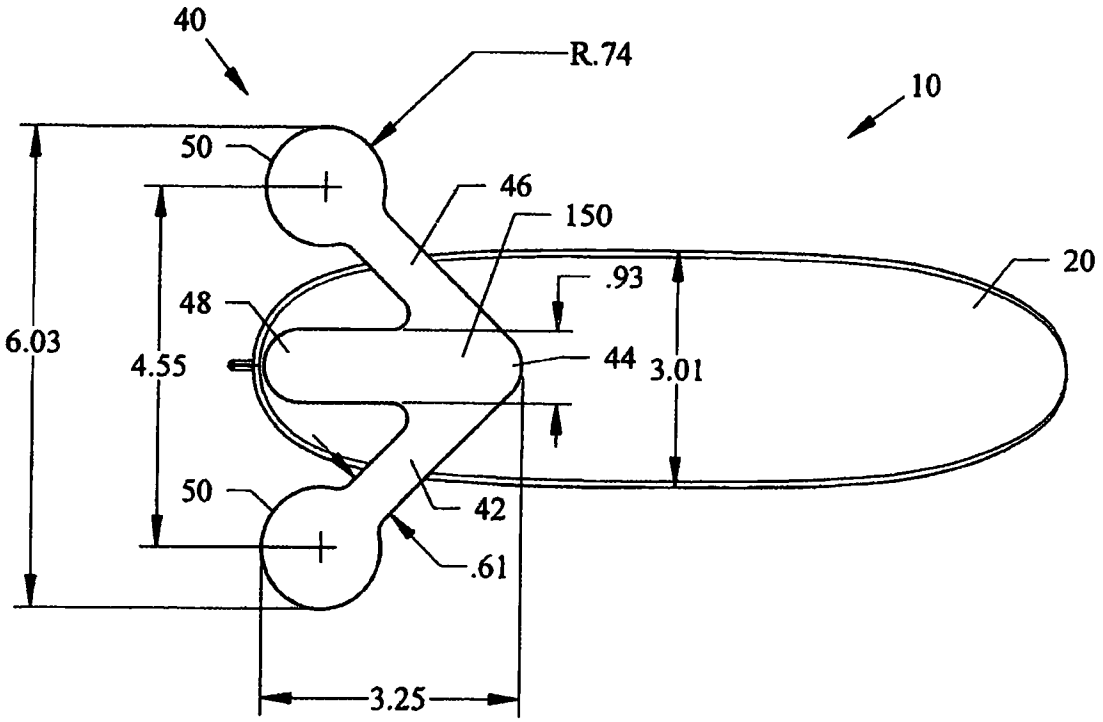
FIG. 7 is a bottom view of the toy of FIG. 1.
Figure 9:
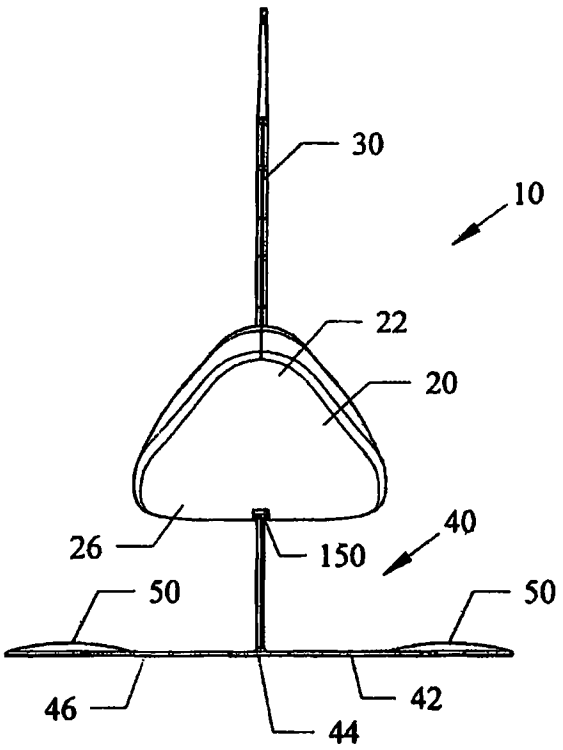
FIG. 9 is a front view of the toy of FIG. 1.
Figure 8:
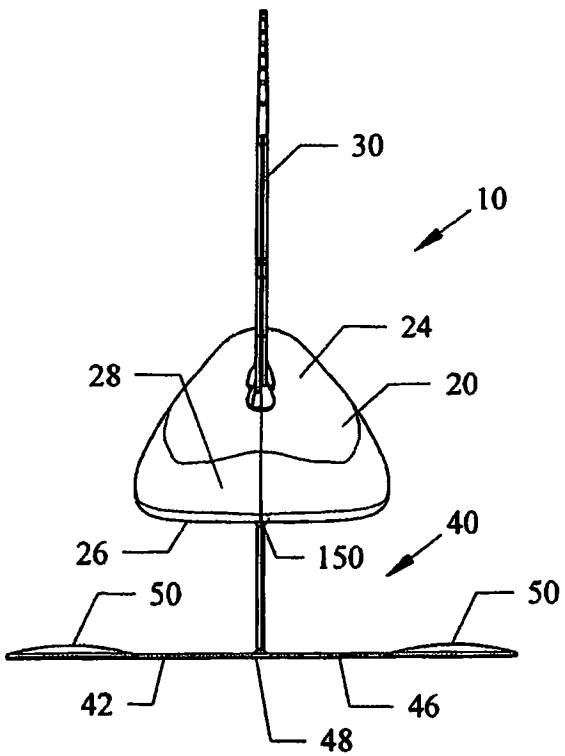
FIG. 8 is a rear view of the toy of FIG. 1.
Figure 11:
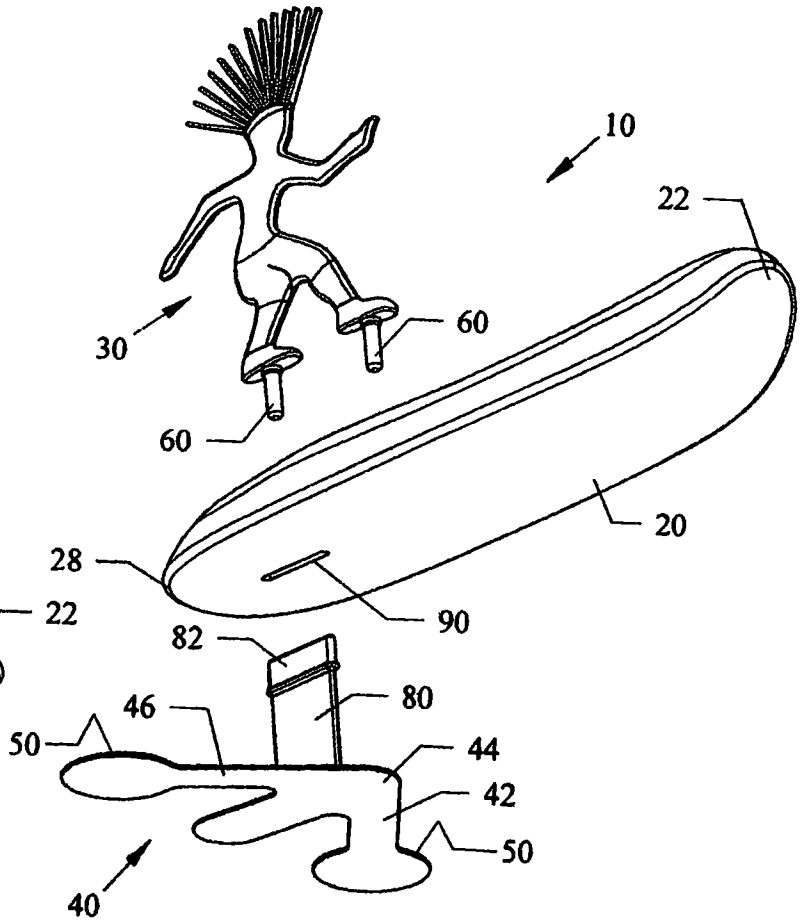
FIG. 11 is a bottom exploded perspective view of the toy of FIG. 1.
Figure 10:
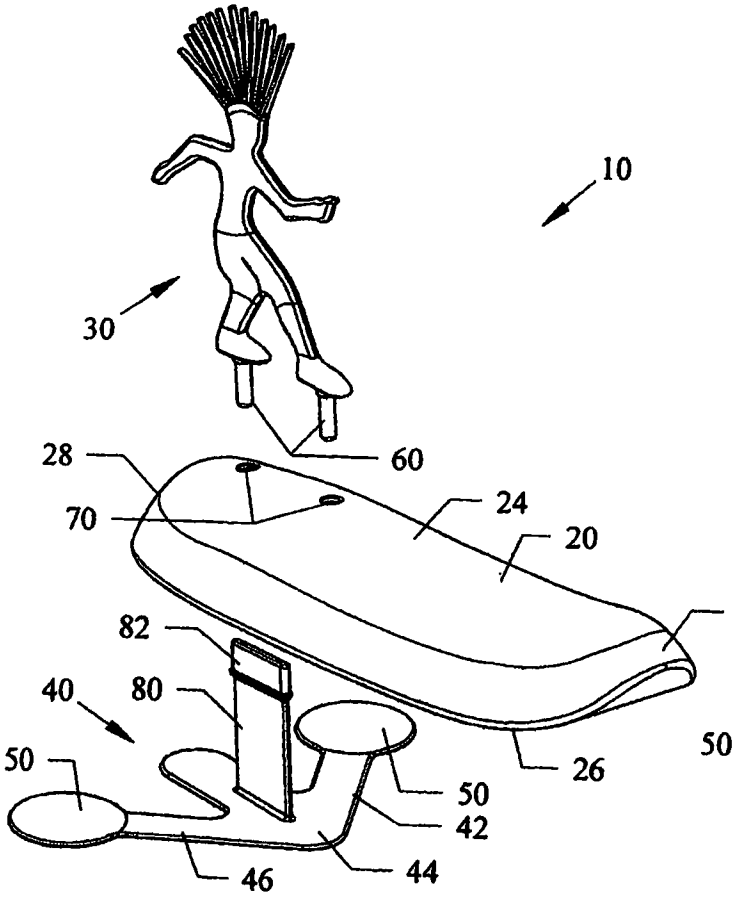
FIG. 10 is a top exploded perspective view of the toy of FIG. 1.

FIG. 5 is a side view of the toy 10 of FIG. 1 with dimensions of a preferred embodiment. FIG. 6 is a top view of the toy 10 of FIG. 1. FIG. 7 is a bottom view of the toy 10 of FIG. 1 with dimensions of a preferred embodiment. FIG. 8 is a rear view of the toy 10 of FIG. 1. FIG. 9 is a front view of the toy 10 of FIG. 1. FIG. 10 is a top exploded perspective view of the toy 10 of FIG. 1. FIG. 11 is a bottom exploded perspective view of the toy 10 of FIG. 1.

Flotation Device 20

Referring to FIGS. 1-11, the novel toy 10 can include a flotation device 20 having a front upwardly curving end 22 with rounded tip and a rear end 28 with rounded edge with a top side 24 and bottom side 26. The flotation device 20 can be formed from injection molded foam, or foam rubber cut into a selected shape, or other lightweight material impervious to water. Alternatively, the flotation device 20 can be formed from in injection molded plastic hollow housing with rubber placed inside the plastic shell.

Referring to FIGS. 5-7, the flotation device 20 can have dimensions of approximately 10.23 inches in length from the front end 22 to the rear end 28, and have a width of approximately 3.01 inches that tapers down at both the front end 22 and the rear end 28 to rounded tips. The thickness of the flotation device 20 can have a thickness of approximately 1.28 inches with the rear end 28 curving downward to an outer edge. The flotation device 20 has a generally flat bottom surface 26 that curves upward near the front end 22 in order to aid in lift of the flotation device when riding incoming waves.

Figurine 30

Referring to FIGS. 1-11 and mounted to the top surface 24 of the flotation device 20 adjacent to the rear end 28 can be figurine 30 mounted thereon. The figurine 30 can have downwardly extending male members 60, such as pegs, that are insertable into figurine mounting holes (female receptacles) 70 on the top surface 24 of the flotation device 20 adjacent to the rear end 28 of the flotation device 20 as shown in FIGS. 10-11. The pegs 60 can be locked into the mounting holes 70 with waterproof glue or cement and the like.

Referring to FIG. 5, the figurine 30 can be formed from injection molded plastic and the like, and have a height from a foot portion mounted to the top surface 24 of the flotation device 20 to the top of the head portion to be approximately 4.62 inches and a width of approximately 3.72 inches between ends of the outstretched hands. Additionally, the figurine 30 can be formed from a lightweight foam so that it will stay upright easily while being pummeled by waves as the toy 10 is being used in the surf of incoming waves. The figurine can be narrow thin stick figure turned sideways so the plane of the planar shaped body is in the same plane as the keel/strut member 80 mounted underneath the flotation device 20. The figurine 30 can be mounted almost directly above the keel/strut member 80.

Hydrofoil 40 and Keel/Strut Member 80

Referring to FIGS. 1-11, and mounted underneath the flotation device 20 adjacent to the rear end 28 can be a hydrofoil 40. A generally rectangular and narrow diameter keel type strut member 80 can be turned so that one side edge faces forward and the opposite side edge faces rearward. The keel/strut member can have a upper male member (tenon) that fits into a mateable slit 90 on the bottom surface 26 of the flotation device 20 adjacent to the rear end 28 of the flotation device 20 can be locked with waterproof glue or cement and the like.

Referring to FIG. 5, the keel/strut member 80 can have a height of approximately 1.59 inches between the bottom surface 26 of the flotation device and the top of the generally flat left wing/vane (not shown) and right wing/vane 47 of the hydrofoil 40.

Referring to FIGS. 1-11, the hydrofoil 40 can have a generally V or boomerang shape with a generally flat thin left wing/vane 42 connected to a generally flat thin right wing/vane 46 by a rounded/curved tip apex portion 44. The outer free ends of the left wing/vane 42 and right wing/vane 46 extend rearward from the apex portion and outward from the sides of the flotation device 20, and end in additional stabilizer/weighted curved portions 50. The wing end stabilizer/weighted portions 50 can be curve shaped and can include disc shapes and the like. The wing end stabilizer/weighted portions 50 can be slightly thicker with a slightly rounded top surface to add additional stabilizing weight to the hydrofoil 40. Extending rearward from the apex portion 44 can be an optional generally flat stabilizing tail rudder 46 located between the left wing/vane 42 and the right wing/vane 46.

Referring to FIGS. 5 and 7, the hydrofoil 40 can have an overall length between outer ends of the of outer stabilizing weights to be approximately 6.03 inches, and a length from the apex portion outer edge 44 to the outer end of the tail/rudder member 48 to be approximately 3.25 inches. Each of the wings/vanes 42, 46 can have a width of approximately 0.61 inches, with a width of the tail/rudder member 48 being approximately 0.93 inches. Each of the wing end stabilizers/weights 50 can have a radius of approximately R.74, and the distance between center points of each wing end stabilizers/weights 50 from one another can be approximately 4.55 inches.

The angle between the wings/vanes 42, 46 of the generally V shape or generally boomerang shaped hydrofoil 40 can range between approximately 10 to approximately 120 degrees. A narrower range can be between approximately 22 to approximately 60 degrees, and a narrower range of a preferred embodiment can range between approximately 35 to approximately 5 degrees.

Both the keel/strut member 80 and the hydrofoil 40 can be formed from hardened plastic, which was injection molded, and can include metal layer imbedded within the plastic. The weight of the keel/strut 80 and hydrofoil 40 can be approximately 1.3 ounces, while the entire weight of the figurine 30, flotation device 20 and keel/strut member 80 with hydrofoil 40 can be approximately 2.2 ounces. As such, the weight of keel/strut member 80 and the hydrofoil 40 can easily counter-balance the lighter weight of the figurine 30 in order to keep the toy 10 in an upright floating position.

The plane of the wings 42, 46 of the hydrofoil to the generally flat bottom surface 26 of the flotation device 20 can be slightly angled so that the bottom surface 26 of the flotation device 20 angles upward toward the front end 22 approximately 6 degrees.

The figurine 30 can be mounted to be approximately perpendicular to the top surface 24 of the flotation device 20. The generally flat top surface 24 of the flotation device 20 can have an angle of approximately 95 degrees relative to the flat wings 42, 46 of the hydrofoil 40.

The dimensions referenced in a preferred embodiment shown and described in relation to FIGS. 5 and 7 are approximate. The term "approximately" can be +/−10% of the dimension numbers referenced for the preferred embodiment. The dimensions come from a preferred embodiment that has been tested in the ocean by the inventor to an effective working embodiment.

While FIGS. 5 and 7 show a preferred embodiment dimensions, the invention can use alternative dimensions when the toy is scaled up or scaled down to different sizes such as small as approximately 3 inches long as desired by the user.

Method of Playing with the Toy

Figure 12:
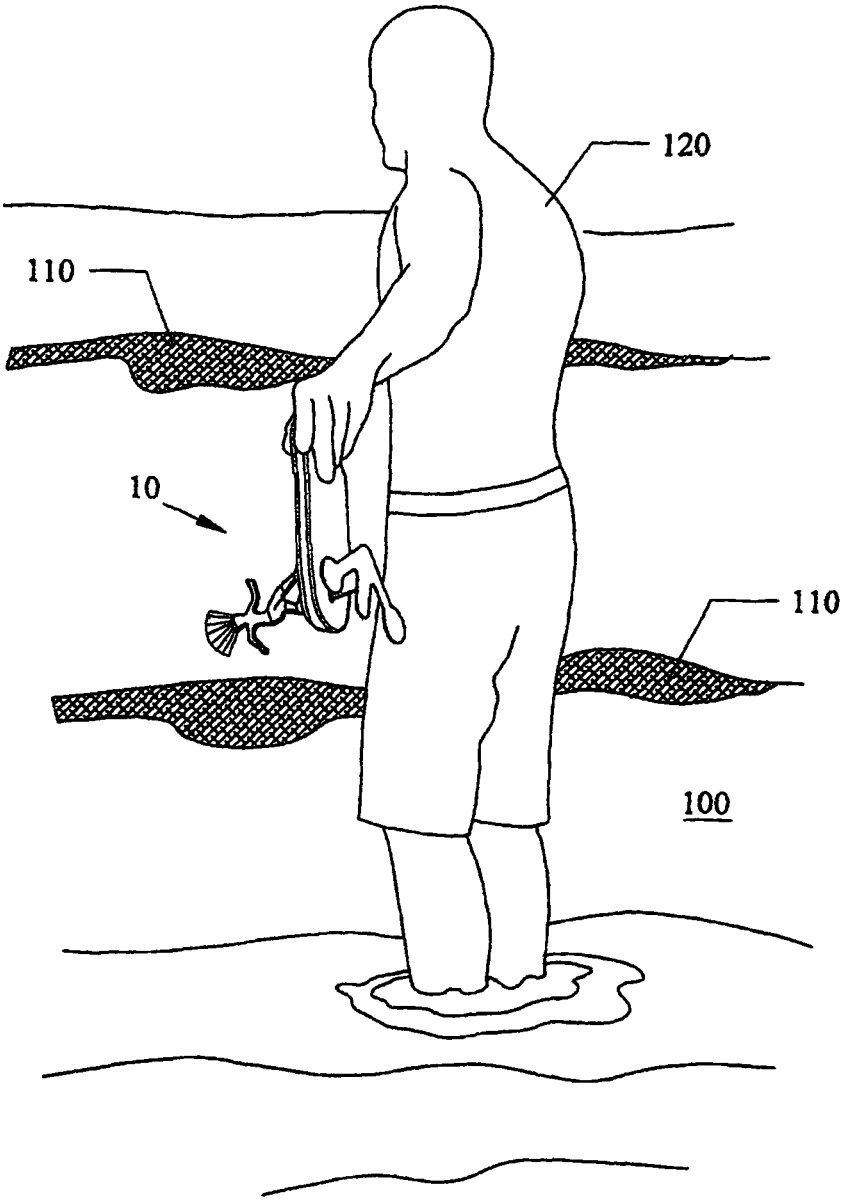
FIG. 12 shows a user on the back-swing of throwing a toy of FIG. 1 into the breaking surf from a shoreline.
Figure 13:
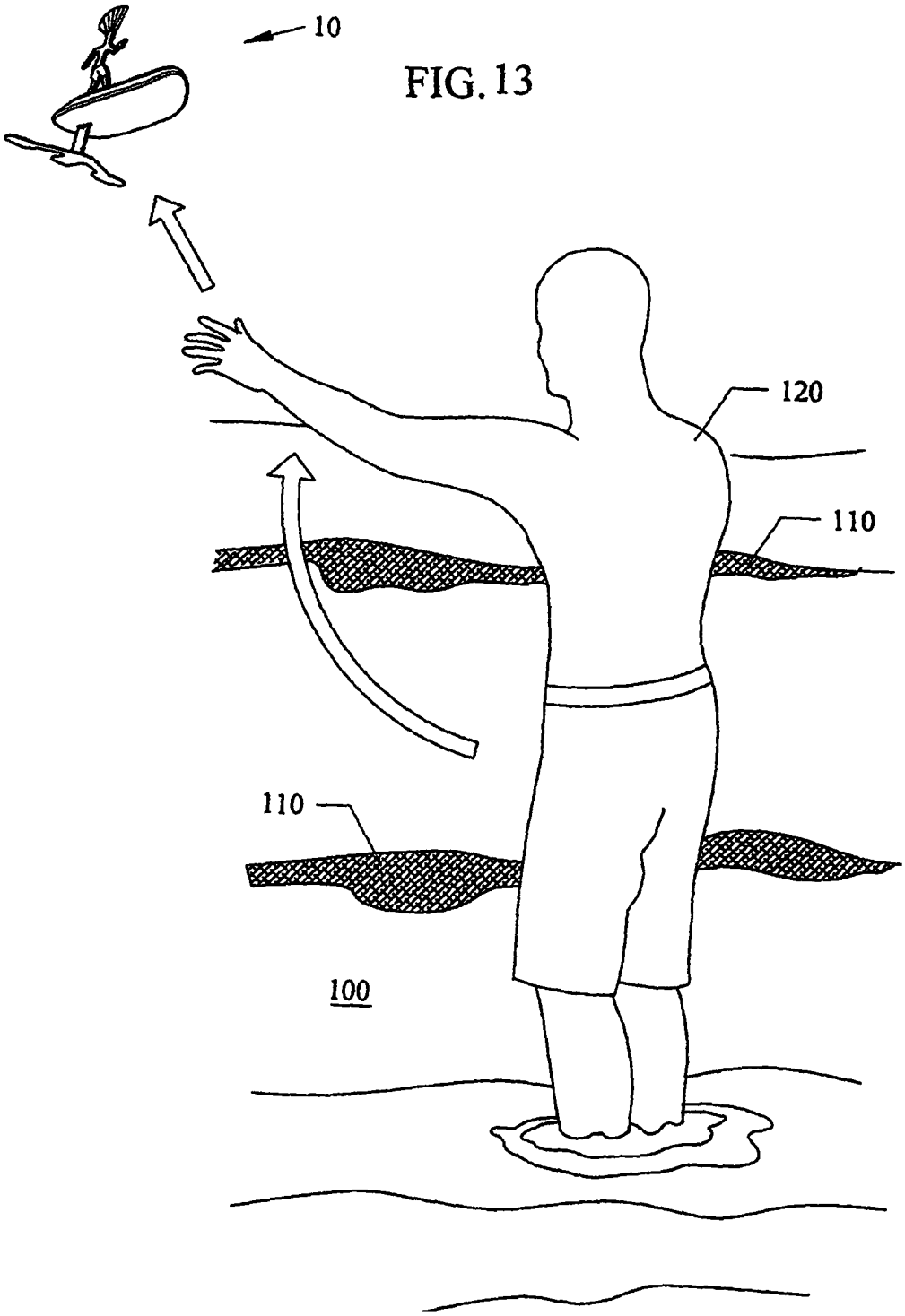
FIG. 13 shows the person in FIG. 12 throwing a toy into the breaking surf.

FIG. 12 shows a user 120 standing adjacent to a shoreline near the shore surf 100 and on the back-swing of throwing a toy 10 of FIG. 1 into the breaking surf 110. FIG. 13 shows the user 120 in FIG. 12 throwing the toy 10 into the breaking surf 110.

Figure 14:
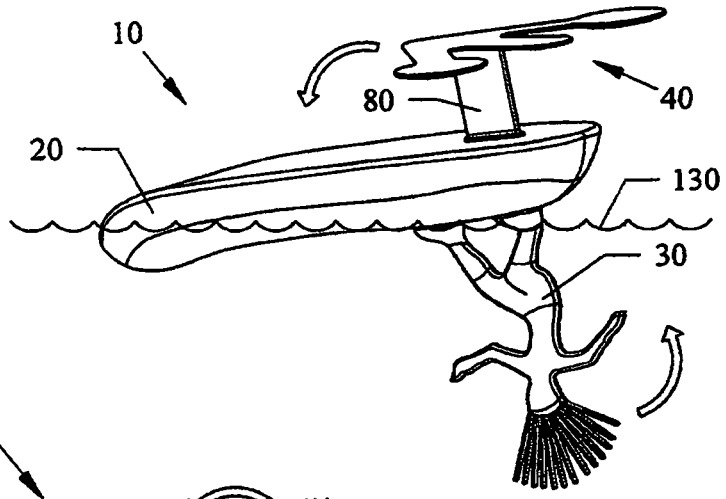
FIG. 14 shows the toy of FIG. 13 just after landing upside-down in the breaking surf.
Figure 15:
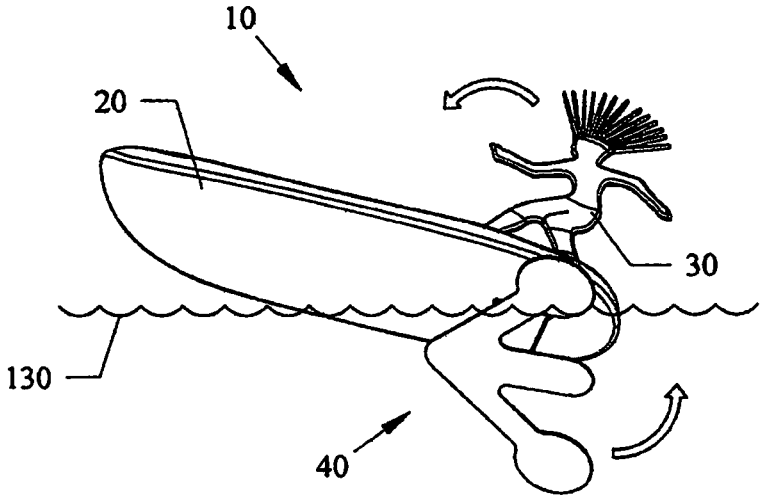
FIG. 15 shows the beginning of the self righting ability of the toy in FIG. 14.
Figure 16:
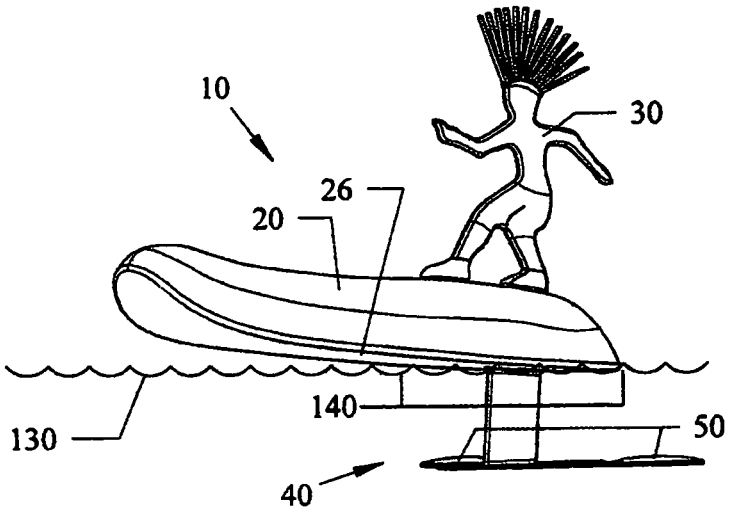
FIG. 16 shows the toy of FIG. 15 fully upright. Flotation zone is noted.

FIG. 14 shows the toy 10 of FIG. 13 just after landing upside-down in the breaking surf and resting on the water line 130. FIG. 15 shows the beginning the self righting ability of the toy 10 in FIG. 14. The weighted keel 80 and hydrofoil 40 will always insure that the toy 10 stays upright. FIG. 16 shows the toy 10 of FIG. 15 fully upright. Flotation zone is noted where a rear portion of the bottom surface 26 of the flotation device 20 can float on the water line 130 with the weighted hydrofoil 40 below the waterline 130.

Figure 17:
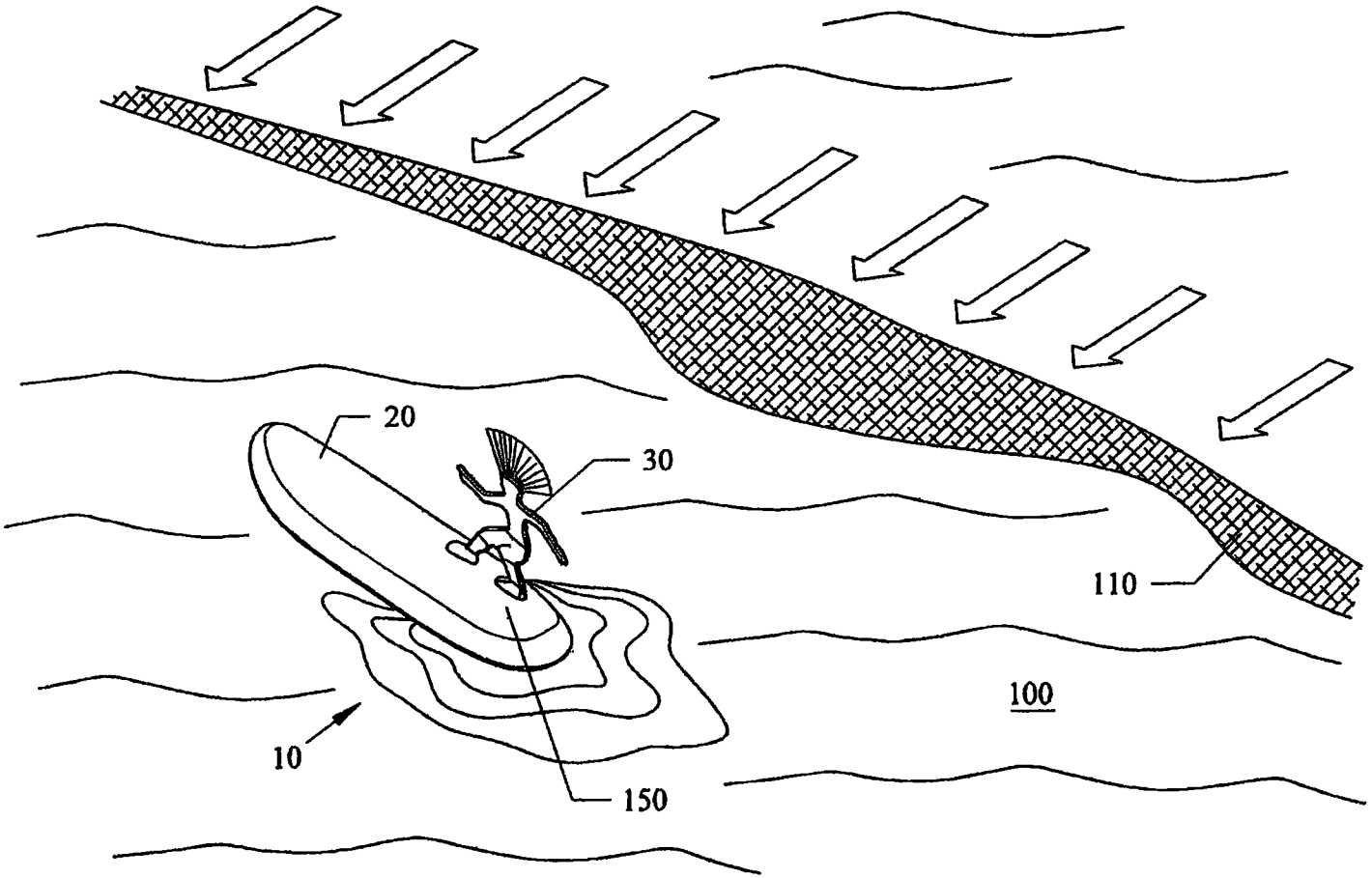
FIG. 17 shows the toy of FIG. 16 floating in the breaking surf with its side to the oncoming waves.

FIG. 17 shows the toy 10 of FIG. 16 floating in the breaking surf 100 with its side to the oncoming waves 110.

Figure 18:
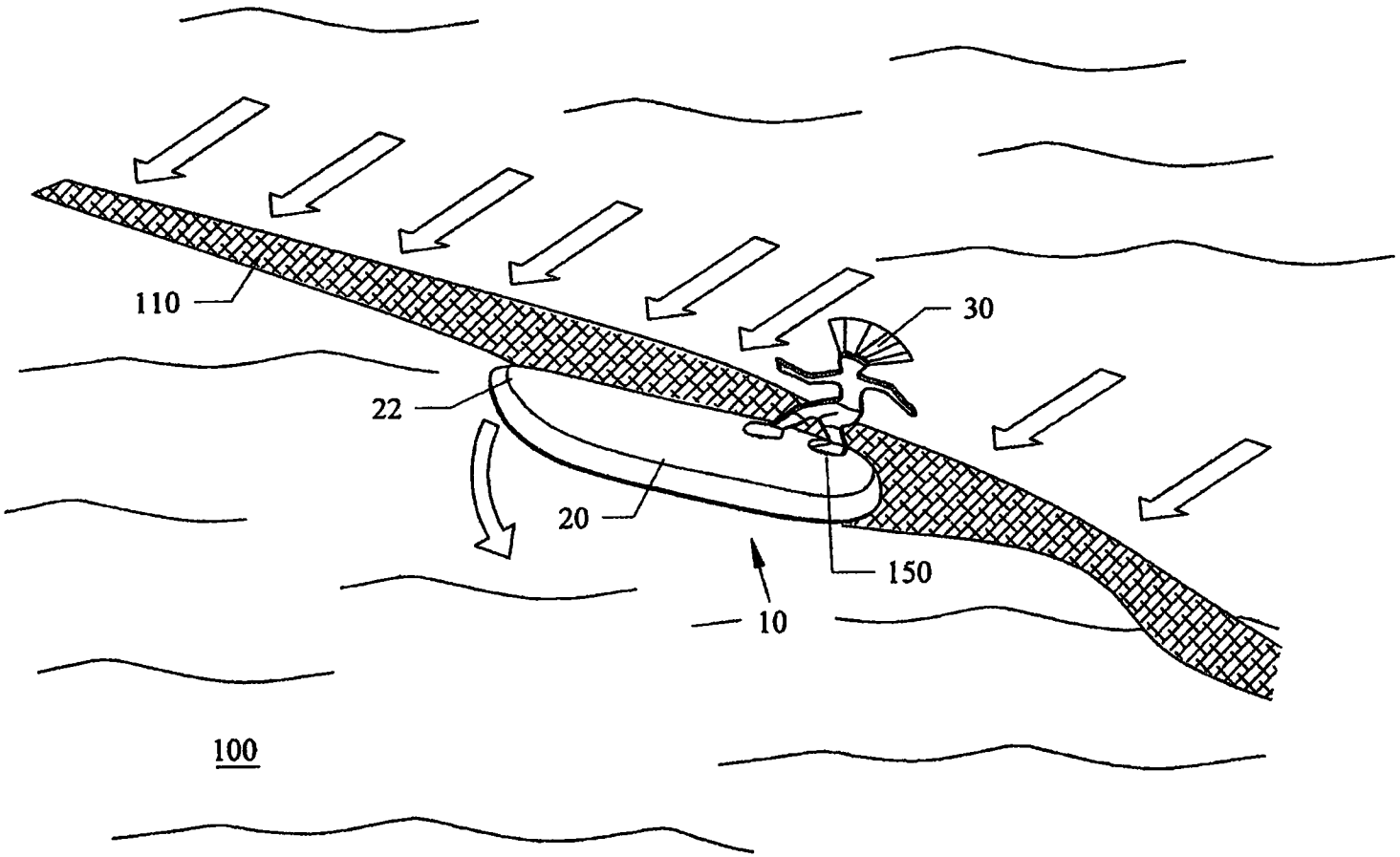
FIG. 18 shows the toy of FIG. 17 just being caught by a breaking wave. The front three quarters of the flotation device float free of the water allowing the assembly to rotate about the flotation zone as the wave exerts its influence. This naturally points the nose of the flotation device in the direction of wave travel.
Figure 19:
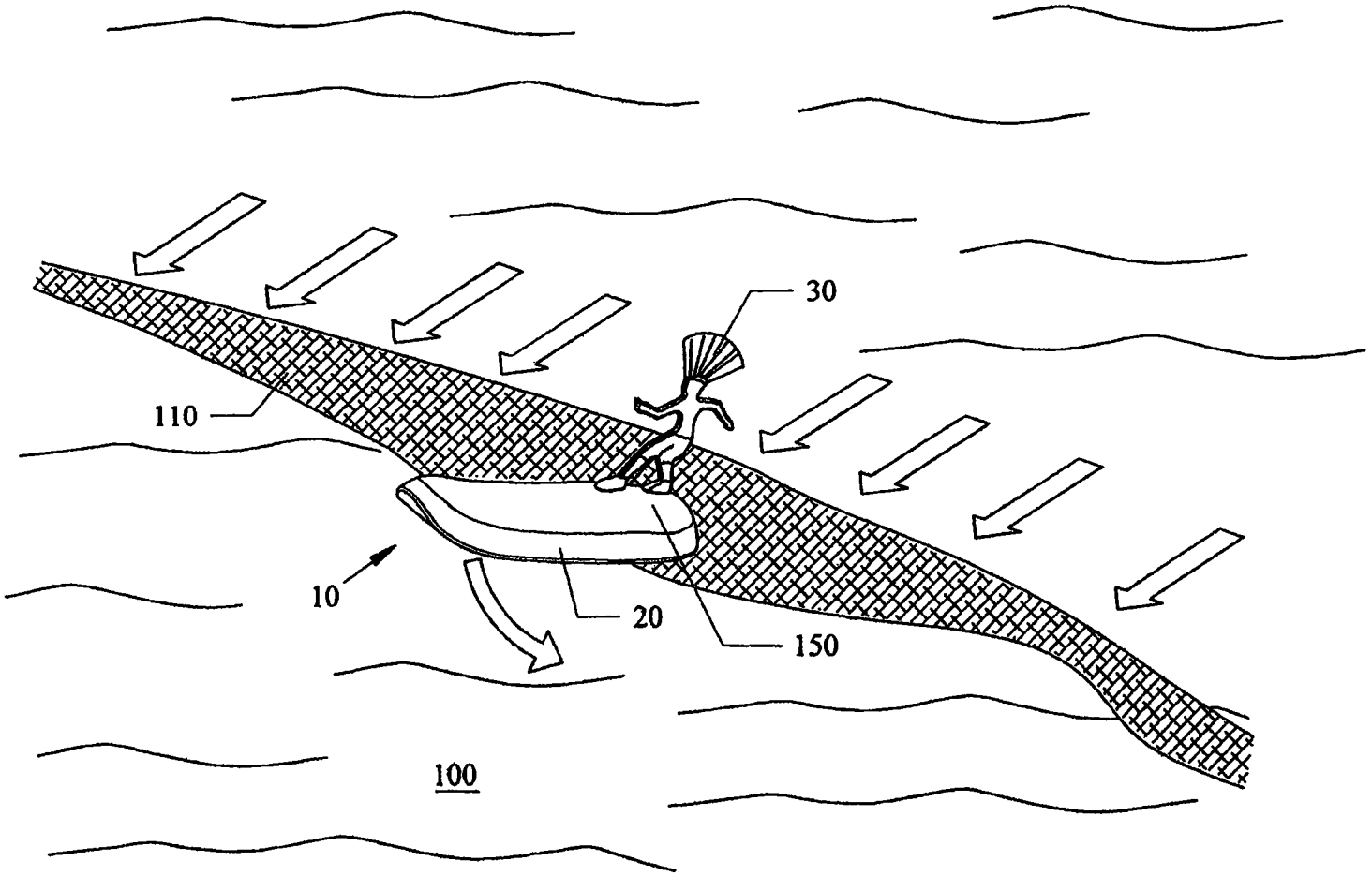
FIG. 19 shows the toy of FIG. 18 continuing to rotate influenced by the breaking wave.

FIG. 18 shows the toy 10 of FIG. 17 just being caught by a breaking wave 110. The front three quarters of the flotation device 20 float free of the water allowing the toy 10 to rotate about the flotation zone 140 as the wave exerts its influence. This naturally points the nose (front end) 22 of the flotation device 20 in the direction of wave travel and pivots at a pivot point 150. FIG. 19 shows the toy 10 of FIG. 18 continuing to rotate influenced by the breaking wave 110.

Figure 20:
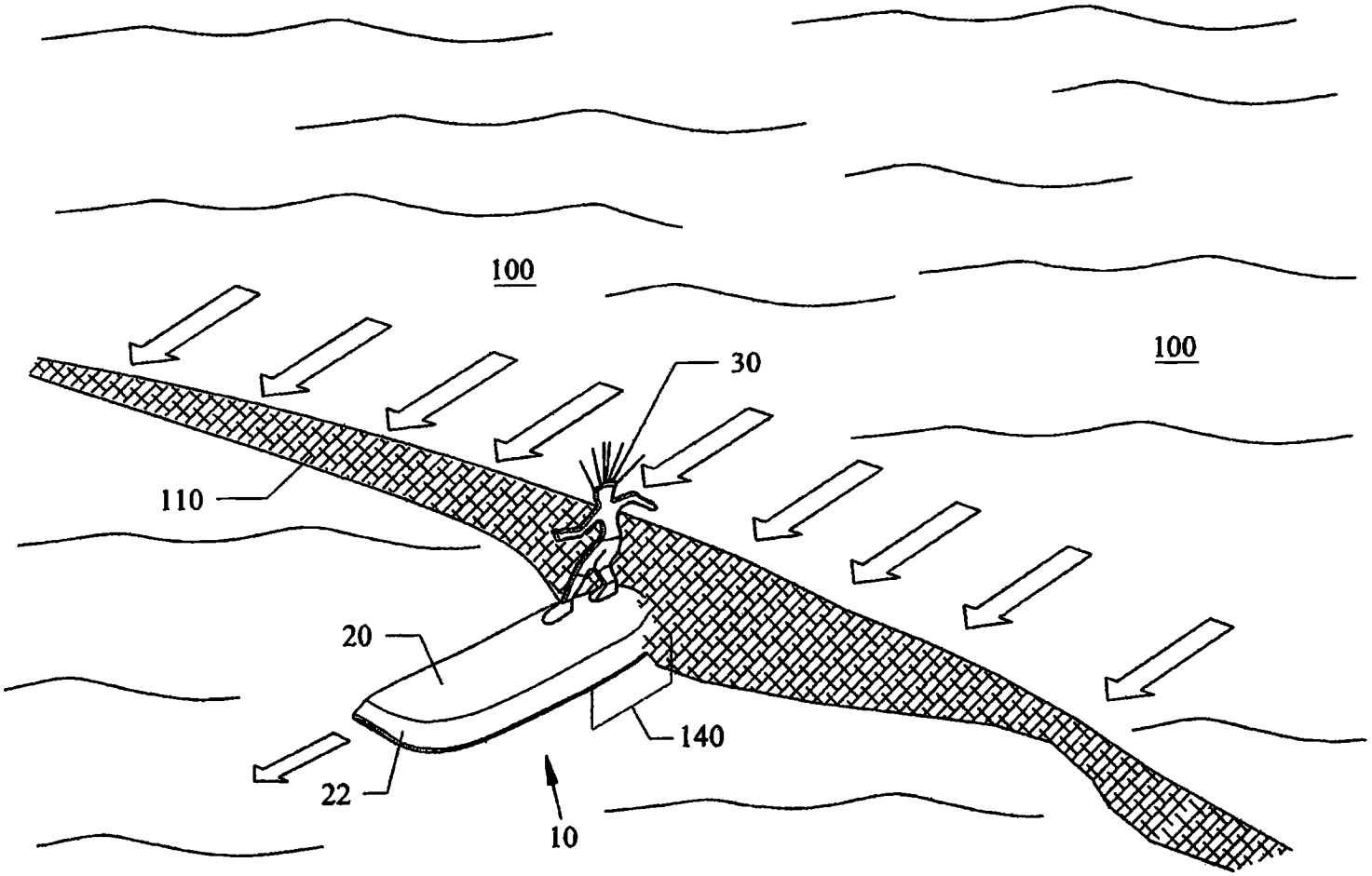
FIG. 20 shows the toy of FIG. 19 has fully oriented itself with its nose in the direction of wave travel and is riding or "surfing" on the breaking wave.

FIG. 20 shows the toy 10 of FIG. 19 has full oriented itself with its nose 22 in the direction of wave travel and is riding or "surfing" on the breaking wave 110.

Figure 21:
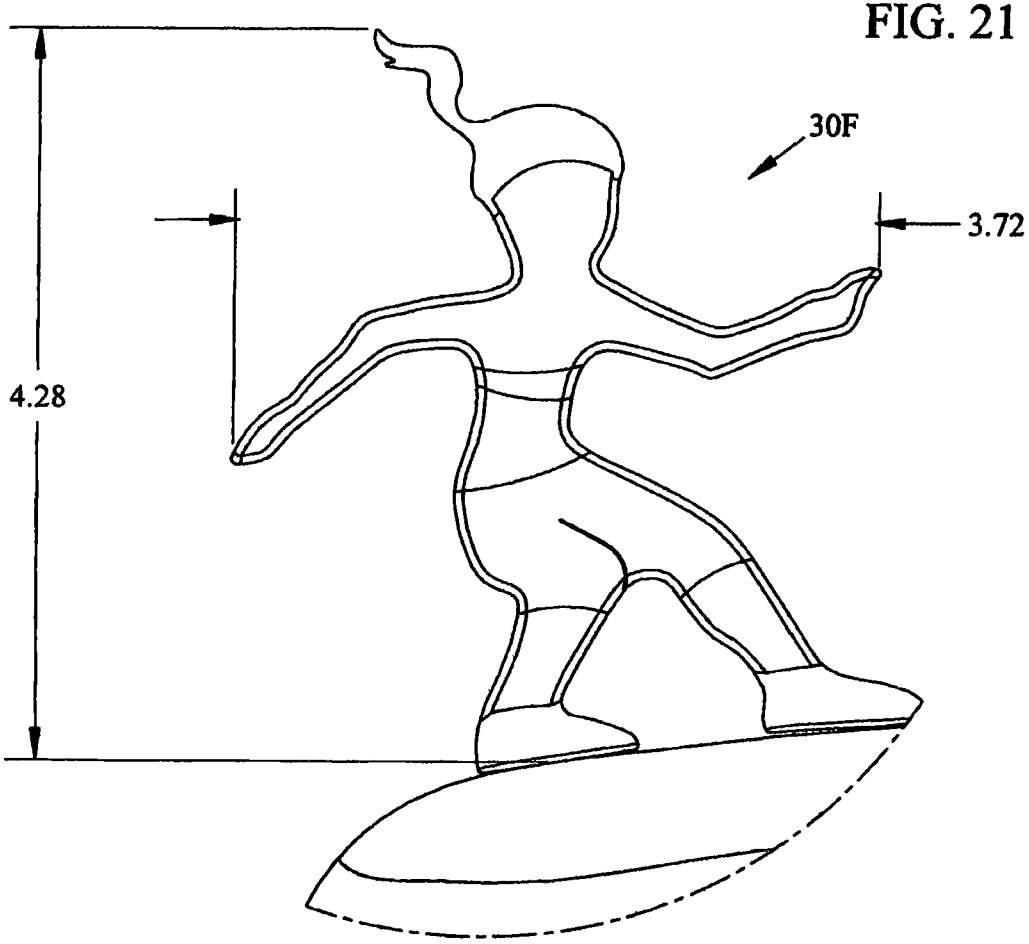
FIG. 21 is an enlarged view of an alternative figurine that can be mounted on the toy of FIG. 1.

FIG. 21 is an enlarged view of an alternative figurine 30F that can be mounted on the toy 10 of FIG. 1. The figurine 30F can have similar dimensions to the previously described figurine 30.

Additional games that can take place with the novel toys 10 can include two or more players tossing or throwing generally identical toys 10 into the surf and determining a winner when the first toy 10 reaches the shoreline.

Second Embodiment

FIG. 22 is an exploded view of another embodiment of the toy 200 with figurine 230, flotation device 205, skeg 240 and main wing 270. FIG. 23 is a side assembled view of the toy 200 with figurine 230, flotation device 205, skeg 240 and main wing 270 of FIG. 22. FIG. 24 is a front view of the assembled toy 200 of FIG. 23. FIG. 25 is a rear view of the assembled toy 200 of FIG. 23. Figurine 230, flotation device 205, skeg 240 and main wing 270 can be formed from similar materials to similar components described in the previous embodiment. For example, figurine 230 can be formed from an injection molded hard plastic, and flotation device 205 can be formed from EVA (ethylene vinyl acetate) foam.

FIG. 26 is a cross-sectional view of the assembled toy 200 of FIG. 23 along arrows 26X. FIG. 27 is a side cross-sectional view of the assembled toy 200 of FIG. 24 along arrows 27X.

FIG. 28 is an enlarged perspective view of the separated figurine 230 of the previous figures. FIG. 29 is a side view of the figurine 230 of FIG. 28. FIG. 30 is a front view of the figurine 230 of FIG. 28. FIG. 31 is a rear view of the figurine 230 of FIG. 28.

Referring to FIGS. 28-31, the figurine 230 can be similar to the figurine 30 of the previous embodiment, with some main differences. Figurine 230 can included rounded hair tip ends 231, which are less sharp and safer than the hair ends in the previous embodiment, and curved hand portions with rounded ends 239 which are also less sharp and safer than those in the previous embodiment.

Figurine 230 can include a downwardly extending front cylindrical male peg 232, with parallel ribs 233 on the front face, and a flat surface 234 under the front foot, and a downwardly extending rear square (or rectangular) male peg 236 with parallel ribs 237 on the front face and a flat surface 238 under rear foot.

FIG. 32 is an enlarged perspective view of the separated flotation device 205 of FIGS. 22-27. FIG. 33 is a top view of the flotation device 205 of FIG. 33. FIG. 34 is a bottom view of the flotation device 205 of FIG. 33.

Referring to FIGS. 23 and 32-34, flotation device 205 can have a top 210 with a front generally beveled tip edge 212, and an upwardly angling tip 213, and a generally flat top surface 214. Tip edge 212 can have a slight beveling instead of being arced in the previous embodiment. Here, the tip edge is more perpendicular to the bottom with a small arc at the top of the tip edge 212. Flotation device 205 can also have a front cylindrical through-hole 215 and a rear square (or rectangular) through-hole 216 both adjacent to a rear end of the flotation device 205. Flotation device 205 can also have a rounded upper rear surface edge 217 and a generally flat rear end 218 with rounded beveled upper side edges 219 on both sides of the flotation device 205.

The bottom 220 can have a flat upwardly angling front surface 222 with a rounded transition surface 223, and a generally flat lower surface 224. Down the middle of the bottom 220 adjacent to rear end of the flotation device 205 can be a longitudinal indentation 226 with an angled front tip indentation 227 and a flat rear indentation 228.

The lower rear surface 224 of the flotation device 205 (also shown in FIG. 23) can have an approximately 9 degree angle that can begin approximately 0.75 inches in from the end 218 of the flotation device 205 sloping up to the end 218 of the flotation device 205.

FIG. 35 is an enlarged perspective view of the separated keel/strut member (skeg) 240 of FIGS. 22-27. FIG. 35A is a bottom view of the skeg 240 of FIG. 35 along arrow 35X. FIG. 36 is a side view of the skeg 240 from FIG. 35 assembled to the separate main wing 270 of FIGS. 22-27.

Referring to FIGS. 22, 23, and 27, main wing 270 can be at a downward 5 degree (+/−2 degrees) angle from flotation device 205 on a perpendicular 90 degree upward angle through skeg 240 and a 35 degree (+/−5 degrees) to the front 212 of flotation device 205.

Referring to FIGS. 35-36, skeg 240 can include an upwardly extending front cylindrical tube 242 with socket, having an upper edge which rests generally flush with (or slightly recessed from) upper (top) surface 210 when assembled. The upper ends of the tubes 242, 246 can be tapered (narrower) to allow for ease in inserting into the through-holes 215, 216 in the flotation device 205. Front tube 242 can have parallel slits/slots 243 in the front face, and an upwardly extending rear square (or rectangular) tube 246 with socket having an upper edge which rests generally flush with (or slightly recessed from) upper (top) surface 210 when assembled. Rear tube 246 can have parallel slits/slots 247 in the front face. The tubes 242, 246 can raise upward from a flat upper ledge surface 244 that has a narrow tip end and a generally flat rear end which can mateably fit into the longitudinal indentation 226 in the flotation device bottom 220.

The strut portion 250 of the skeg 240 can have a front concave curved edge 252 and a rear convex curved edge 256. Strut portion 250 can have an enlarged lower footer 258 with a male connector 260 extending downward therefrom. The male connector 260 can have a front split step 262 which protrudes from a longitudinal split fin portion 264 and longitudinal side rib(s) 266 can face sideways from the longitudinal split fin portion 264.

FIG. 37 is a top view of the separate wing 270 of FIGS. 22-27 and 36. FIG. 38 is a bottom view of the wing 270 of FIG. 37. FIG. 39 is a side view of the wing 270 of FIG. 37 along arrow 39X.

Referring to FIGS. 37-39, main wing 270 can include a front convex edge 272 with a rear extending left wing/vane 274 and an enlarged rounded (weighted) end 275, and a rear right wing/vane 276 with an enlarged rounded (weighted) end 277. The weighted portions can be additional material such as metal, and/or weighted discs that can be imbedded therein, and/or more plastic type material for the added weight which provide ballast for helping maintain the toy in an upright position when used in the ocean as described in the previous embodiment.

Wing 270 can also include a central rear extending tail 280 with a rounded tip end 281. The root end of tail 280 can have concave edges 282 with sculpted indented surfaces 284 located about the concave root end edges 282.

A through-hole mounting slot 286 can be located through a mid-portion of the wing between the left vane 274 and right vane 276, with a front end indentation step 287 in the wing top, and side indentation steps 288 along the sides of the slot 286 in the wing bottom.

A raised footer 285 can have a pedestal type shape with flat bottom and be located under the front of main wing 270 near the apex portion. Footer 285 allows for the assembled toy 200 to be balanced when placed on a flat surface for display purposes.

Table 1 lists preferred dimensions of the flotation device 205, FIG. 230, skeg 240 and main wing 270 used with the toy 200.

TABLE 1

Toy component dimensions

| Component description | Acceptable range | Narrowed range | Preferred dimension |
|---|---|---|---|
| in inches: | | | |
| Flotation device, length | 7.0000-12.0000 | 8.5000-11.5000 | 11.0236 |
| Flotation device, width | 2.1250-3.6429 | 2.5804-3.4911 | 3.3465 |
| Flotation device, depth or thickness (measured at rear, before bevel, or at midpoint of device) | 0.6750-1.1572 | 0.8197-1.1089 | 1.0630 |
| Male figure, height (peg bottom to top of hair) | 3.7306-6.3954 | 4.5301-6.1289 | 5.8750 |
| Male figure, width (front hand to back hand) | 2.5400-4.3543 | 3.0843-4.1729 | 4.0000 |
| Male figure, thickness (rear foot puddle) | 0.3572-0.6123 | 0.4337-0.5868 | 0.5625 |
| Male figure, thickness (torso) | 0.0794-0.1361 | 0.0964-0.1304 | 0.1250 |
| Skeg, height (front to back) | 1.7463-2.9936 | 2.1205-2.8688 | 2.7500 |
| Skeg, width (top to bottom) | 1.8256-3.1296 | 2.2168-2.9992 | 2.8750 |
| Skeg, depth (side to side) | 0.3572-0.6123 | 0.4337-0.5868 | 0.5625 |
| Wing, length (side to side) | 3.8100-6.5314 | 4.6264-6.2593 | 6.0000 |
| Wing, width (front to back) | 1.9050-3.2657 | 2.3132-3.1296 | 3.0000 |
| Wing, depth (weighted sides or vanes) | 0.1588-0.2721 | 0.1928-0.2608 | 0.2500 |
| Wing, depth (including bottom souvenir bump) | 0.2381-0.4082 | 0.2892-0.3912 | 0.3750 |
| in millimeters: | | | |
| Flotation device, length | 178-305 | 216-292 | 280 |
| Flotation device, width | 54-93 | 66-89 | 85 |
| Flotation device, depth or thickness (measured at rear, before bevel, or at midpoint of device) | 17-29 | 21-28 | 27 |
| Male figure, height | 95-162 | 115-156 | 149 |

TABLE 1-continued

| Toy component dimensions | | | |
|---|---|---|---|
| Component description | Acceptable range | Narrowed range | Preferred dimension |
| (peg bottom to top of hair) | | | |
| Male figure, width (front hand to back hand) | 65-111 | 78-106 | 102 |
| Male figure, thickness (rear foot puddle) | 9-16 | 11-15 | 14 |
| Male figure, thickness (torso) | 2-3 | 2-3 | 3 |
| Skeg, height (front to back) | 44-76 | 54-73 | 70 |
| Skeg, width (top to bottom) | 46-79 | 56-76 | 73 |
| Skeg, depth (side to side) | 9-16 | 11-15 | 14 |
| Wing, length (side to side) | 97-166 | 118-159 | 152 |
| Wing, width (front to back) | 48-83 | 59-79 | 76 |
| Wing, depth (weighted sides or vanes) | 4-7 | 5-7 | 6 |
| Wing, depth (including bottom souvenir bump) | 6-10 | 7-10 | 10 |

Table 2 lists preferred weights of the flotation device 205, FIG. 230, skeg 240 and main wing 270 used with the toy 200.

TABLE 2

| Toy component weights | | | |
|---|---|---|---|
| Component description | Acceptable range | Narrowed range | Preferred dimension |
| in ounces: | | | |
| Flotation device only | 0.7-1.3 | 0.8-1.2 | 1.1 |
| Male figure | 0.4-0.8 | 0.5-0.7 | 0.7 |
| Skeg | 0.3-0.5 | 0.3-0.5 | 0.4 |
| Wing, including stability weights | 1.2-2.2 | 1.5-2.1 | 1.9 |
| Wing, excluding stability weights | 0.8-1.5 | 1.0-1.4 | 1.3 |
| Male figure | 0.4-0.8 | 0.5-0.7 | 0.7 |
| All toy components combined | 2.6-4.8 | 3.1-4.5 | 4.1 |
| in grams: | | | |
| Flotation device only | 19.2-36.3 | 23.4-34.8 | 30.3 |
| Male figure | 12.4-21.2 | 15.0-20.3 | 19.5 |
| Skeg | 7.9-14.3 | 9.6-13.7 | 12.5 |
| Wing, including stability weights | 33.7-60.6 | 40.9-58.1 | 53.0 |
| Wing, excluding stability weights | 22.9-41.1 | 27.8-39.4 | 36.0 |
| All toy components combined | 73.2-132.4 | 88.9-126.9 | 115.3 |

The assembly of the toy 200 will now be described with the figurine 230 mounted to the top 210 of the flotation device 205, and the skeg mounted to the bottom 220 of the flotation device 205, with the main wing 270 mounted to the bottom of the skeg 240 as shown by the arrows in FIG. 22.

Referring to FIGS. 22-36, the upwardly extending cylindrical tube 242 and square (or rectangular) tube 246 of skeg 240 can be pushed into the cylindrical through-hole 215 and square (or rectangular) through-hole 216 in the bottom 220 of the flotation device 205 until the flat ledge 244 rests against the flat bottom 224 recessed therein within indentation 226. The locations of the square hole 216 and cylindrical hole 215 force the assembler to only use the correct holes 215, 216 when assembling the skeg 240 to the flotation device 205.

Next, the assembler can mount the wing 270 to the bottom of the skeg 240 in reference to FIGS. 22-39. The assembler can place the flotation device 205 and skeg 240 upside down on a surface. The top surface of wing 270 can be positioned such that the front end indentation step 287 is placed over front split step 262 and longitudinal split fin portion 264 is aligned into the rest of through-hole slot 286. The outer facing edges of the longitudinal split fin portion 264 can be tapered to more easily fit into the slot 286.

Next the assembler can push the wing 270 so that the slip fin portion 264 passes into the slot 286 which causes the split fin portion to be pinched together. The assembler can push until the longitudinal side facing ribs 266 of split fin portion 264 snap about side indentation steps 288 locking the wing 270 in place. Similarly, the split step can also pinch together and rest against step 287.

Next the lower extending cylindrical peg 232 and square (or rectangular) peg 236 of the figurine 230 are passed into the top 210 of the flotation device 205, and their locations also force the assembler to use the proper through-holes 215, 216 for assembly. The raised ribs 233, 237 in the respective pegs 232, 236 can snap into mateable slits/slots 243, 247 in the respective tubes 242, 246, which lock the figurine 230 to the top 210 of the flotation device 205, and the skeg 240 to the bottom 220 of the flotation device 205.

The novel invention shown and described in the second embodiment allows for many additional benefits.

If the toy were stepped upon after it is assembled, the connection of skeg 240 and wing 270 would snap apart and not fracture, yet the figurine with flotation device and skeg and wing is still strong enough to ensure that the wing (or hydrofoil) will not become unattached in normal play in surf and waves.

In addition, the novel toy can only be assembled in one orientation, ensuring that the consumer assembles the toy in the correct orientation.

The redesign of the connecting mechanism results in the skeg having a rear square channel and a round front channel, which match a new rear square and front round peg in the figure. In addition, the flotation device can have two holes, one square at the rear, and one round toward the front, to match the design of both the skeg and the figurine.

This redesign ensures that the toy is assembled properly such that the figure and the skeg are logically inserted into the flotation device and their connection in only one orientation. In addition, the square peg of the figure cannot physically be inserted into the round hole of the receptor channel of the skeg.

The second embodiment can include a new downward pointing "split arrowhead" connector between the skeg and the wing or hydrofoil.

The first embodiment combined the "strut" (now called a skeg) and wing, or hydrofoil, into a single piece. This would have allowed the single piece construction, which consisted of two perpendicular planar surfaces, to potentially fracture if the toy were stepped on, which fractured piece could have resulted in a sharp edge.

The second embodiment splits these planar surfaces into two separate pieces and introduces a new "breakaway" split arrowhead (which is a split construction such that the space between the two sides of the "split arrowhead" condenses during insertion into the wing (or hydrofoil), then, once inserted, pops back open to secure the connection that is designed to "breakaway" if the toy were stepped upon, which connection is still strong enough to ensure that the wing (or hydrofoil) will not become unattached in normal play in surf and waves.

In addition, the second embodiment can only be assembled in one orientation, ensuring that the consumer assembles the toy in the correct orientation.

The wing, or hydrofoil, was previously a flat, planar surface. The second embodiment smoothes the prior sharp angles and surfaces of the wing and thickens the wing/vanes of the first embodiment.

The revisions to shape and thickness, especially the "sculpting" of the wing in the second embodiment, promotes much better and more consistent performance, catching random turbulence in the currents of waves which produces more "yawing" motion, which "yawing" motion is corrected by the new unitized design, causing more tricks to be performed during each play session, while more consistently keeping the toy in its natural upright position on top of the surf and wave, perfecting the self-righting capability of the toy in surf.

The second embodiment can include weighted members, such as but not limited to two weighted disks that can be inserted into the wing, or hydrofoil, during its injection molding manufacturing process that precisely weight and balance, or stabilize, the wing and toy.

Additional tests during the further design and prototyping of the second embodiment toy revealed that precise weighting added to each wing vane, which weights are stainless steel or chrome-plated (to discourage rusting in water use) and inserted during the manufacturing (injection molding) process would result in much better and more consistent performance, including more consistent righting of the toy on any inversion in the surf, helping to ensure the toy inverts to its natural upright position to resume its play session.

In addition, the rear weighting of the toy, combined with the increased upward angle of the nose of the flotation device and overall heavier weight of the toy, avoids the previous embodiment's tendency to "pearl" or submerge its nose as it acquired a wave.

In the second embodiment the weight of the wing was increased by over 75% from the previous embodiment 1.3 ounces (for the combined strut/keel and hydrofoil) to a combined weight for the skeg and wing (hydrofoil) of approximately 2.3 ounces.

The increased weight, and precise stabilization through the ballast weighting system, promotes the optimum combination of trick performance while surfing and ensuring the toy returns to its natural upright position whenever surf conditions invert the toy during a play session.

The second embodiment adds a bump to the front bottom of the wing such that the toy, when displayed after a play session in one's home or office, will sit upright.

The increased back weighting of the toy and increased angles promote better performance and required the addition of a "souvenir bump" at the front edge of the wing to ensure the toy would sit upright when displayed on a dresser or credenza in a home bedroom or at an office after use on the beach.

Although the embodiment shows tubes with sockets extending upward from the skeg and male pegs extending downward from the figurine, the components can be reversed such that the tubes can extend downward from the figurine, and male pegs can extend upward from the skeg.

Although the embodiment shows a cylindrical hole in front and square (or rectangular) hole toward the rear, the locations of the respective geometrical shaped holes, can be reversed. Additionally, other shapes, such as but not limited to other geometrical shapes, such as but not limited to triangle shapes, hexagon, shapes, and the like can be used. Additionally less than or more than two side slits/slots, can be used, and different types of snaps can be used such as but not limited to raised protrusion locking into a small cylindrical hole, and the like.

Third Embodiment Upwardly Protruding Object(S)

FIG. 40 is a right perspective view of the toy 300 with hydrofoil 240, 270, and mounted figurine 304 and animal 306. Component labeled 304, can be an upwardly protruding object, such as but not limited to figurines, statutes, cartoon characters, animals, and the like.

Component 306, can be any type of object or animal, such as but not limited to dogs, cats, lions, tigers, elephants, monkeys, birds, fish, horses, and the like. While FIG. 40 shows a figurine 304 holding a dog 306 on a leash, the invention can use different types of upwardly protruding objects and/or different types of animals, and the like. Similar to the previous embodiments the upwardly protruding object(s) 304, 306 can be lighter in weight than the hydrofoil 240, 270.

Fourth Embodiment Upwardly Protruding Object(S)

FIG. 41 is a right perspective view of the toy 310 with hydrofoil 240, 270 with a mounted vehicle 312 as the upwardly protruding object. Here the upwardly protruding vehicle can include but is not limited to different types of vehicles, such as but not limited to an automobile, van, truck, bus, any other type of toy, and the like. Similar to the previous embodiments the upwardly protruding object 312 can be lighter in weight than the hydrofoil 240, 270.

Fifth Embodiment Upwardly Protruding Object(S)

FIG. 42 is a right perspective view of the toy 320 with hydrofoil 240, 270 and mounted upwardly protruding object 322 that can include a sail, wind sail, and the like.

Referring to FIG. 42, an additional illustration 324 printed/painted/drawn/colored, and the like, separate from or added directly on the sail/wind sail 322 can include but is not limited to figurine, statute, cartoon character, figures, animals as referenced above, vehicles as referenced above, and any other illustration and the like. Similar to the previous embodiments, the upwardly protruding object(s) 322, 324, can be lighter in weight than the hydrofoil 240, 270.

Sixth Embodiment Locations of Weights

While the previous embodiments have shown the use of extra weights or thickened portions (which can create extra weight) on the outer wing vanes (FIGS. 1-11), the invention can alternatively be used with extra weights or thickened portions (that have extra weights by their material) on different locations of the hydrofoil (skeg 240 and main wing 270).

FIG. 43 is a bottom view of an embodiment 340 of the main wing 270 of the hydrofoil with dotted lines 277W indicating locations of extra weight(s) in the enlarged rounded vanes 277 which can have flattened bottom end surface portions 278.

FIG. 44 is another bottom view of another version 350 of the main wing 270 of FIG. 43 with the weights 277W removed from the outer vanes 277 of the main wing 270. Similar to the previous embodiments, the hydrofoil would have a greater weight (and further greater weight can be added by thickening the main wing or its vanes) than the upwardly protruding object(s) on top of the flotation device.

FIG. 45 is another bottom view of the hydrofoil with main wing 360 of FIG. 44 with weight(s)(either extra weights or thickened portions) 362 in dotted lines on the rear tine (tail) 280 of the main wing 270.

FIG. 46 is another bottom view of the hydrofoil with main wing 370 of FIG. 44 with weight(s) 368 (either extra weight(s) or thickened portions) centered toward the front convex end 272 of the main wing 270.

FIG. 47 is a side perspective view of the hydrofoil skeg 370 used to attach the main wing of the hydrofoil to the flotation device with weight(s) 372 (extra weight(s) or thickened portion(s)) on the skeg 250.

FIG. 48 is an assembled view of the toy 380 showing weights (277W, 362, 368, 372) at different possible combinations of locations on the skeg 240 and main wing 270.

Although some weights are shown, the invention can be used with any combination of weights at different locations, so that the hydrofoil has a greater overall weight than any upwardly protruding object on the top of the flotation device 205.

FIG. 49A is a bottom view of the main wing 270 of the hydrofoil 390 showing the internal location of torpedo shaped weights 392, 394.

FIG. 49B is another bottom view of the main wing 270 of FIG. 49A showing the weights 392, 394 molded (393, 395) into the left wing vane 274 and right wing vane 276.

Similar to the previous embodiments, the weights, here can be extra weight material or thickened portions of material forming extra weight at these locations. Similar to the previous embodiments, the invention allows for the hydrofoil to have a greater weight than any upwardly protruding objects on the flotation device 205.

Seventh Embodiment Bendable Wing Vanes

FIG. 50 is a top view of a hydrofoil main wing embodiment 400 with left wing vane 274 and right wing vane 276 having portions 404, 405, 406, 407, and 408 flexible to bend up and down along arrows B. Here, the user can bend the wing vanes 274, 276 or rear vane 280 to selected bent positions created by the user, before using the toy.

The bend lines 404-408 can allow different bent positions of the vanes, so that the toy will ride higher or lower in the water, and/or turn to the right or to the left while riding in the water, and the like, during play or use.

The bend lines 404, 405, 406, 407, 408 can be formed from material that has a memory that when bent stays in the bent position. Alternatively, the bend lines 404-408 can include internal metal type material molded into the wing vanes 274, 276, 280 that allows for the bended positions to be maintained.

Eighth Embodiment Interchangeable Upwardly Protruding Objects

FIGS. 51A, 51B and 51C show the toy 420 with attachable and detachable figurines 230, 430, such as but not limited to male figurine 230, female figurine 430, and any other types of upwardly protruding objects as described in the above embodiments that can be removed and replaced interchangeably by the user.

Components 215, 216, 232, 233, 234, 236, 237, 238, 240, 270 can be attached and detachable as previously described. The ribs (detents) 233, 237 can allow for the user to easily snap on the downwardly protruding pegs 232, 236 can easily snap into mateable side indented portions (as shown and described in relation to FIG. 27) inside the through-holes 215, 216 on top of the flotation device 205.

Although the upwardly protruding objects in FIGS. 51A-51C show male and female figurines, any type of upwardly protruding objects that were previously shown and described in relation to at least FIGS. 40-42 can be interchanged, as well as other types of upwardly protruding objects and the like.

Ninth Embodiment Interlocking Fasteners

FIG. 52 is a cross-sectional view of the toy 500 with downwardly extending fastener peg 514 from the upwardly protruding object 510F (which as shown can include but is not limited to a female figurine, and the like) in combination with fastener peg 524 extending upward from the skeg 520.

FIG. 52A is a top view of the removable main wing 530 that can twist onto the bottom of the skeg 520 shown in FIG. 52.

FIG. 53 is an exploded view of another version using another upwardly protruding object 510M (which as shown can include but is not limited to a male figurine, and the like) and upper skeg plate 522 with rear through-hole 521 an upwardly extending front peg 524 with upper hook end 525 of FIG. 52, with slide on main wing 560.

Referring to FIGS. 52 and 53, the upwardly protruding object 510F/510M can be moved downward so that downwardly extending rear foot peg 513 passes through a first through-hole 504 in flotation device 505 until the flat bottom of rear foot 512 abuts against the top 507 of the flotation device, and the flat bottom of front foot 519 abuts against the top of the flotation device 505 above second through-hole 506.

The upper plate 522 on the skeg 522 with the upwardly protruding peg 524 passing into second flotation device through-hole 506 with upper hook end 525 snapping into the mateable hook shaped slot 519 in the bottom of the front foot 518 of the upwardly protruding object 510F, 510M. The enlarged fastener head 516 with stem can snap into the through-hole 521 on the upper plate 522, where the upper plate 522 can fit into a pocket shaped indentation 503 in the bottom 502 of the flotation device 505.

A first version of attaching the main wing 530 to the skeg 520 is shown in FIGS. 52 and 52A. A bottom end 528 of the skeg 520 can be separated from the rest of the skeg 520 by a narrow stem 526. As shown in previous embodiments, such as but not limited to FIGS. 24-26, the skeg 520 can have a narrow thickness between a right side and left side. The user can position the key-hole slot 532 with narrow outer end slots 533 as depicted in FIG. 52A to be positioned and raised over bottom end 528 of skeg 520. Next the user can twist the main wing 530 approximately 90 degrees in a clockwise (or counterclockwise, not illustrated) direction until downwardly facing protrusions 527 lock into indentation slots 535 on an upper surface of the main wing 530. Main wing 530 can be removed by twisting the main wing 530 in an opposite direction and pulling the main wing 530 away from skeg 520.

A second version of attaching a main wing 560 to the skeg 540 is shown in FIG. 53. The skeg 540 can have a similar upper fastening part as the skeg 520 in FIG. 42. The bottom of the skeg 540 can have an enlarged rectangular bottom portion 542 which can slide into a rectangular indentation 564 of the main wing 560. Opposite facing side edges of the rectangular bottom portion 542 can slide within side track-channels 565 in the indented portion 564 until front and side facing teeth type protrusions can snap and lock into front and side edge slots 567 in indentation 564. The main wing 560 can be removed by moving the main wing 560 in an opposite direction relative to the enlarged bottom plate 542.

While the figures show pegs downwardly extending from rear portions of the upwardly protruding objects, the pegs can be reversed with the downwardly extending pegs from the front portion (front foot) of the upwardly protruding objects. Similar the upwardly protruding pegs from the front top portions of the skegs can be located on rear top portions of the skegs.

While the outer ends of the pegs have hooks and enlarged heads, the outer ends can have other shapes that can snapably lock into slots and openings.

Tenth Embodiment

FIG. 54 is an exploded view of another attachment embodiment 570 of attaching an upwardly protruding object 571 (which is shown as a male figurine, but can include any other type of upwardly protruding object as previously shown and described), flotation device 505 and main wing 580 by a skeg 590 having upwardly protruding fasteners 592, 594.

The slide on skeg 590 can include rear upwardly protruding peg 592 and front upwardly protruding peg 594 which extend upward from a skeg middle section 596. Pegs 592 and 594 can pass through rear and front narrow through-holes 583, 587 in the main wing 580, followed by skeg middle section 596 passing through central rectangular through-hole 585 until the enlarged flat bottom plate 598 of the skeg snaps and can snap lock into mateable pocket shaped indentation 584 in the bottom surface of main wing 580.

Upper hook ends 593, 595 of pegs 592, 594 can pass through the through-holes 504, 506 of the flotation device until the flat upper end 597 of the skeg middle section 596 abuts against the bottom surface 502 of flotation device 505. The upper hook ends 593, 595 can snap and lock into the mateable hook shaped slots 573, 575 in the bottom of flat bottomed rear foot 572, and front foot 574. The assembled toy can be dissembled in reverse order of the assembly steps.

While FIG. 54 shows two pegs extending upward from the skeg, the invention can be used with one peg extending upward from the skeg. The peg can have a non-circular cross-sectional shape to fit through a similar shaped through-hole in the main wing and through-hole in the flotation device to keep the parts in alignment. Additionally, the top of the single peg can have fastener shape that can allow the upwardly protruding object such as the figurine to rotate thereon.

Eleventh Embodiment Rotatable Sail and Windsurfing Sail

FIG. 55A a perspective view of the toy embodiment 600 with rotatable sail and windsurfing sail 610 on the flotation device. FIG. 55B is a top view of the toy 600 of FIG. 55A with sail rotated to the left side. FIG. 55C is a top view of the toy 600 of FIG. 55A with sail rotated to the right side.

Referring to FIGS. 55A-55C, the toy 600 can include a main wing 650 mounted to a skeg 640 in similar attachment techniques to any of the embodiments previously described. The upper enlarged plate 644 can fit into a pocket shaped indentation 633 on the bottom surface 635 of the flotation device 630.

A peg 646 upwardly extending from the enlarged plate 644 on the skeg 640 can pass through a through-hole 631 in the flotation device 630 which can allow the peg to rotate thereon.

The fastener head 648 on top of the peg 646 can be a hook that loosely hooks into a slot 625 in the bottom of the front foot 622 of a figurine 620 holding a handle 622. The rear foot 626 can be unattached and slightly spaced from the upper surface 632 of the flotation device 630. This configuration can allow the sail 610 and figurine 620 to be able to rotate to the left and to the right relative to the toy 630 as shown in FIGS. 55B and 55C.

While the embodiment 600 shows a peg extending upward from the skeg into a slot in the bottom of the front foot of the figurine, the single peg can extend downward from one of the feet of the figurine.

Additionally, the invention can work with only a sail and a single peg extending downward from a mast portion of the sail, or a peg extending from the skeg to a mast portion of the sail.

Additionally, this embodiment can work with only a sail or wind sail with a picture of a figurine or character on the sail or windsurfing sail. Still furthermore, this embodiment can work with only a sail or windsurfing sail rotatably attached to the toy.

The sail and windsurfing sail embodiments can allow the toys to be used in other water applications, such as but not limited to swimming pools, lakes, rivers, including play in conjunction with white water rafting, and the like.

Twelfth Embodiment Toy with No Upwardly Protruding Objects

FIG. 56 is a side perspective view of the toy 700 with flotation device 720, skeg and main wing 740 without any upwardly protruding objects (such as figurines, animals, vehicles, sails, and the like). The flotation device 720, skeg 730 and main wing 740 can attach to one another as shown and described in any of the previous embodiments.

Thirteenth Embodiment Towable Toy

FIG. 57 shows the toy 810 of the preceding figures being tethered to be pulled by a motorboat 830. The toy 810 can be any of the previous embodiments shown and described. Here, a tow line 820 can attach to a fastener slot 815 on a front portion of the toy 810 so that a motorboat can tow the toy through the water.

Fourteenth Embodiment Fishing Toy

FIG. 58 shows the toy 810 of any of the preceding figures to be tethered by fishing lines 820 to fishing poles or rods 847 being held by persons securing the return of the toy or by fishermen 845. The toy(s) 810 also can be used as floats or bobbers to support fishing hooks in which instance(s), the size of the toy can be reduced to as little as one inch or very similar to the size of a decorative key chain ornament or fob.

The toy(s) can include LED (light emitting diodes) lights or be decorated in a manner that would allow the toy(s) to glow in the dark, such that they also could be used for nighttime activity. A battery or solar rechargeable battery can be used. Also, a glow in the dark paint or coating can be used as well.

The toy(s) can also be used for digging and creating sand sculptures on a beach by use of its wing or upwardly protruding object(s) as digging devices and its flotation device as a smoothing device in sculpting.

The toys, with or without their skeg and main wing, and with or without the upwardly protruding objects can also be attached to pool cleaners so that the moving pool cleaner pulls the toy on the pool surface.

Fifteenth Embodiment Interchangeable Figurines and Easy to Assemble and Disassemble Toy FIG. 59 is an exploded perspective view of a surfing toy 900 with attachable and detachable interchangeable figurines 901, 907 and hydrofoil 930 of a skeg 940 and main wing/vanes 950.

FIG. 60 is an assembled perspective view of the surfing toy 900 with attached figurines 901, 907 and hydrofoil 930 having a skeg 940 and wing/vanes 950.

FIG. 61 is a cross-sectional view of the assembled surfing toy 900 of FIG. 60. FIG. 62 is an enlarged view of the forward figurine 907 shown in FIG. 61.

Referring to FIGS. 59-62, the embodiment can allow for a plurality of figurines that can include male/female figurines 901, each having two feet, each with dual pegs (which can consist of a tab and a catch) 903, 905, and other figurines 907 such as but not limited to animals, birds, fish, and the like, each having one set of dual pegs 908. The figurines 901, 907 can include any other shape, object and the like, such as those previously described.

A flotation device 920, can include a surfboard shape similar to those previously described. The flotation device 920 can have one or a plurality of through-hole slots 921, 924, 927 that run through the top surface of the flotation device 920 through the bottom surface. The bottom of each of the slots 921, 924, 927 can have a wider and larger opening than the top of each of the slots 921, 924 and 927.

The hydrofoil 930 can include a skeg 940 similar to those previously described. This skeg 940 can include an upper plate 942 with one or a plurality of upwardly protruding members 931, 934, 937. Each of these members 931, 934, 937 can have larger base portions adjacent to the upper plate 942 than the width at the top of each protruding members 931, 934, 937, and each can be sized to fit snugly into respective slots 921, 924, 927 in the flotation device 920.

The top of each of the protruding members 931, 934, 937 can have respective cavities 932, 935, 938 therein. Inside of each of the cavities 932, 935, 938 can be respective ledges/edges 933, 936, 939 therein.

After the protruding members 931, 934, 937 are positioned and inserted into the bottom of the slots 921, 924, 927 of the flotation device 920, the front and rear dual pegs 903, 905 can be inserted into the top of respective slots 921, 924. The dual pegs 903, 905 can be pushed down until the lower angled tip of the respective front peg catch 904 and one dual peg catch 906 snap about respective ledges/edges 933, 936 in the cavities 932, 935 and footer(s)/base(s) 902 abut against or rest adjacent to the top surface of the flotation device 920.

Next, the other figurine 907 having one dual peg 908 that can be pushed down into slot 927 until the lower angled tip of the respective peg catch 909 snaps about ledge/edge 939 in slot 927 and footer/base 910 of figurine 907 abuts against or rests adjacent to the top surface of the flotation device 920.

Referring to FIGS. 59-62, the figurine(s) 901, 907 can easily be removed and disassembled to allow for other figurines 901, 907 to be interchanged with the flotation device 920. A key ring 960 having a pin shape 962 that can be inserted into respective openings 943, 944, 945. The pin 962 can push against the respective catches 906, 904, 909 to move those catches 906, 904, 909 to detach from respective ledges/edges 933, 936, 939, allowing the figurines 901, 907 to be removed and interchanged.

The skeg 940 can include an enlarged bottom plate 946 similar to those previously described, and in this embodiment can have a front catch 948 similar to catches 904, 906, 909. A main wing 950 with vanes, similar to those previously described, can having an elongated slot 952 with a ledge/edge 953. The user can position the main wing 950 so that the elongated slot 952 is pushed up under the plate 946 until the angled tip edge of the catch 948 snaps about the ledge/edge 953 locking the main wing 950 to the skeg 940. To remove the main wing 950 from the skeg 940, the pin 962 on the key ring 960 can be pushed up into the opening 955 and can push against the catch 948 releasing the catch 948 from the ledge/edge 953 allowing the main wing 950 to be disassembled from the skeg 930.

Having the figurines 901, 907 to be disassembled from the flotation device 920 and allowing the hydrofoil 930 to be separated from the flotation device 920 and the main wing 950 to be removed from the skeg 940, allows the toy to be disassembled and easily transported or stored when the toy is not used.

FIG. 63 is another perspective view of the assembled surfing toy 900 of the preceding figures with one figurine 901 being used.

FIG. 64 is another perspective view of the assembled surfing toy 900 of the preceding figures with small figurine 907 shaped like a dolphin in the third slot 927.

FIG. 65 is another perspective view of the assembled surfing toy 900 of the preceding figures with a forward facing small figurine 907 such as dog in the second slot 924.

FIG. 66 is another perspective view of the assembled surfing toy 900 of the preceding figures with small figurine 907 such as a rearwardly facing pig in the first slot 921.

FIG. 67 is another perspective view of an assembled surfing toy 900B of the preceding figures with two top slots 921, 924 for interchangeably mounting different figurines 901, 901A therein.

FIG. 68 is a perspective view of attaching one of the interchangeable figurines 901, 907 and key 960 with pin 962 removably attached to a keychain 966.

FIG. 69 is a perspective view of the attaching the keychain 966 with figurines 901, 907 and key 960 with pin 962 to a backpack 970.

Sixteenth Embodiment Skateboard Toy Conversion

FIG. 70 is an exploded perspective view of figurines 901, 907 and surfboard (flotation device) 920 of the preceding figures for converting into a skateboard toy conversion 1000. This embodiment 1000 can include the same use of interchangeable figurines 901, 907 with flotation device 920 of the preceding figures. Here, instead of a removable hydrofoil 930, there can be a skateboard platform 1100 with a rear set of wheels 1110 and front set of wheels 1120 spaced apart from one another and mounted underneath.

The user can orient and position the upwardly bent front end 922 of the surfboard 920 into an open back of a closed tip clip 1130, while positioning the upwardly protruding members 931, 934 and 937 up into the bottom of respective slots 921, 924 and 927 until the bottom of the flotation device 920 rests against the top surface of the skateboard platform base 1100. Next the dual pegs 905, 903 and 908 of the figurines can be pushed down into the top of the respective slots 921, 924 and 927, and locked into place as previously described. The upwardly bent portion of the platform base 1100 can have weight(s) 1105 embedded thereon to allow the entire skateboard device 1000 to roll downhill and/or in a forward direction.

FIG. 71 is another exploded perspective view of a figurines 901, 907, and surfboard 920 of the preceding figures and another skateboard base 1100 having an open top tip clip 1135. The assembly of the figurines with the flotation device 920 and skateboard platform base 1100 can be done similar to the version shown in FIG. 70.

FIG. 72 is a perspective assembled view of FIG. 71 with the figurines 901, 907 mounted to the surfboard 920 which is mounted to the skateboard base 1100.

The figurines 901, 907 and the skateboard base 1100 can be disassembled by using the key 960 and pin 962 as described in the previous embodiment.

Seventeenth Embodiment Sled Toy Conversion

FIG. 73 is an exploded perspective view of figurines 901, 907 and surfboard 920 of the proceeding figures for a sled toy conversion 1200. FIG. 74 is a perspective assembled view of FIG. 73 with the figurines 901, 907 mounted to the surfboard 920 and mounted to the base 1210.

Referring to FIGS. 73-74, this embodiment 1200 can include the same use of interchangeable figurines 901, 907 with flotation device 920 of the preceding figures. Here, instead of a removable hydrofoil 930, there can be a sled platform base 1210 with a left sled rail 1220 and right sled rail 1230 spaced apart from one another and mounted underneath.

The user can orient and position the upwardly bent front end 922 of the surfboard 920 into an open back of a tip clip 1240, while positioning the upwardly protruding members 931, 934 and 937 up into the bottom of respective slots 921, 924 and 927 until the bottom of the flotation device 920 rests against the top surface of the sled platform base 1210. Next the dual pegs 905, 903 and 908 of the figurines 901, 907 can be pushed down into the top of the respective slots 921, 924 and 927, and locked into place as previously described. The upwardly bent portion of the platform base 1210 can have weight(s) 1215 embedded thereon to allow the entire sled toy 1200 to slide downhill and/or in a forward direction.

The figurines 901, 907 and the sled base 1210 can be disassembled by using the key 960 and pin 962 as described in the previous embodiment.

Eighteenth Embodiment Snowboard Toy Conversion

FIG. 75 is an exploded perspective view of the figurines 901, 907 and surfboard 920 of the preceding figures for a snowboard toy conversion 1300. FIG. 76 is perspective assembled view of FIG. 75 with the figurines 901, 907 mounted to the surfboard 920 which is mounted to the snowboard platform base 1310.

Referring to FIGS. 75-76, this embodiment 1300 can include the same use of interchangeable figurines 901, 907 with flotation device 920 of the preceding figures. Here, instead of a removable hydrofoil 930, there can be a snowboard platform base 1310.

The user can orient and position the upwardly bent front end 922 of the surfboard 920 into an open back of a tip clip 1340, while positioning the upwardly protruding members 931, 934 and 937 up into the bottom of respective slots 921, 924 and 927 until the bottom of the flotation device 920 rests against the top surface of the snowboard platform base 1210. Next the dual pegs 905, 903 and 908 of the figurines 901, 907 can be pushed down into the top of the respective slots 921, 924 and 927, and locked into place as previously described. The upwardly bent portion of the platform base 1310 can have weight(s) 1315 embedded thereon to allow the entire snowboard toy 1300 to slide downhill and/or in a forward direction.

The figurines 901, 907 and the snowboard base 1310 can be disassembled by using the key 960 and pin 962 as described in the previous embodiment.

Nineteenth Embodiment Carve Stick Attachment

FIG. 77 is an exploded view of another embodiment 1400 of the surfboard (flotation device) 920 with interchangeable figurines 901/907 and detached carve stick 1405. FIG. 78 is an assembled view of the surfboard 920 with attached figurine 901/907 and carve stick 1405 attached to the surfboard 920.

Referring to FIGS. 77-78, this embodiment 1400 allows for a carve stick 1405 that can include an elongated handle 1410 with an upward bend and top end 1430 having downwardly directed dual pegs 1440. The user can push the dual pegs 1440 into the slot 927 in the top of the surfboard 920 so that that catch portion of the dual pegs 1440 lock inside of a ledge/edge (as shown in the previous figures. The upward bend can have a lower curved or angled surface that can abut against an upper side edge of the surfboard 920. The user can use the carve stick 1405 to cause the surf toy (water toy) 1400 to carve (move) through water, causing wake spray to emulate a surfer's action, without requiring waves to move the surf toy, such as while playing in a swimming pool or lake.

The carve stick 1405 can also be used with the skateboard toy 1000, sled toy 1200 and snowboard toy 1300 in a similar manner to emulate a skateboarder or snowboarder, carving off natural or handmade snow berms, cardboard constructed, or imaginary miniature half pipes.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described herein.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A water toy having figurines and a hydrofoil and flotation device which parts are able to be easily assembled and disassembled from one another, comprising:

an elongated flotation device with front and rear ends, and top and bottom surfaces, and at least one slot extending between the top and bottom surfaces;

a hydrofoil with a skeg and main wing, the skeg including an upwardly protruding member with a top cavity, the upwardly protruding member insertable into the bottom of the flotation device into the at least one slot; and at least one figurine, each figurine having at least one peg member extending beneath, wherein the peg is insertable into the top of the flotation device into the at least one slot and into the top cavity of the upwardly protruding member so as to lock the elongated flotation device and hydrofoil and figurine in an assembled position.

2. The water toy of claim 1, wherein the flotation device includes: a surfboard configuration.

3. The water toy of claim 1, wherein the at least one slot extending between the top and bottom surfaces of the flotation device includes:

a plurality of slots spaced apart from one another extending between the top and bottom surfaces of the flotation device; and wherein the at least one figurine includes a plurality of different figurines.

4. The water toy of claim 1, wherein the at least one slot includes a wider opening through the bottom surface of the flotation device compared to a narrower opening through the top surface of the flotation device.

5. The water toy of claim 4, wherein the upwardly protruding member has an upper portion and a lower portion, the upper portion being narrower in width than the lower portion.

6. The water toy of claim 1, further comprising:

a catch and an edge for allowing the peg on the figurine to lockably attach into the cavity in the upwardly protruding member on the skeg.

7. The water toy of claim 1, further comprising:

a catch and an edge for allowing the main wing to lockably attach to the skeg.

8. The water toy of claim 6, further comprising:

a pin for pushing against the catch so that the catch detaches from the edge and allows the figurine to disassemble from the flotation device.

9. The water toy of claim 7, further comprising:

a pin for pushing against the catch so that the catch detaches from the edge and allows the main wing to disassemble from the skeg.

10. The water toy of claim 3, wherein the plurality of slots each include a wider opening through the bottom surface of the flotation device compared to a narrower opening through the top surface of the flotation device.

11. The water toy of claim 10, wherein the upwardly protruding member includes a plurality of upwardly protruding members, each member having an upper portion and a lower portion, the upper portion being narrower in width than the lower portion.

12. The water toy of claim 11, further comprising:

a plurality of catches and edges, each catch and edge for allowing the peg on each figurine to lockably attach into each cavity in the upwardly protruding member on the skeg.

13. The water toy of claim 11, further comprising:

a lower catch and lower edge for allowing the main wing to lockably attach to the skeg.

14. The water toy of claim 1, wherein the at least one figurine is selected from at least one of: a male shape, a female shape, an alien, an animal shape or a fish shape.

15. A water toy having figurines and a hydrofoil and flotation device which that is able to be easily assembled and disassembled from one another, comprising:

an elongated flotation device with front and rear ends, and top and bottom surfaces, and at least one slot extending between the top and bottom surfaces;

a hydrofoil having an upwardly protruding member with a top cavity, the upwardly protruding member insertable into the bottom of the flotation device into the at least one slot; and at least one figurine, each figurine having at least one peg member extending beneath, wherein the peg is insertable into the top of the flotation device into the at least one slot and into the top cavity of the upwardly protruding member so as to lock the elongated flotation device and hydrofoil and figurine in an assembled position.

16. The water toy of claim 15, wherein the at least one slot extending between the top and bottom surfaces of the flotation device includes:

a plurality of slots spaced apart from one another extending between the top and bottom surfaces of the flotation device; and wherein the at least one figurine includes a plurality of different figurines.

17. The water toy of claim 15, wherein the at least one slot includes a wider opening through the bottom surface of the flotation device compared to a narrower opening through the top surface of the flotation device.

18. The water toy of claim 17, wherein the upwardly protruding member has an upper portion and a lower portion, the upper portion being narrower in width than the lower portion.

19. The water toy of claim 15, further comprising:

a catch and an edge for allowing the peg on the figurine to lockably attach into the cavity in the top of the hydrofoil.

20. The water toy of claim 19, further comprising:

a pin for pushing against the catch so that the catch detaches from the edge and allows the figurine to disassemble from the flotation device.

* * * * *